US008842872B2

(12) United States Patent
Stevinson

(10) Patent No.: US 8,842,872 B2
(45) Date of Patent: Sep. 23, 2014

(54) KEYED EARPHONE CADDY AND CARRYING CASE

(71) Applicant: Dean Stevinson, Centennial, CO (US)

(72) Inventor: Dean Stevinson, Centennial, CO (US)

( * ) Notice: Subject to any disclaimer, the term of this patent is extended or adjusted under 35 U.S.C. 154(b) by 35 days.

(21) Appl. No.: 13/764,666

(22) Filed: Feb. 11, 2013

(65) Prior Publication Data

US 2013/0148839 A1 Jun. 13, 2013

Related U.S. Application Data

(63) Continuation-in-part of application No. 13/336,918, filed on Dec. 23, 2011, which is a continuation-in-part of application No. 13/167,662, filed on Jun. 23, 2011.

(60) Provisional application No. 61/357,921, filed on Jun. 23, 2010.

(51) Int. Cl.
*H04R 25/00* (2006.01)
*H04R 1/10* (2006.01)

(52) U.S. Cl.
CPC ..... *H04R 1/1033* (2013.01); *H04R 2201/107* (2013.01)
USPC ..... 381/384

(58) Field of Classification Search
USPC ..... 381/334, 384, 370; 206/701; 379/428.01; 455/575.1; 361/679.55
See application file for complete search history.

(56) References Cited

U.S. PATENT DOCUMENTS

| | | | |
|---|---|---|---|
| 363,495 | A | 5/1887 | Wilson |
| 1,426,537 | A | 8/1911 | Bauer |
| 2,287,368 | A | 6/1941 | Anderson |
| D136,783 | S | 12/1943 | Veck |
| 2,396,906 | A | 3/1946 | Windson |
| 2,981,990 | A | 9/1957 | Balderee |
| 3,161,723 | A | 12/1964 | Flower et al. |
| D209,330 | S | 11/1967 | Coderre et al. |
| 3,353,232 | A | 11/1967 | Brownson |
| 3,465,391 | A | 9/1969 | Armstrong |
| D221,511 | S | 8/1971 | Dufault |
| 3,736,925 | A | 6/1973 | Erman |
| 3,785,080 | A | 1/1974 | Wallace |
| 4,270,247 | A | 6/1981 | Freedom |
| D284,299 | S | 6/1986 | Auerbach et al. |
| 4,680,886 | A | 7/1987 | Caselli |
| D347,989 | S | 6/1994 | DeWard |
| 5,383,091 | A | 1/1995 | Snell |
| 5,867,355 | A | 2/1999 | Arai et al. |

(Continued)

OTHER PUBLICATIONS

U.S. Appl. No. 29/409,525 Notice of Allowance mailed Jan. 9, 2013, 8 pages.

(Continued)

*Primary Examiner* — Brian Ensey
*Assistant Examiner* — Norman Yu
(74) *Attorney, Agent, or Firm* — Lathrop & Gage LLP

(57) ABSTRACT

A keyed caddy storage system stores an earphone set proximate a digital media device (DMD). The keyed caddy storage system includes a first caddy configured for holding the earphone set and having a first keyed coupling. The keyed caddy storage system also includes a case configured for attachment to the DMD and forming a storage area for storing the earphone set held by the first caddy. The case has a second keyed coupling mateable with first keyed coupling to removably secure the first caddy within the storage area.

8 Claims, 65 Drawing Sheets

(56) References Cited

U.S. PATENT DOCUMENTS

| | | | | |
|---|---|---|---|---|
| 5,984,224 | A | 11/1999 | Yang | |
| 6,006,915 | A | 12/1999 | Moor | |
| 6,254,114 | B1 | 7/2001 | Pulling et al. | |
| 6,370,401 | B1 | 4/2002 | Baranowski et al. | |
| 6,542,757 | B2 | 4/2003 | Bae | |
| 6,601,808 | B1 | 8/2003 | Nagel | |
| 6,633,770 | B1 * | 10/2003 | Gitzinger et al. | 455/575.1 |
| D485,834 | S | 1/2004 | Davetas | |
| D488,460 | S | 4/2004 | Alwicker et al. | |
| 6,847,724 | B1 | 1/2005 | Weng et al. | |
| 6,928,704 | B2 | 8/2005 | Johnson | |
| D514,923 | S | 2/2006 | Brown | |
| 7,086,512 | B2 | 8/2006 | Shack et al. | |
| D529,288 | S | 10/2006 | Ham | |
| D553,352 | S | 10/2007 | Allen | |
| D556,020 | S | 11/2007 | Whitney | |
| D565,290 | S | 4/2008 | Brandenburg et al. | |
| D576,785 | S | 9/2008 | TerMeer | |
| D576,867 | S | 9/2008 | Kretz | |
| 7,492,917 | B2 | 2/2009 | Ito | |
| 7,500,644 | B2 | 3/2009 | Naudet et al. | |
| D600,673 | S | 9/2009 | Kim et al. | |
| D601,879 | S | 10/2009 | Kim et al. | |
| D603,376 | S | 11/2009 | Blasko | |
| D604,501 | S | 11/2009 | Lee | |
| D606,529 | S | 12/2009 | Ferrari et al. | |
| D620,781 | S | 8/2010 | Weckworth | |
| D624,064 | S | 9/2010 | Esposito | |
| 7,801,322 | B2 | 9/2010 | Chiu | |
| D626,129 | S | 10/2010 | Lutz | |
| D634,115 | S | 3/2011 | Long et al. | |
| D635,555 | S | 4/2011 | Giles | |
| D641,974 | S | 7/2011 | Stampfli | |
| D644,428 | S | 9/2011 | Feng | |
| D644,639 | S | 9/2011 | Weller et al. | |
| 8,016,107 | B2 | 9/2011 | Emsky | |
| D657,137 | S | 4/2012 | Weller et al. | |
| D661,482 | S | 6/2012 | Chang et al. | |
| D673,936 | S | 1/2013 | Michie et al. | |
| D673,940 | S | 1/2013 | Chang et al. | |
| D673,941 | S | 1/2013 | Melanson et al. | |
| 8,345,913 | B2 | 1/2013 | Pang et al. | |
| D683,955 | S | 6/2013 | Melanson et al. | |
| D688,234 | S | 8/2013 | Esses | |
| 2001/0035242 | A1 | 11/2001 | Hughs et al. | |
| 2002/0079244 | A1 | 6/2002 | Kwong | |
| 2005/0150796 | A1 | 7/2005 | Wong et al. | |
| 2007/0154048 | A1 | 7/2007 | Chang | |
| 2008/0053851 | A1 | 3/2008 | Ko et al. | |
| 2009/0036175 | A1 * | 2/2009 | Brandenburg et al. | 455/575.1 |
| 2009/0242364 | A1 | 10/2009 | Prest et al. | |
| 2010/0096284 | A1 | 4/2010 | Bau | |
| 2011/0077061 | A1 | 3/2011 | Danze et al. | |
| 2011/0203954 | A1 * | 8/2011 | Kroupa | 206/320 |

OTHER PUBLICATIONS

U.S. Appl. No. 29/409,547 Non-Final Office Action mailed Jan. 8, 2013, 7 pages.

U.S. Appl. No. 29/409,547 Response to Office Action filed Apr. 8, 2013, 9 pages.

PCT/US11/67263 Search Report and Written Opinion mailed Jul. 11, 2012, 13 pages.

U.S. Appl. No. 29/409,520 Notice of Allowance mailed Oct. 3, 2012, 8 pages.

U.S. Appl. No. 29/409,528 Notice of Allowance mailed Sep. 26, 2012, 8 pages.

U.S. Appl. No. 29/409,525 Ex Parte Quayle Action mailed Sep. 26, 2012, 6 pages.

U.S. Appl. No. 29/409,521 Notice of Allowance mailed Sep. 26, 2012, 8 pages.

U.S. Appl. No. 29/409,547 Final Office Action mailed Jul. 23, 2013, 7 pages.

U.S. Appl. No. 13/336,918 Non Final Office Action mailed Sep. 25, 2013, 14 pages.

U.S. Appl. No. 13/336,918 Response to Office Action filed Dec. 20, 2013, 9 pages.

U.S. Appl. No. 29/409,531 Notice of Allowance mailed Dec. 6, 2013, 10 pages.

U.S. Appl. No. 29/409,529 Non-Final Office Action mailed Dec. 4, 2013, 13 pages.

U.S. Appl. No. 29/409,529 Response to Non-Final Office Action filed Mar. 3, 2014,16 pages.

* cited by examiner

KEYED EARPHONE CADDY AND CARRYING CASE

RELATED APPLICATIONS

This application is a continuation-in-part of U.S. patent application Ser. No. 13/336,918, filed Dec. 23, 2011, which is a continuation-in-part of U.S. patent application Ser. No. 13/167,662, filed Jun. 23, 2011, which claims priority to U.S. Patent Application Ser. No. 61/357,921, titled "Protective Holder for Digital Media Device and Auxiliary Devices", filed Jun. 23, 2010, and each of which is incorporated herein by reference.

BACKGROUND

Hand held digital media devices (DMDs) come in many forms, such as: cellular phones, digital music players, digital video players, AM/FM radios, and so on. Most DMDs are small enough to fit in a pocket, a purse or a briefcase, and many require the user to wear an earphone set or a headset (or similar listening device) for optimal enjoyment. However, these earphone sets (or other listening devices) easily become tangled, damaged, or are lost when transported unprotected, such as when wound around a DMD or carried loose in a pocket or bag. When included, a carrying case supplied with an earphone set is typically either a bulky hard structure or a cloth bag. Bulky earphone storage cases and cloth storage bags are additional items that a user must keep track of. Although cloth bags are not bulky, they do nothing to neatly store and organize the earphone set. As a result, earphone sets/headsets are usually stored separate from the DMD and are thus easily lost, or are wrapped around the DMD and exposed to damage, and further inhibit use of the DMD.

DMD manufacturers (e.g., Apple™, Nokia™, Samsung™, and BlackBerry™) sell many lines of mobile devices such as cell phones, music players, video players, notebook computers, and gaming devices. These manufacturers typically supply earphone sets to compliment the functions of the DMD and may also supply protective covers to protect the devices from damage. Although these manufacturers occasionally market a limited variety of earphone sets and protective cases, most earphone sets and protective cases are manufactured and sold by other companies (i.e., companies other than the manufacturers of the DMDs). For the most part, DMD manufacturers are focused on selling the DMD itself and have done little to help the consumer efficiently manage and transport the DMD and earphone set together.

Protective case manufacturers (e.g., In-Case™, OtterBox™, Speck™,iFrogz™) sell protective cases to cover and protect a DMD, but do not protect or secure the earphone set that is provided with the DMD. Where a case for protecting a mobile device does provide for storing the associated earphone set, these cases are big and bulky and provide only containment without organization of the earphone set subcomponents.

DMDs, particularly from different manufacturers, have unique physical characteristics and dimensions and thereby have unique form signatures. Protective cases for these DMDs are therefore designed to fit one particular DMD. For example, a protective case for an Apple iPhone 4s will not fit a Samsung Galaxy S, and vise versa. Thus, it can be said that a protective case is keyed to a particular DMD.

Protective case manufacturers are focused primarily on selling protective cases for DMDs and have done little to help the consumer efficiently manage, control or store earphone sets for transport together with the DMD.

Earphone set manufacturers (e.g., Skull Candy™, Klipsh™, and BOSE™) sell earphone sets that work with many different DMDs. DMD users may choose to purchase a third-party earphone set because they offer higher fidelity, better fit or better aesthetics. Regardless of the source of the earphone set, most end up stuffed in pockets or are wrapped around the DMD, and are often forgotten, misplaced or damaged.

Manufacturers of earphone sets are focused primarily on selling the earphone sets and have done little to help the consumer efficiently manage, control or store the earphone sets for transport together with the DMD.

SUMMARY

A keyed storage system protects a DMD with a case that includes a storage area for safely and compactly storing an earphone set captured by one of the following means of a:

a) keyed caddy that forms a skeleton around which the earphone set is wrapped and captured, where the keyed caddy has a keyed coupling that is keyed to the DMD case.
b) keyed caddy that forms a skeleton around which the earphone set is wrapped and captured, where the keyed caddy is has a keyed coupling which is keyed to a compartment that is keyed and made removable from a DMD case.
c) keyed dual purpose case which is keyed to retain a specific target DMD and a specific singular or dual target set of earphones via a keyed caddy that forms a skeleton around which the earphone set is wrapped captured.
d) keyed exoskeleton compartment, wherein the compartment has a coupling which is keyed and made removable from a DMD case.
e) exoskeleton compartment that is part of a DMD case.
f) wireless earphone compartment that is keyed to a specific wireless earphone and is part of a DMD case.

The keyed storage system provides manufacturers of cases, mobile devices and earphone sets a new level of control over their products. The keyed storage system provides these companies with new marketing and branding opportunities. The keyed storage system allows consumers to store a paired earphone set with a DMD in a very compact, ergonomic and user-friendly form.

The keyed storage system provides many competitive advantages by controlling the ability to mate earphone sets to DMD's. The advantages are achieved using an exclusive intermediate locking mechanism engineered into DMD protective covers and engineered into the keyed caddy and storage compartment or exoskeleton storage case or compartment. The advantages are better understood by understanding the relationship between DMD manufacturers, protective case manufacturers, and earphone set manufacturers.

The above stated advantages of the keyed storage system is further enhanced by making the storage compartment containing the earphones a self-contained unit that is also keyed to, and detachable from, the DMD protective case. The self-contained earphone storage case is made attachable or removable to a target DMD protective case via a keyed relationship. In addition, the earphones are retained in close proximity to the DMD by means of a: keyed skeleton caddy keyed to a storage compartment which also hold the DMD; a keyed removable storage compartment; or a case keyed to retain together a specific target DMD with a specific target earphone or pair of earphones.

There are many beneficial reasons to allow the earphone storage case to function independently from the DMD and yet still mate with the DMD when desired by the user.

Some users may wish to separate earphone storage compartment from the DMD case for a short period of time while maintaining the two storage components in close proximity. For instance, a person going to the gym for a workout session may enter the facility with a earphone case and a DMD protective case locked together. Once inside the facility, the user may wish to leave his/her phone in a locker, but take the protective case containing the earphones into the facilities workout area. Many modern workout machines, such a stationary bikes and treadmills are earphone compatible and feed TV and audio signals through the equipment making sound available to owners of earphones who bring the earphones into the workout facility. When the user is finished exercising, he/she can reattach the earphone case to the DMD case and leave the workout facility with the two devices recombined in a single ergonomic package.

Other users may wish to use the DMD separately from the stored earphones and leave the earphones behind for a period of time, but in close proximity and fully protected with a case. One occasion whereby a user may wish to separate the earphones storage case containing the earphone and caddy from the DMD is when going out to a nightclub or to an evening dinner. New clothing styles, such as skinny jeans, may make the case uncomfortable when placed in a tight pocket. The user may wish to take the phone along, but choose to leave the earphones behind in the car. The earphones may have been used during the day but not needed in the evening.

Earphone manufacturers will find it beneficial to package together earphones and a protective case, one that is keyed to mate with a separately packaged DMD case. The arrangement provides the earphone purchaser a fully organized earphone secured by a caddy and contained within a protective case. The purchaser would then have the option of purchasing, if desired, compatible DMD protective case that mates with the earphone protective case, or being content knowing the earphones were packaged with a caddy and a earphone case that protects their investment better than being packaged with just a caddy.

Some earphone buyers may wish have the option of storing their earphones separately from time to time from their handheld DMD, so that they are available for use in conjunction with for example a notebook computer in a hotel room while the phone is used individually.

Purchasers will benefit from having an earphone storage case which is sold separately but still couples with a manufacturer's line of DMD protective cases. The invention allows the DMD case and the earphone case to be combined via a keyed locking mechanism or, as desired, decoupled and operate separate and independent from each other. This arrangement provides independent protection to both the DMD and earphones when they are apart or in combination as a unit. The user of the invention is provided greater flexibility and protection from this enhanced arrangement.

By making the earphone storage case detachable from the DMD protective case, users have the benefit of reducing bulk by taking only one of the devices with them and leaving the other behind in a safe and secure protective compartment.

Wireless non-corded earphone users may benefit from having a single molded case that is capable of securing by direct keyable means, both a DMD and a target wireless earphone/s.

Wireless non-corded earphone users may benefit from having a single molded case that is capable of securing by direct keyable means, both a DMD and a target wireless earphone/s while also facilitating the recharging of the wireless earphones battery by various means.

In one embodiment, a keyed caddy storage system stores an earphone set proximate a digital media device (DMD). The keyed caddy storage system includes a first caddy configured for holding the earphone set and having a first keyed coupling. The keyed caddy storage system also includes a case configured for attachment to the DMD and forming a storage area for storing the earphone set held by the first caddy. The case has a second keyed coupling mateable with first keyed coupling to removably secure the first caddy within the storage area.

In another embodiment, a keyed caddy stores and protects an earphone set proximate a digital media device (DMD). The keyed caddy includes a contoured plate configured to hold the earphone set such that cables of the earphone set are wrappable about the contoured plate, the contoured plate having a first keyed coupling that mates with a second keyed coupling formed with a case that (a) forms a storage area for the contoured plate holding the earphone set and (b) attaches with the DMD.

In another embodiment, a case stores an earphone set proximate a digital media device (DMD). The case includes a base component that attaches to the DMD, a lid component that couples with the base component to form a storage area, and a first keyed coupling for removably mating with a second keyed coupling of a keyed caddy configured to hold the earphone set. The first keyed coupling and the second keyed coupling form a matched pair and are non-mateable with a keyed coupling of a different matched pair.

In another embodiment, a method stores an earphone set proximate a digital media device (DMD), and includes the steps of: forming a case that attaches to the DMD and has a second keyed coupling and a storage area; and forming a keyed caddy with a first keyed coupling matched with the second keyed coupling, such that the first and second keyed couplings are removably mated to position the earphone set held by the keyed caddy within the storage area.

In another embodiment, a method uniquely couples an earphone storage case to a digital media device (DMD) case. The method includes the steps of: configuring the earphone storage case with a first keyed coupling; and configuring the DMD case with a second keyed coupling that matches the first keyed coupling. The first and second keyed couplings removably mate to secure the earphone storage case to the DMD case.

In another embodiment, product packaging for a digital media device (DMD) and accompanying earphone set promotes sale of a DMD case. The packaging includes: keyed caddy having a first keyed coupling and configured to hold the earphone set; and container for containing the DMD and the earphone set held by the keyed caddy. The first keyed coupling matches a second keyed coupling of the DMD case.

In another embodiment, a method designs an earphone caddy to store an earphone set within an earphone set storage case. The method includes the steps of: forming a caddy to hold the earphone set; and configuring the caddy with a first keyed coupling that uniquely couples with a second keyed coupling of the earphone storage case. Each of the first and second keyed couplings includes irregularities that interleave when the caddy and the earphone set storage case are mated.

In another embodiment, a case stores an earphone set proximate a digital media device (DMD). The case includes a base component that attaches with the DMD and forms a storage area that is accessible via an aperture in the base component, and a lid component that couples with the base component to close the aperture, where an inner surface of the lid has a first keyed coupling that holds a component of the earphone set.

In another embodiment, a keyed caddy stores and protects an earphone set proximate a digital media device (DMD). The keyed caddy includes a contoured plate configured to hold the earphone set such that cables of the earphone set are wrappable about, earpieces and a jack plug of the earphone set are snappable to, the contoured plate. The contoured plate has a first keyed coupling that mates with a second keyed coupling formed with a case that (a) forms a storage area for the contoured plate holding the earphone set and (b) attaches with the DMD.

In another embodiment, a combination case protects a digital media device (DMD) and stores an earphone set having two wireless earpieces proximate the DMD. The combination case includes a base component that attaches with, and protects, the DMD, a raised portion, positioned on the rear external face of the base component, shaped to receive each earpiece of the wireless earphone set, and two connectors that each mechanically couple with one of the wireless earpieces to removably retain each wireless earpiece.

DETAILED DESCRIPTION OF THE EMBODIMENTS

Figure 1:
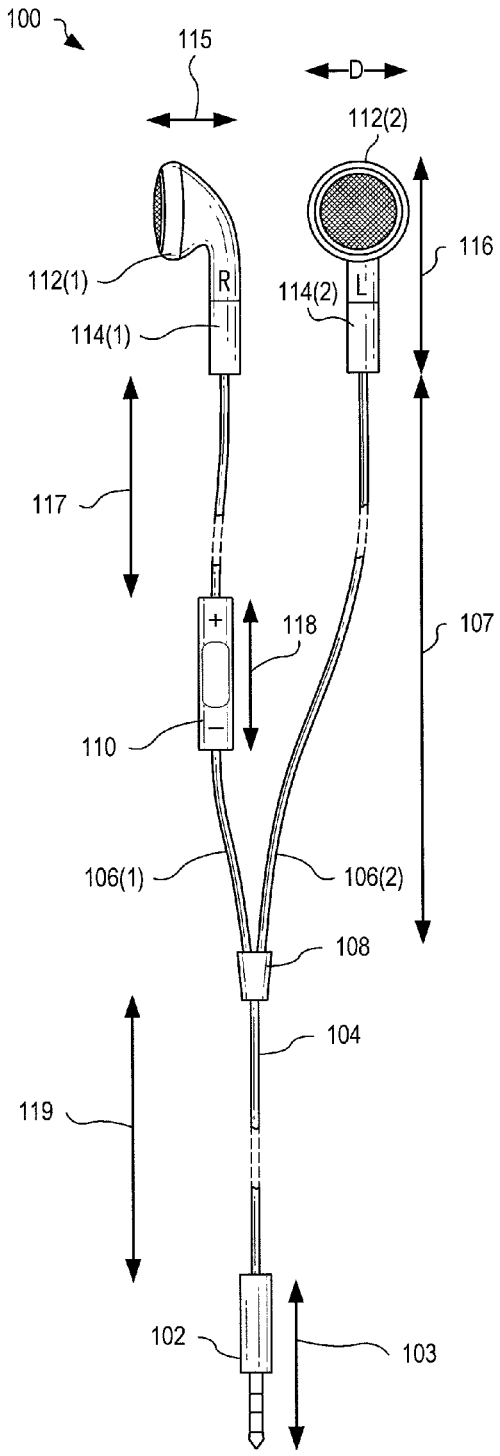
FIG. 1 PRIOR ART
FIG. 1 shows a first exemplary prior art earphone set with two ear-bud style earpieces.

The present disclosure may be understood by reference to the following detailed description considered in conjunction with the drawings. Note that, for purposes of illustrative clarity, certain elements in the drawings are not drawn to scale. Reference numbers for items that appear multiple times may be omitted for clarity. Where possible, the same reference numbers are used throughout the drawings and the following description to refer to the same or similar parts.

In the following embodiments, reference is made to a digital media device (DMD) that may be selected from the group including an iPod, an iPhone, an iPad, an iTouch, a notebook computer, a laptop computer, a personal DVD player, an MP3 player, a cell phone, a hand-held recording device and a personal digital assistant (PDA). Other DMDs may be used without departing from the scope hereof. Further, the examples of DMD case shown herein have flat edges. However, DMD cases may be configured with rounded edges as a matter of design choice without departing from the scope hereof.

Details of caddy design for storing a specific earphone set can be found in U.S. patent application Ser. No. 13/336,918. The following teaching provides improvements to the caddy design by incorporating a keying mechanism that matches the caddy to a specific case. This keying mechanism requires that a storage case that matches the keying of the caddy be used for storing an earphone set mounted onto the caddy.

Keyed Protective Case which Retains Together Target Earphone Via Keyed Skeleton Caddy and a Target DMD.

FIG. 1 shows a first exemplary prior art earphone set 100 with a jack plug 102 coupled with a cable 104 that splits into wires 106(1) and 106(2) at a junction splitter 108, a remote control and microphone 110 positioned in line with wire 106(1), and two ear-bud style earpieces 112(1) and 112(2), each having a stem 114(1) and 114(2) that couples to wires 106(1) and 106(2), respectively. Earpieces 112 have a diameter D that allows their use within a human ear. Earpieces 112 have a depth 115 and a length 116. Remote control and microphone 110 has a length 118 and is positioned a distance 117 from stem 114(1) along wire 106(1), which has an overall length 107. Cable 104 has a length 119 from junction splitter 108 to jack plug 102, which has a length 103. Jack plug 102, junction splitter 108, remote control and microphone 110, and earpieces 112 are substantially rigid. Earphone set 100 may represent prior art ear-bud style earphone sets sold by Apple™, for example.

Figure 2:
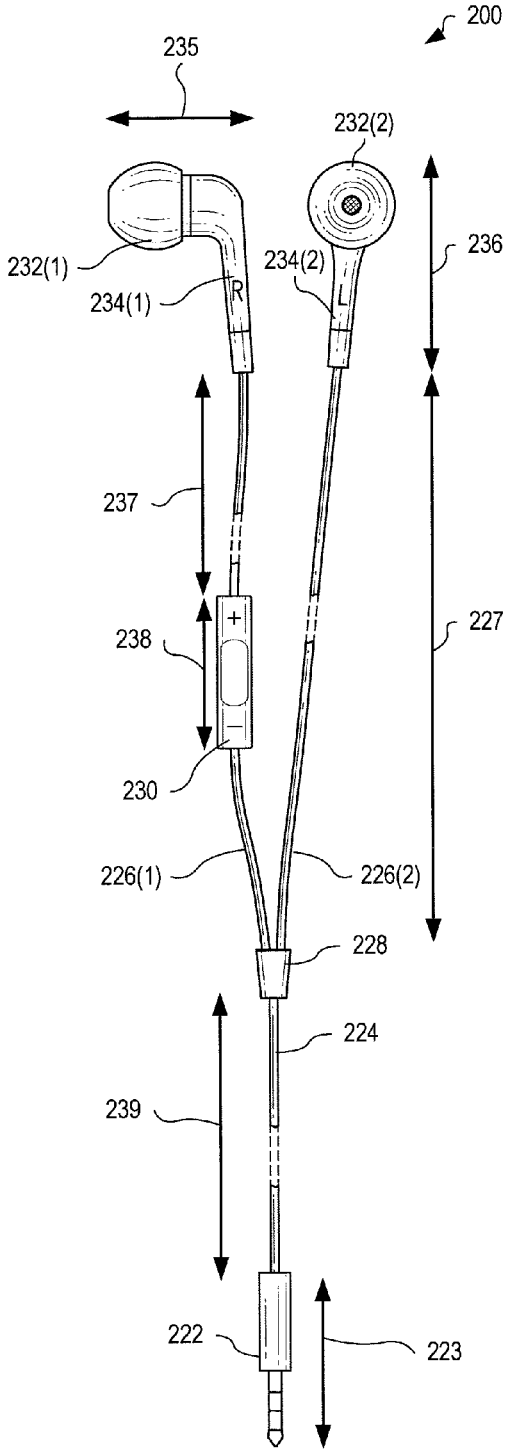
FIG. 2 PRIOR ART
FIG. 2 shows second exemplary prior art earphone set of an in-ear style.

FIG. 2 shows second exemplary prior art earphone set 200 of an in-ear style that include a jack plug 222 coupled with a cable 224 that splits into wires 226(1) and 226(2) at a junction splitter 228, a remote control and microphone 230 positioned inline with wire 226(1), and two in-ear style earpieces 232(1) and 232(2), each having a stem 234(1) and 234(2) that couples to wires 226(1) and 226(2), respectively. Earpieces 232 have a depth 235 and a length 236. Dimension of earphone set 200 may be similar to those of earphone set 100, except that depth 235 may be larger than depth 115 due to the in-ear styling. Remote control and microphone 230 has a length 238 and is positioned a distance 237 from stem 234(1) along wire 226(1), which has an overall length 227. Cable 224 has a length 239 from junction splitter 228 to jack plug 222, which has a length 223. Jack plug 222, junction splitter 228, remote control and microphone 230, and earpieces 232 are substantially rigid. Earphone set 200 may represent in-ear style prior art earphone devices sold by Apple™, for example.

Figure 3:
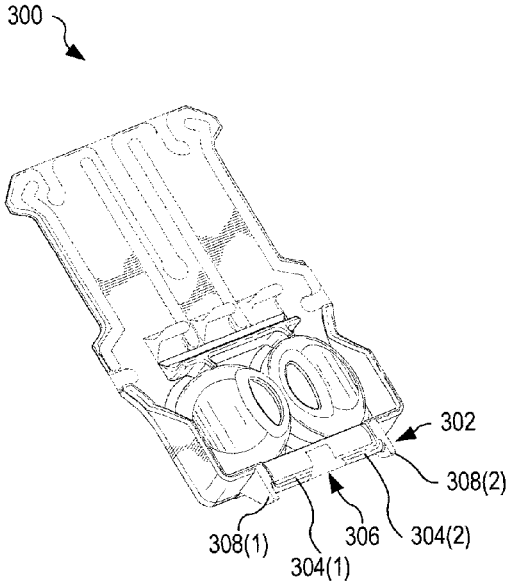
FIGS. 3 and 4 are perspective views of one exemplary caddy that is designed to receive and capture the earphone set of FIG. 1, in an embodiment.
Figure 4:
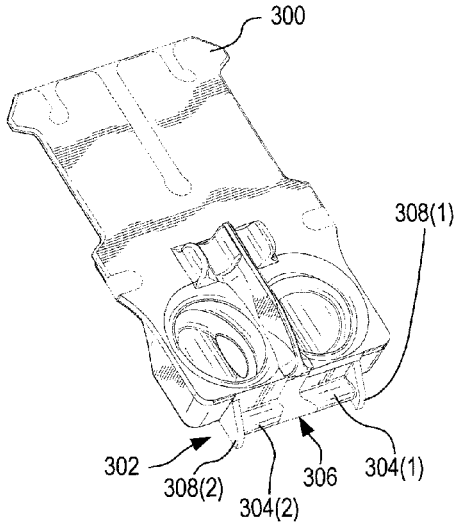
Figure 7:
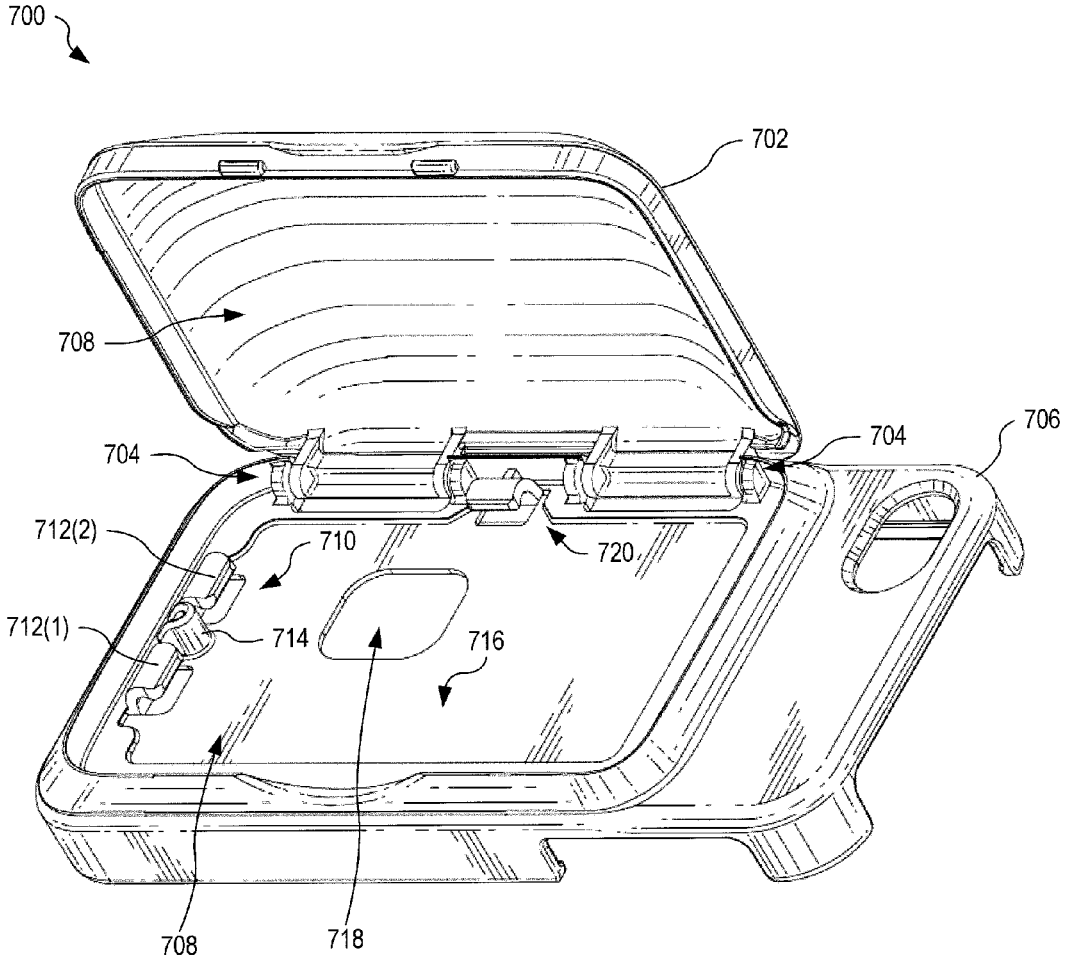
FIG. 7 shows one exemplary DMD combo keyed storage case for receiving one of the caddies of FIGS. 3-6, in an embodiment.

FIGS. 3 and 4 are perspective views of one exemplary keyed caddy 300 that is designed to hold each sub-component of earphone set 100 of FIG. 1, such that earphone set 100 is compactly and safely held by caddy 300 and occupies a minimal volume. The caddy mounted earphone set is easily stored within a storage area proximate the DMD. FIG. 7 shows one exemplary DMD combo keyed storage case 700 for receiving caddy 300. FIGS. 3, 4, and 7 are best viewed together with the following description.

Storage case 700 is formed with a lid 702 that is coupled by a hinge 704 to a base 706. In the embodiment of FIG. 7, lid 702 is substantially rigid, maintaining a domed shape to form storage area 708. Base 706 is configured for coupling to the rear of an iPhone™, however, base may be configured to couple with other DMDs without departing from the scope hereof.

Given the variance in the size and shape of sub-components and the positioning of these sub-components relative to one another with earphone sets of different styles and even similar styles for different manufacturers, each caddy (e.g., caddy 300) is designed and sized to store and protect one particular earphone set (e.g., one earphone set of a particular manufacturer). That is, earphone sets having other styles and/or manufacturers cannot be optimally stored on caddy 300 because of variance in component size and cable lengths. Thus, caddy 300 is effectively keyed to earphone set 100. As appreciated, a caddy may be provided for any specific earphone set design to provide optimal storage, protection and presentation for that earphone set. For example, rather than simply winding and securing leads of the earphone set using a wire twist, an earphone manufacturer and/or supplier may wind the earphone set (e.g., earphone set 100) onto a specifically design caddy (e.g., caddy 300) to optimally store, protect, and present the earphone set to a customer. Caddy 300 is a plate with contoured portions for receiving earpieces 112 and around which wires and cables of earphone set 100 are wrapped. The contoured plate of caddy 300 may also have retaining clips into which stems 114 of earpieces 112, and/or jack plug 102, snap such that earphone set 100 is held by keyed caddy 300.

Caddy 300 is shown with a first keyed coupling 302 that is able to mate (hereinafter "mateable") with a second keyed coupling 710 within storage case 700, such that when mated, first keyed coupling 302 and second keyed coupling 710 removably secure caddy 300 within storage area 708 of keyed storage case 700. In the example of FIGS. 3 and 4, first keyed coupling 302 is formed with two tabs 304(1) and 304(2) that are positioned either side of an opening 306 and between two end stops 308(1) and 308(2). Collectively, tabs 304, opening 306, and end stops 308 form the keying of first keyed coupling 302 with second keyed coupling 710. Tabs 304(1) and 304(2) are captured by clasps 712(1) and 712(2), respectively, of second keyed coupling 710 to secure caddy 300 within storage area 708. Second keyed coupling 710 has a post 714 that is received by opening 306 during coupling and that further operates, based upon leverage of a rear surface of opening 306 against post 714, to extract tabs 304 from clasps 712 when caddy 300 is lifted away from backing surface 716; thereby preventing excessive force being applied to clasps 712 such as would occur if tabs 304 remained within clasps 712 as caddy 300 is lifted. Surface 716 is shown with an aperture 718 to facilitate separation of case 700 from a DMD.

Figure 5:
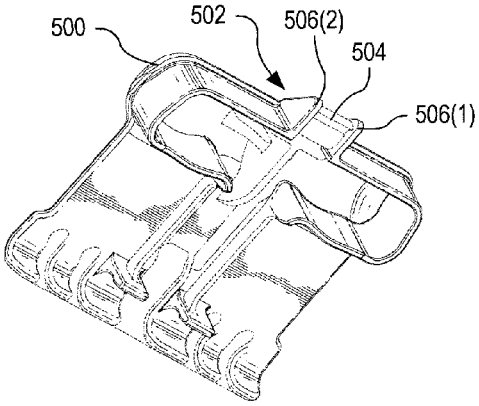
FIGS. 5 and 6 are perspective views of one exemplary caddy that is designed to receive and capture the earphone set of FIG. 2, in an embodiment.
Figure 6:
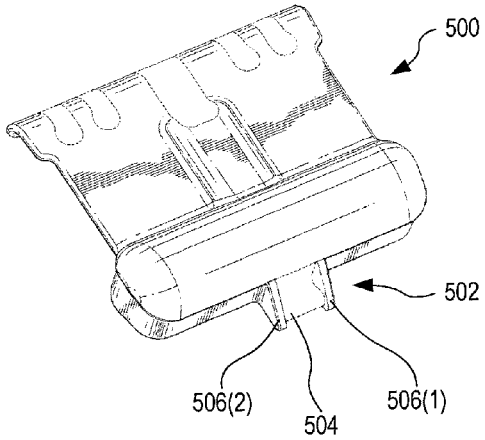

FIGS. 5 and 6 are perspective views of one exemplary keyed caddy 500 that is designed to hold each sub-component of earphone set 200 of FIG. 2, such that earphone set 200 is compactly and safely stored using a minimal volume. Earphone set 200, held by keyed caddy 500 is easily stored within storage area 708 of case 700. FIGS. 5, 6, and 7 are best viewed together with the following description. Caddy 500 is a plate with contoured portions for receiving earpieces 232 around which wires and cables of earphone set 200 is wrapped. The contoured plate of keyed caddy 500 may also have retaining clips into which stems 234 of earpieces 232 and/or jack plug 222 snap such that earphone set 200 is held by keyed caddy 500.

Caddy 500 is shown with a first keyed coupling 502 that is mateable with a second keyed coupling 720 within storage case 700, such that when mated, first keyed coupling 502 and second keyed coupling 720 removably secure keyed caddy 500 within storage area 708 of keyed storage case 700. In the example of FIGS. 5 and 6, first keyed coupling 502 is formed with a tab 504 that is between two end stops 506(1) and 506(2). Collectively, tab 504 and end stops 506 form the keying of first keyed coupling 502 with second keyed coupling 720. First keyed coupling 502 is different from first keyed coupling 302 of caddy 300 such that coupling 502 is mateable only with second keyed coupling 720 and is not mateable with second keyed coupling 710.

Figure 8:
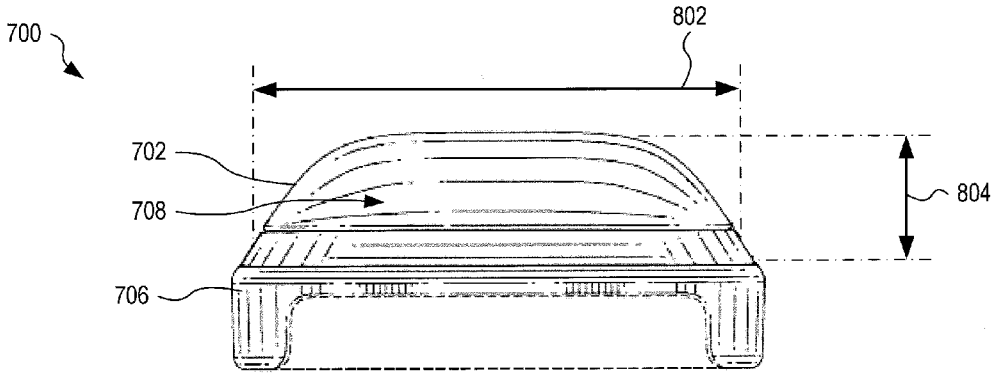
FIGS. 8 and 9 show elevations of the storage case of FIG. 7.
Figure 9:
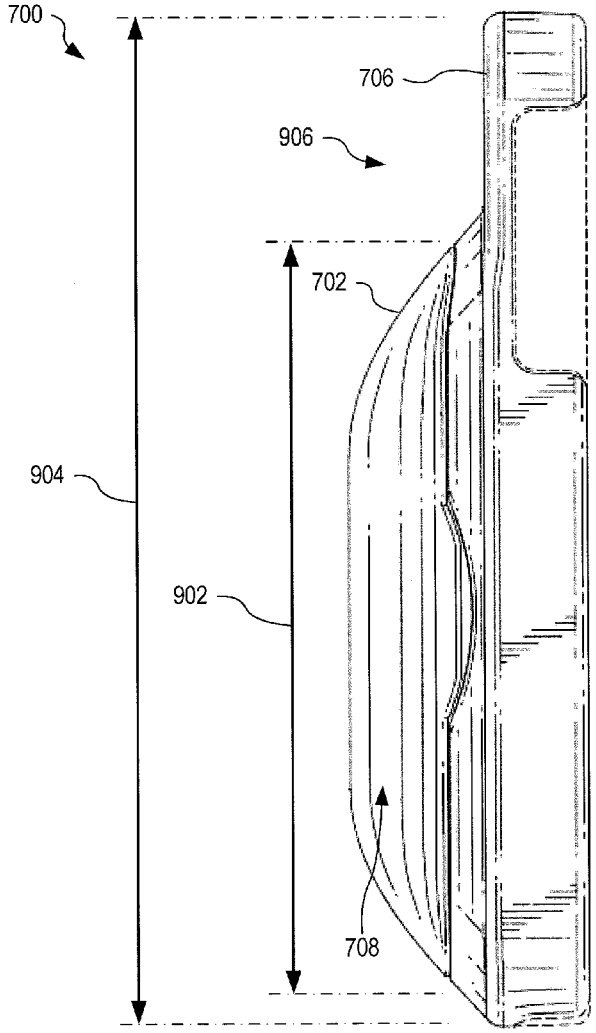

FIG. 8 shows an end elevation of storage case 700 of FIG. 7. As shown, width 802 of storage area 708 is substantially equal to the width of base 706 (i.e., the width of the DMD). Height 804 of storage area 708 is sufficient for storing either earphone set 100 held by (i.e., wound onto) keyed caddy 300 or earphone set 200 held by (i.e., wound onto) keyed caddy 500. FIG. 9 shows a side elevation of storage case 700 of FIGS. 7 and 8. As shown, length 902 of storage area 708 is less than the length 904 of base 706 (i.e., the length of the DMD), and storage are 708 is positioned toward a lower end of base 706 (i.e., the lower end of the DMD). An upper portion 906 of base 706 remains uncovered by storage area 708 to reduce interference with components (e.g., camera) positioned in that area of the DMD. The ergonomic shape and size of case 700 also improves handling and comfort of using the DMD.

Figure 10:
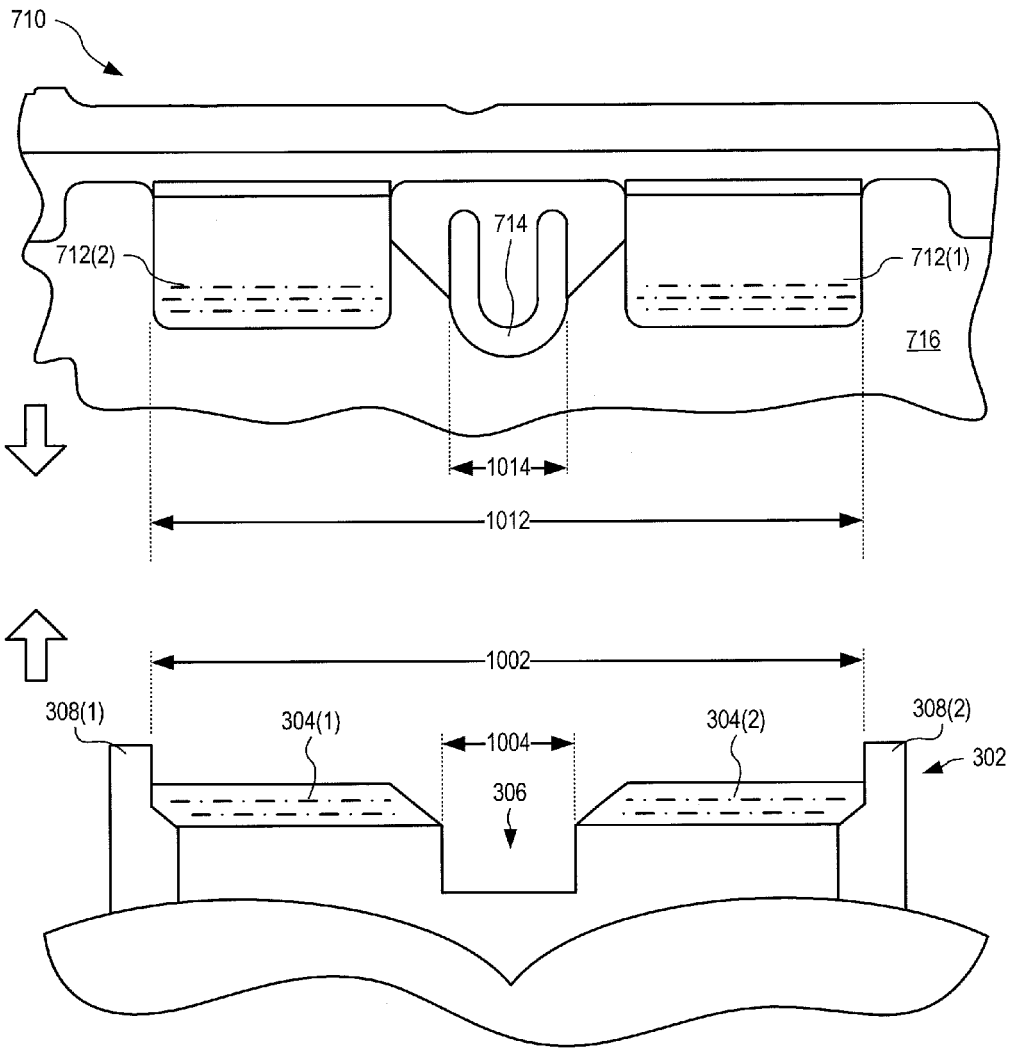
FIG. 10 shows exemplary detail of a first keyed coupling of the caddy of FIGS. 3 and 4 and a second keyed coupling of the case of FIG. 7, in an embodiment.

FIG. 10 shows exemplary detail of first keyed coupling 302 of FIGS. 3 and 4 and second keyed coupling 710 of FIG. 7. As shown, keyed couplings 302 and 710 are designed (i.e., specifically keyed) to mate together. Width 1004 of opening 306 is configured to receive width 1014 of post 714, width 1002 between end posts 308 receives width 1012 of clasps 712, wherein this combination of widths 1002, 1004, 1012, and 1014 and components 304, 306, 308, 712, and 714 provides a unique coupling between first and second keyed couplings 302 and 710.

Figure 11:
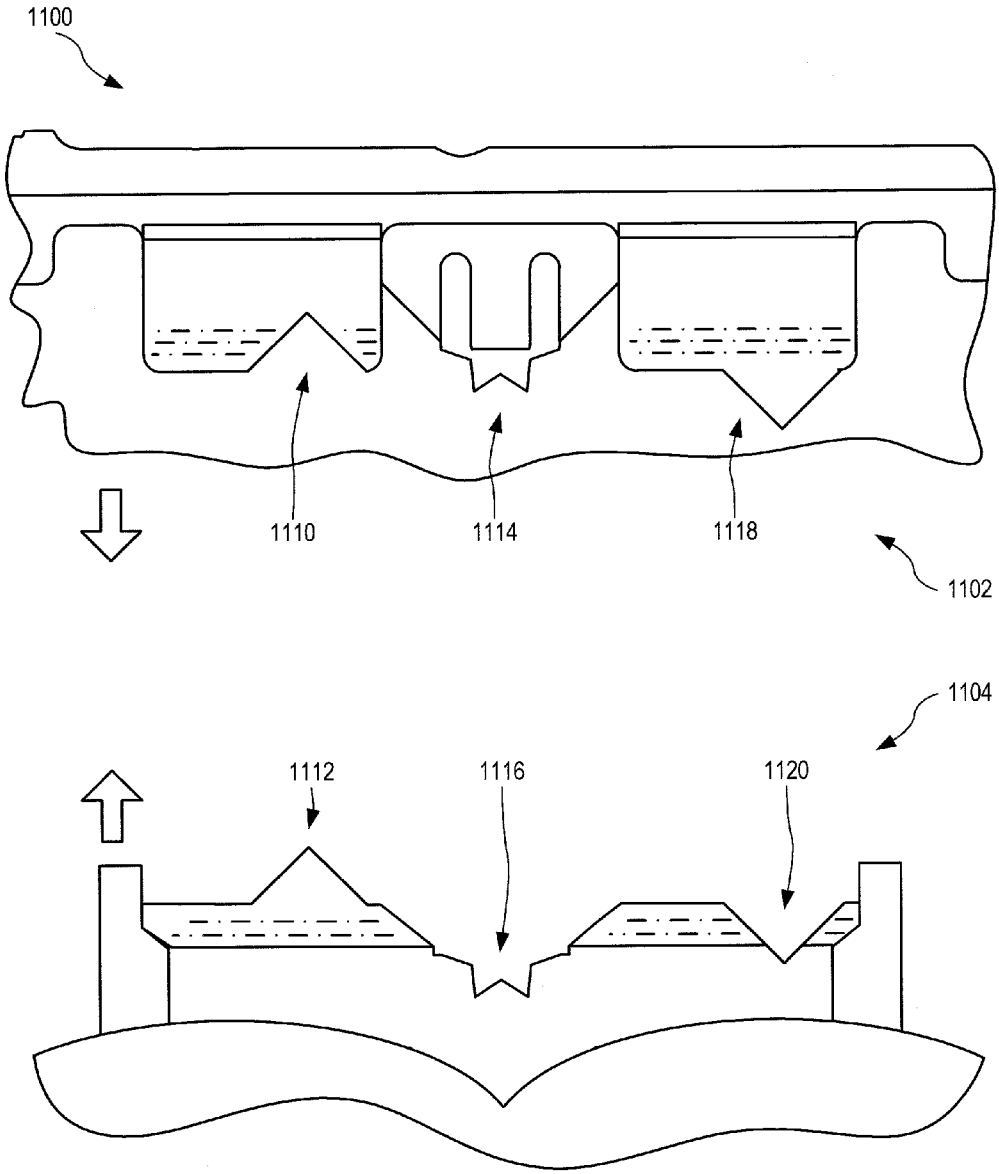
FIG. 11 shows exemplary detail of an alternate keyed coupling that has additional irregular keyed portions that increase variability and uniqueness, in an embodiment.

FIG. 11 shows an alternate keyed coupling pair 1100 that have irregularities 1110, 1114, 1118, 1112, 1116, and 1120 (i.e., irregular features) that increase variability and uniqueness of the keyed coupling. Keyed coupling pair 1100 is formed of a first keyed coupling 1102 and a matching second keyed coupling 1104 that are similar to keyed couplings 302 and 710, respectively, as shown in FIGS. 3, 7 and 8. Keyed couplings 1102 and 1104 are designed to mate together, where keyed coupling 1102 is formed with irregularities 1110, 1114, and 1118, that complement irregularities 1112, 1116, and 1120, respectively, of keyed coupling 1104. Specifically, keyed couplings 1102 and 1104 are mateable, but will not mate with keyed coupling 302 because of irregularities 1110, 1114, and 1118. That is, irregularities 1110, 1114, 1118, 1112, 1116, and 1120 inhibit each keyed coupling 1102 and 1104 from coupling with non-complimenting (i.e., non-matching and non-mateable) keyed couplings.

Figure 12:
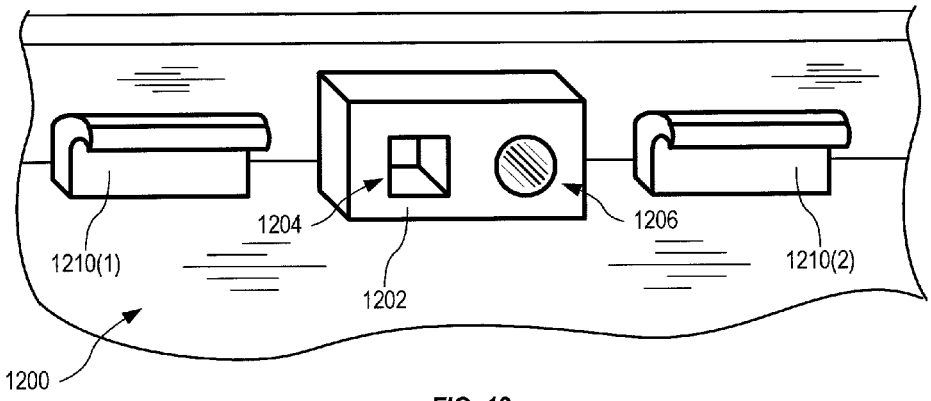
FIG. 12 is a perspective view of an exemplary alternative keyed coupling formed with a key block having a plurality of key features, in an embodiment.
Figure 13:
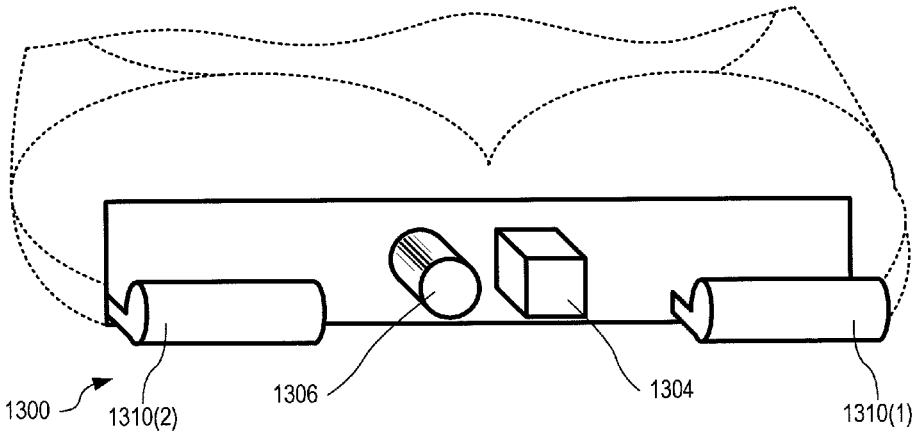
FIG. 13 is a perspective view of an exemplary alternative keyed coupling that is formed to couple with the keyed coupling of FIG. 12, in an embodiment.

FIG. 12 is a perspective view of an alternative keyed coupling 1200 formed with a key block 1202 having a plurality of key features 1204, 1206. Keyed coupling 1200 may be formed on case 700 of FIG. 7 to replace either of keyed couplings 710 and 720, for example. FIG. 13 is a perspective view of an alternative keyed coupling 1300 that is mateable with keyed coupling 1200 of FIG. 12. Keyed coupling 1300 may replace any one of keyed couplings 302, 502, of FIGS. 3 and 5, respectively. For example, by replacing keyed coupling 302 of caddy 300 with keyed coupling 1300, and keyed coupling 710 with keyed coupling 1200, the modified caddy would mate with the modified case.

Keyed coupling 1200 has two clasps 1210(1) and 1210(2) that retain tabs 1310(1) and 1310(2), respectively, of keyed coupling 1300 when couplings 1200 and 1300 are pushed together (i.e., mated). Keyed coupling 1300 has two key features 1304, 1306 that compliment key features 1204, 1206, of keyed coupling 1200. In the example of FIG. 12, key feature 1204 is formed as a recess that is square in cross section, and key feature 1206 is formed as a recess that is circular in cross section. In the complimenting (i.e., mateable) coupling 1300 of FIG. 13, key feature 1304 is formed as a protrusion that is square in cross section, and key feature 1306 is formed as a protrusion that is round in cross section. Key features 1204, 1206, 1304, and 1306 are sized and positioned such that key feature 1304 slides into key feature 1204 and key feature 1306 slides into key feature 1206 when keyed coupling 1300 is pushed towards and couples with keyed coupling 1200. Key features 1204, 1206, 1304, and 1306 also inhibit mating of keyed couplings 1200 and 1300 with other non-mateable (i.e., non-complimenting and non-matching) keyed couplings.

Keyed couplings 1200 and 1300 may have more or fewer key features (e.g., key features 1204, 1206, 1304, 1306) without departing from the scope hereof. Further, keying is also defined by positioning of each key feature pair (e.g., key feature 1204 and 1304) relative to other key feature pairs and/or clasps 1210 and tabs 1310.

Figure 14:
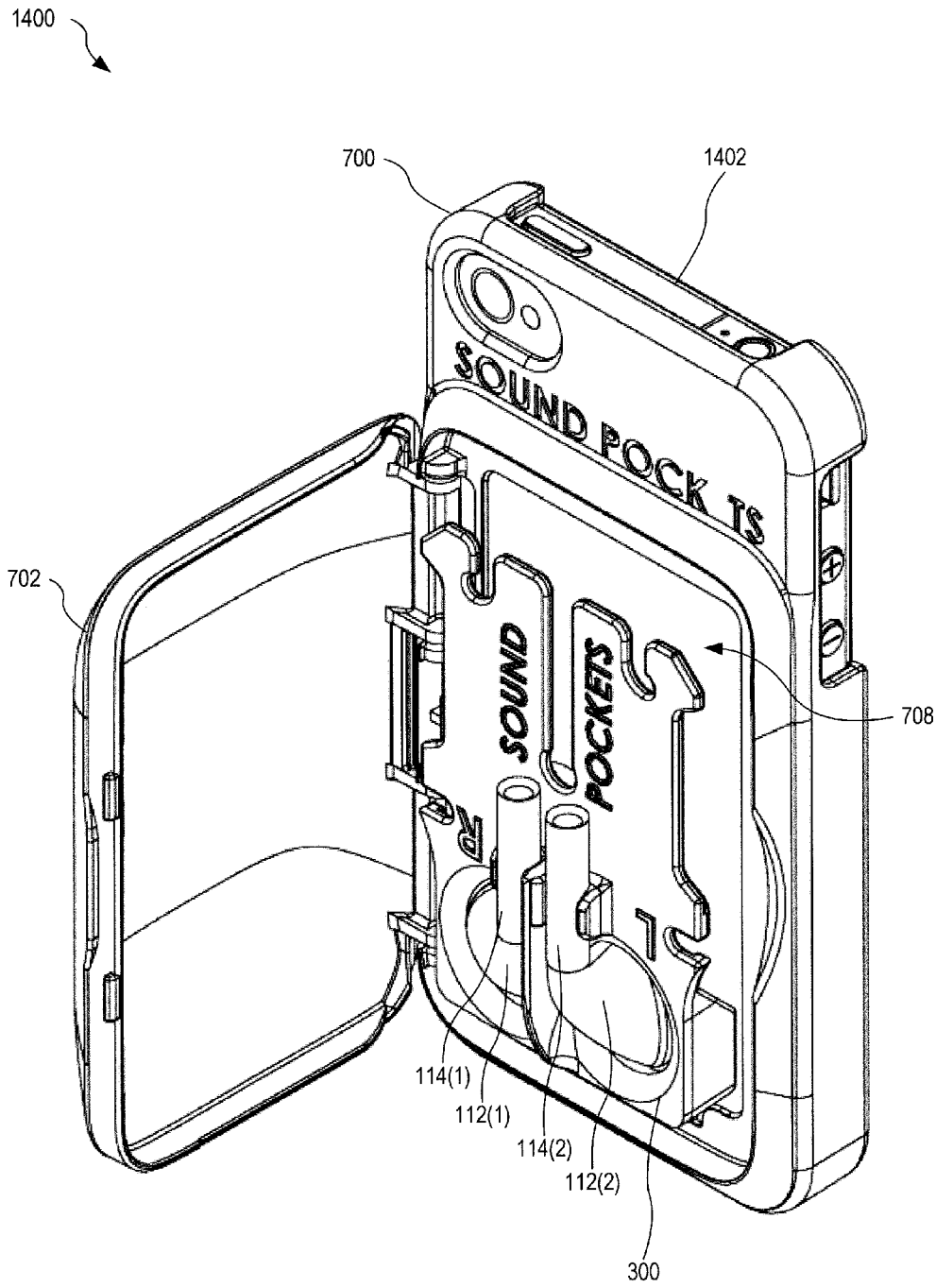
FIG. 14 is a perspective view illustrating one exemplary keyed caddy storage system that includes the DMD combo keyed storage case of FIG. 7 coupled with the caddy of FIGS. 3 and 4.

FIG. 14 is a perspective view illustrating one exemplary keyed caddy storage system 1400 that includes case 700, shown attached to a DMD 1402, with lid 702 open and caddy 300 stored therein. Coupling 302 of caddy 300 is mated with second coupling 710 of case 700. Caddy 300 is illustratively shown with earpieces 112 and stems 114 of earphone set 100 (other parts of earphone set 100 are not shown for clarity of illustration). Lid 702 closes to enclose caddy 300 and earphone set 100 safely and compactly within storage area 708.

Figure 15:
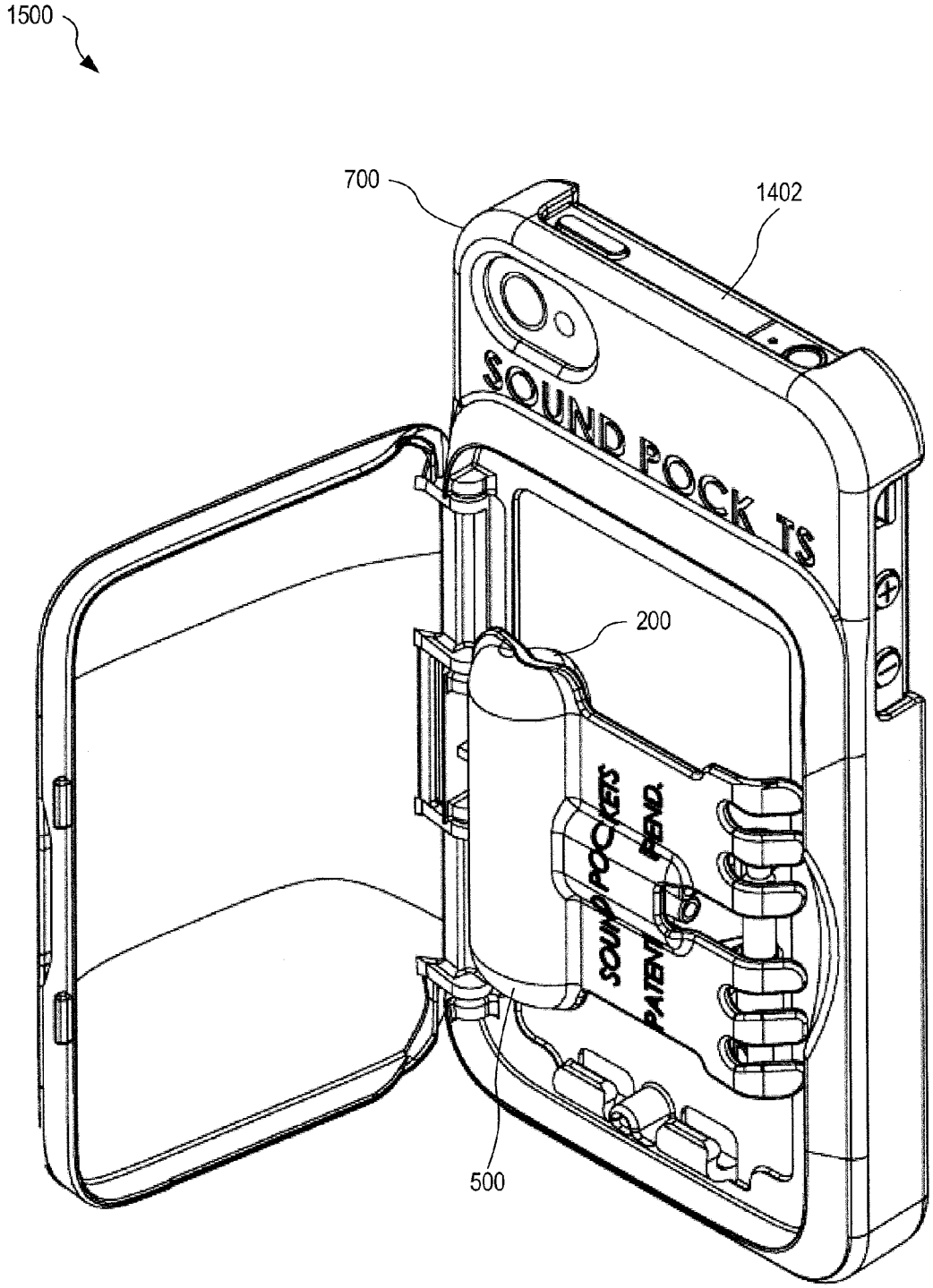
FIG. 15 is a perspective view illustrating one exemplary keyed caddy storage system that includes the DMD combo keyed storage case of FIG. 7 coupled with the caddy of FIGS. 5 and 6.

FIG. 15 is a perspective view illustrating one exemplary keyed caddy storage system 1500 that includes case 700, illustratively coupled to DMD 1402, with lid 702 open showing caddy 500 stored therein. Coupling 502 of caddy 500 is mated with second coupling 720 of case 700. Caddy 500 is illustratively shown with earpieces 232 of earphone set 200 (other parts of earphone set 200 are not shown for clarity of illustration). Lid 702 closes to enclose caddy 500 and earphone set 200 safely and compactly stored within storage area 708.

It should be noted that second couplings 710 and 720 may be formed within lid 702, rather than base 706, such that caddies 300 and 500 when coupled with case 700 are positioned within storage area 708 when lid 702 is closed. Further, hinge 704 may be positioned on other edges of lid 702 and base 706 without departing from the scope hereof.

Lid 702 may also be contoured, at least internally, to closely secure the earphone set mounted on the keyed caddy within the storage area. The sizes of the storage area and lid are configured to minimize wasted space when the earphone set and caddy are stored therein. For example, the length, width and height of the storage area are reduced to a minimum size that stores each paired earphone sets mounted on the keyed caddy. That is, storage area 708 of case 700 is configured to store each keyed caddy 300, 500 with captured earphone set 100, 200, with minimal volume. Further, storage area 708 and lid 702 may be positioned on base 706 to provide optimal ergonomic handling and use of the DMD when coupled with the case.

The keyed caddy storage system has many advantages over other non-exclusive cases. By targeting one specific earphone set design, the keyed caddy 300, 500 consistently and easily captures the earphone set 100, 200 into its most compact form, which results in storage area 708 being smaller, as compared to storage areas of universal case designs. This has the advantage for consumer that the DMD and earphone set are protected and stored together in as small a package as possible, thereby making them easier carry around and less likely to become separated and lost. Manufacturers of DMDs, earphone sets, and protective cases, may all benefit from the designs and features of the keyed caddy storage system.

Figure 16:
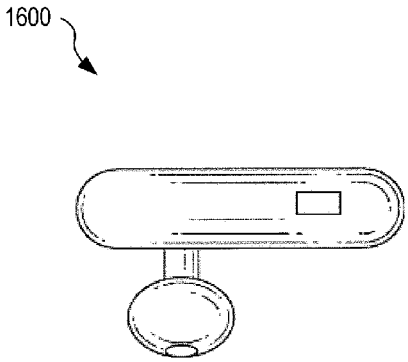
FIG. 16 shows one exemplary prior art Bluetooth earphone set.
Figure 17:
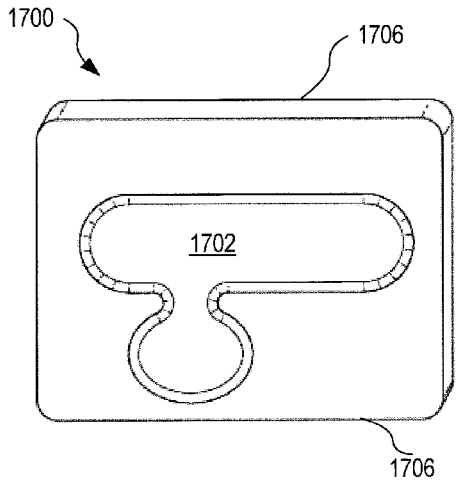
FIG. 17 shows one exemplary keyed caddy with a recess for capturing and securing the earphone set of FIG. 16, in an embodiment.
Figure 18:
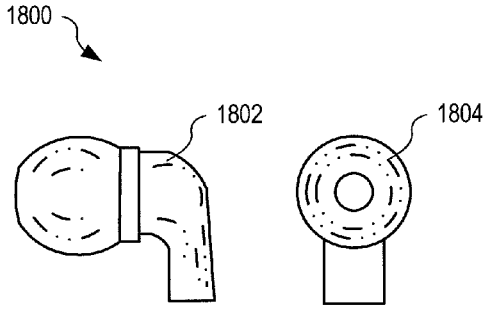
FIG. 18 shows an exemplary prior art Bluetooth earphone set that connects wirelessly to a DMD.
Figure 19:
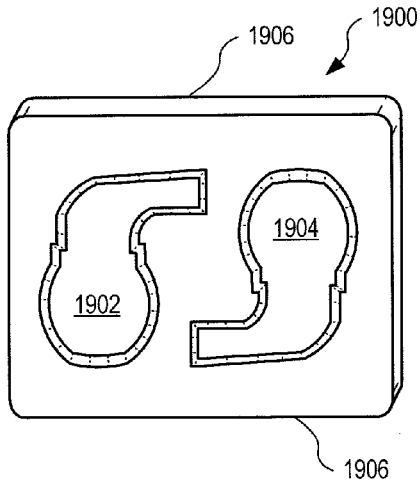
FIG. 19 shows one exemplary keyed caddy for capturing the earpieces of the earphone set of FIG. 18, in an embodiment.
Figure 20:
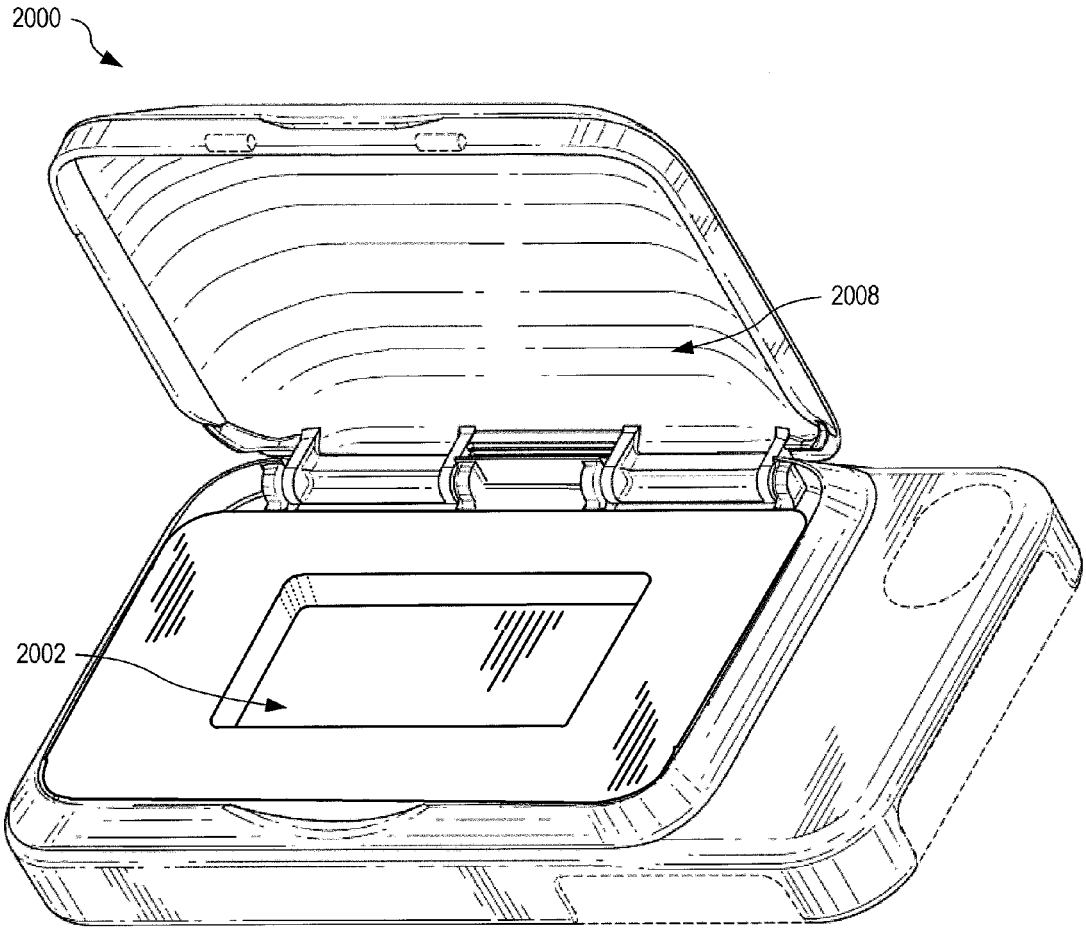
FIG. 20 shows one exemplary DMD combo keyed storage case configured with a keyed area for receiving one of the keyed caddies of FIGS. 17 and 19, in an embodiment.

FIG. 16 shows one exemplary Bluetooth earphone set 1600, as often used for making and receiving phone calls with a mobile phone type DMD. FIG. 17 shows one exemplary keyed caddy 1700 with a recess 1702 for capturing and securing earphone set 1600 of FIG. 16. FIG. 18 shows an exemplary Bluetooth earphone set 1800, having a left earpiece 1802 and a right earpiece 1804, that each connects wirelessly to a DMD. FIG. 19 shows one exemplary keyed caddy 1900 with a first and second recess 1902, 1904, for capturing earpieces 1802 and 1804 of earphone set 1800 of FIG. 18. FIG. 20 shows one exemplary DMD combo storage case 2000 configured with a keyed area 2002 for receiving one of keyed caddies 1700 and 1900 of FIGS. 17 and 19, respectively. FIGS. 16, 17, 18, 19, and 20, are best viewed together with the following description.

Keyed caddies 1700 and 1900 may be made of a soft rubber material or a dense foam material and formed such that recesses 1702, 1902, and 1904 and are sized to securely capture and protect earphone set 1600 and earpieces 1802 and 1804, respectively. An outer perimeter of caddies 1700 and 1900 are keyed to fit within recess 2002 of case 2000. In the example of FIGS. 16, 17, 18, 19, and 20, both caddies 1700 and 1900 are keyed to fit within recess 2002 of case 2000. That is, caddies 1700 and 1900 have the same keyed coupling with case 2000. However, by varying the shape and size of outer perimeter 1706 and 1906 of caddies 1700 and 1900, respectively, and the shape of recess 2002, different keyed combination of caddies 1700, 1900 and case 2000 may be generated.

Although earphone sets 1600 and 1800 do not have cables or wiring, they are easily captured within caddies 1700 and 1900, respectively, and safely and securely stored within storage area 2008 of case 2000.

Advantages of a Single Protective Case which Retains a Target DMD and a Target Earphone Set Using a Keyed Caddy.

Each caddy (e.g., caddy 300, 500) is specifically designed (keyed) to a particular earphone set (e.g., earphone sets 100, 200). Since earphone sets from different manufacturer have different configurations (e.g., different lengths 115, 117, 107, 118, 119, 103 and configurations), an earphone set from one manufacturer matches a caddy that is different to a caddy that matches an earphone set from another manufacturer. That is, the earphone set and caddy are keyed to one another, wherein an earphone set keyed to a first caddy cannot be compactly wound on a caddy for a different earphone set, even when the caddies and earphones are of similar styles. That is, for a particular earphone set, the appropriate caddy is required for compactly storing the earphone set.

A manufacturer may key a case to one particular earphone set from one particular manufacturer since, as shown in FIGS. 3-7 and described above, each caddy (e.g. caddies 300, 500) is configured for storing a particular earphone set and may be uniquely keyed to a particular case (e.g. case 700). Advantageously, the earphone set manufacturer may supply each earphone set on a matching caddy with a specifically keyed coupling that matches only one particular case that is also sold by the manufacturer (even when the case is not made by that manufacturer). That is, where a manufacturer sells a DMD and provides an accompanying earphone set attractively, compactly, and securely stored on a caddy, a purchasers looking for a matching case for the DMD is steered towards the matching keyed case, which may also be sold by the same manufacturer. Purchase of a keyed case from an alternate manufacturer is deterred because the caddy will not couple with that case.

Figure 21:
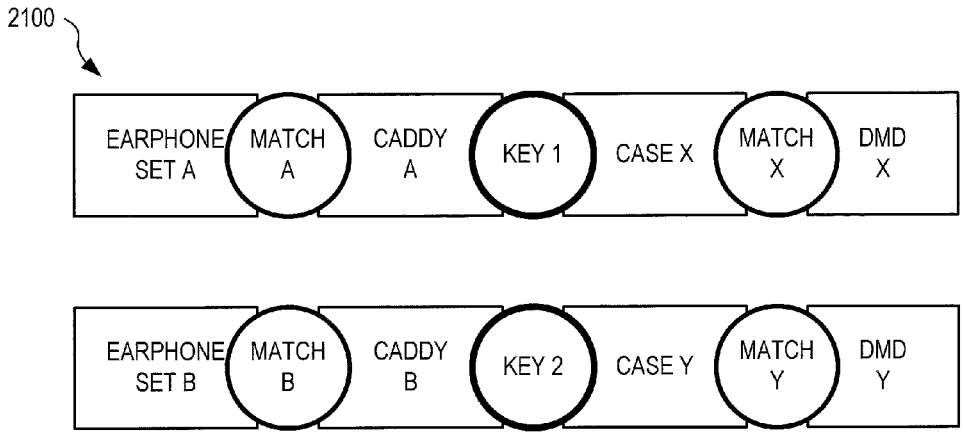
FIG. 21 shows one exemplary scenario wherein a first manufacturer sells a DMD X accompanied by an earphone set A and a caddy A, in an embodiment.

FIG. 21 shows one exemplary scenario 2100 wherein a first manufacturer sells a DMD X accompanied by an earphone set A mounted on a caddy A which is configured specifically for storing earphone set A. The first manufacturer also sells a case X that is configured to protect DMD X and includes a storage area. Caddy A and case X are configured with a keyed coupling (key 1), such that caddy A may couple with case X to store earphone set A, mounted on caddy A, within the storage area of case X.

In the example of FIG. 21, a second manufacturer sells a DMD Y accompanied by an earphone set B mounted on a caddy B which is configured specifically for storing earphone set B. The second manufacturer also sells a case Y that is configured to protect DMD Y and includes a storage area. Caddy B and case Y are configured with a keyed coupling (key 2), such that caddy B may couple with case Y to store earphone set B, mounted on caddy B, within the storage area of case Y.

The first manufacture thus defines a relationship (A, 1, X) between DMD, caddy, and matching case. The second manufacturer thus defines a relationship (B, 2, Y) between DMD, caddy, and matching case.

Figure 22:
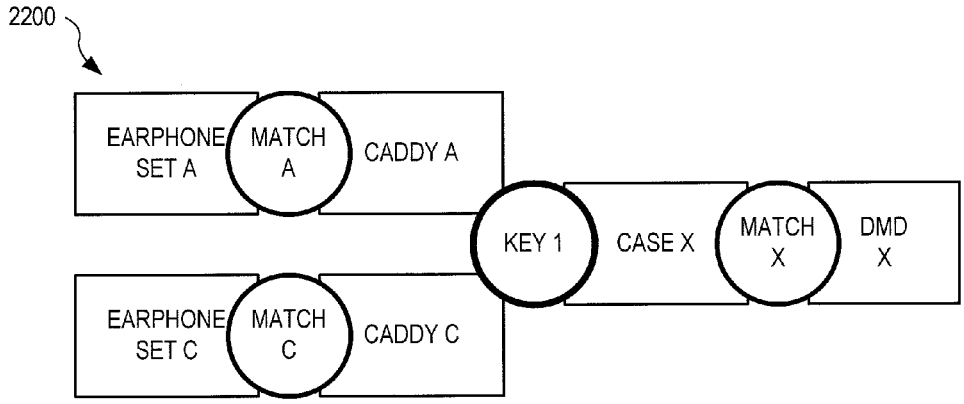
FIG. 22 shows one exemplary scenario wherein the first manufacturer optionally supplies a second earphone set C on a caddy C that couples with case X, in an embodiment.

FIG. 22 shows one exemplary scenario 2200 wherein the first manufacturer optionally supplies a second earphone set C on a caddy C that is also configured with keyed coupling (key 1) such that caddy C couples with case X to store earphone set C, mounted on caddy C, within the storage area of case X. Thus, the consumer of the first manufacturer, selecting either earphone set A or earphone set C, may purchase case X to store the selected earphone set. In another exemplary scenario, earphone set C is sold by a third manufacturer in cooperation with the first manufacturer, wherein the first manufacturer allows the third manufacturer to configure caddy C with keyed coupling (key 1) to allow its use with case X.

Figure 23:
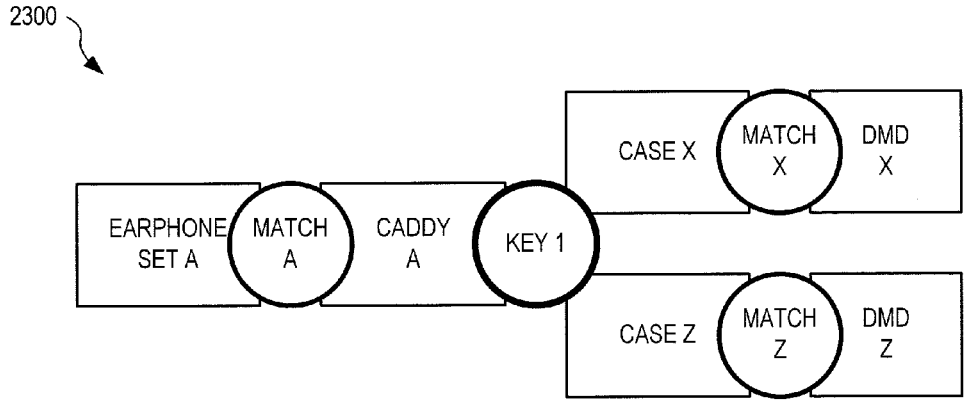
FIG. 23 shows one exemplary scenario wherein the first manufacturer also sells a second DMD Z and a matching case Z that stores earphone set A, in an embodiment.

FIG. 23 shows one exemplary scenario 2300 wherein the first manufacturer also sells a second DMD Z and a matching case Z that is configured with keyed coupling (key 1) such that caddy A couples with case Z to store earphone set A, mounted on caddy A, within the storage area of case Z. Thus, the consumers of the first manufacturer, selecting either case X or case Z, may store earphone set A, mounted on caddy A, within the storage area of the selected case. In another exemplary scenario, case Z is sold by a third manufacturer (e.g., a case manufacturer) in cooperation with the first manufacturer, wherein the first manufacturer allows the third manufacturer to configure case Z with keyed coupling (key 1) to allow its use with caddy A and earphone set A.

By keying each specific caddy to a specific case, an exclusive relationship is provided that encourages brand loyalty (e.g., the caddy matched to the earphone set provided with a DMD and keyed to a particular case sold by the same manufacturer) and encourages the buyer of the DMD to also buy the matching case to obtain optimal earphone set storage and protection. More particularly, to use the case efficiently for storing an earphone set, the consumer is limited to use an earphone set provided (with the appropriate caddy) by that manufacturer or a third party in cooperation with that manufacturer. Consumers may find brand loyalty advantageous because it allows them to carry the DMD and a well-organized earphone set together in the most compact form achievable (i.e., wound onto a specifically matched caddy and stored within an optimally sized and shaped storage area of a case protecting the DMD).

By controlling use of each keyed coupling (e.g., key 1, key 2), a manufacturer may advantageously steer consumers to specific products, since caddies and cases that do not have the same keyed coupling (e.g., key 1) cannot couple to allow storage of the earphone set within the storage area in the most convenient and protective form.

Packaging Products for Consumers

Figure 24:
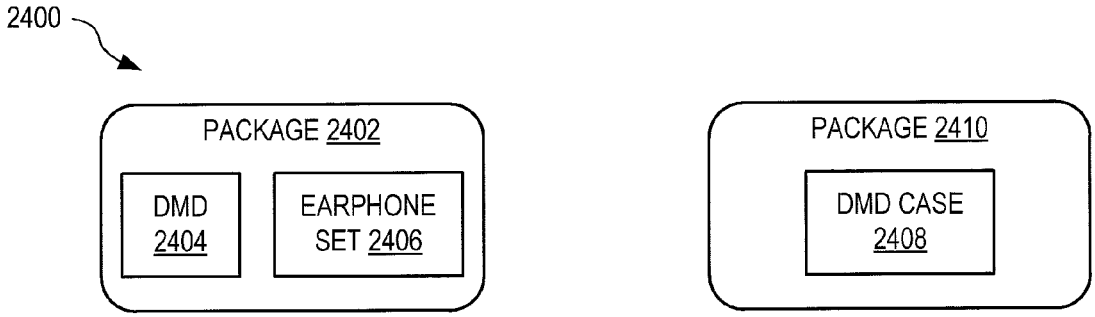
FIG. 24 PRIOR ART
FIG. 24 shows prior art scenario where a DMD manufacturer sells a DMD with a bundled earphone set in a first package, and sells a DMD protective case in a second package.
Figure 25:
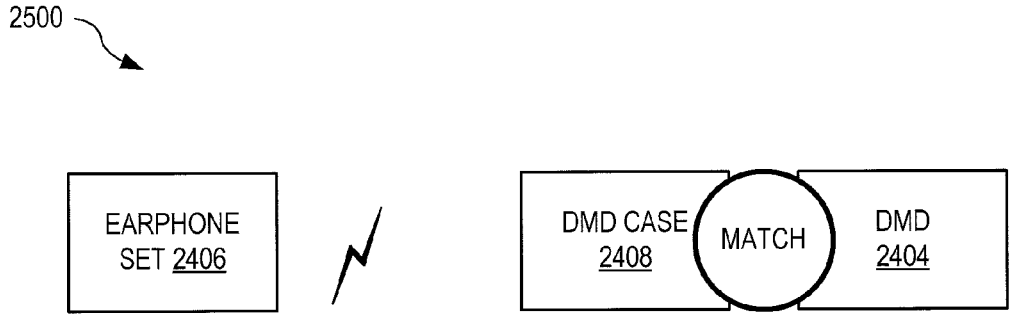
FIG. 25 PRIOR ART
FIG. 25 shows the prior art results of the consumer's purchase of the packages of FIG. 24, where the earphone set remains unprotected.

FIG. 24 shows prior art scenario 2400 where a DMD manufacturer sells a DMD 2404 with a bundled earphone set 2406 as a first package 2402, and sells a DMD protective case 2408 as a second package 2410. Thus the consumer purchases package 2402 and optionally purchases package 2410 if protection of the DMD is desired. FIG. 25 shows the prior art results of the consumer's purchase, where the DMD is protected by the matching DMD protective case 2408, but earphone set 2406 remains unprotected. In this prior art scenario 2400, the consumer sees no advantage in purchasing package 2410 over any other DMD case by any other manufacturer. Thus the consumer is not steered towards any particular DMD case.

Figure 26:
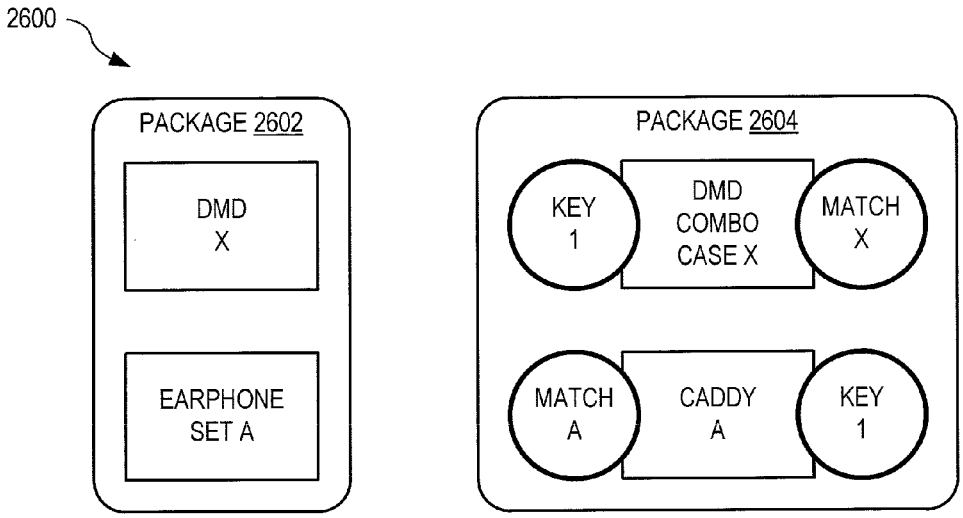
FIG. 26 shows one exemplary scenario with improved packaging including a DMD combo case X and a caddy A, in an embodiment.

FIG. 26 shows one exemplary scenario 2600 with improved packaging, where the DVD manufacturer sells DMD X and an earphone set A in a first package 2602, and sells a DMD combo case X and a caddy A in a second package 2604. DMD combo case X is matched (shown as match X) with DMD X and has a keyed coupling key 1 that keys caddy A to case X. Caddy A is matched to earphone set A (shown as match A) and has a keyed coupling key 1 that matches the coupling of DMD combo case X. By purchasing both package 2602 and package 2604, the consumer protects DMD X and may store earphone set A mounted onto caddy A within the storage area of DMD combo case X. See for example scenario 2100 of FIG. 21. Thus, packaging of scenario 2600 steers the consumer to also purchase package 2604 because DMD combo case X allows earphone set A to be stored together with DMD X.

Figure 27:
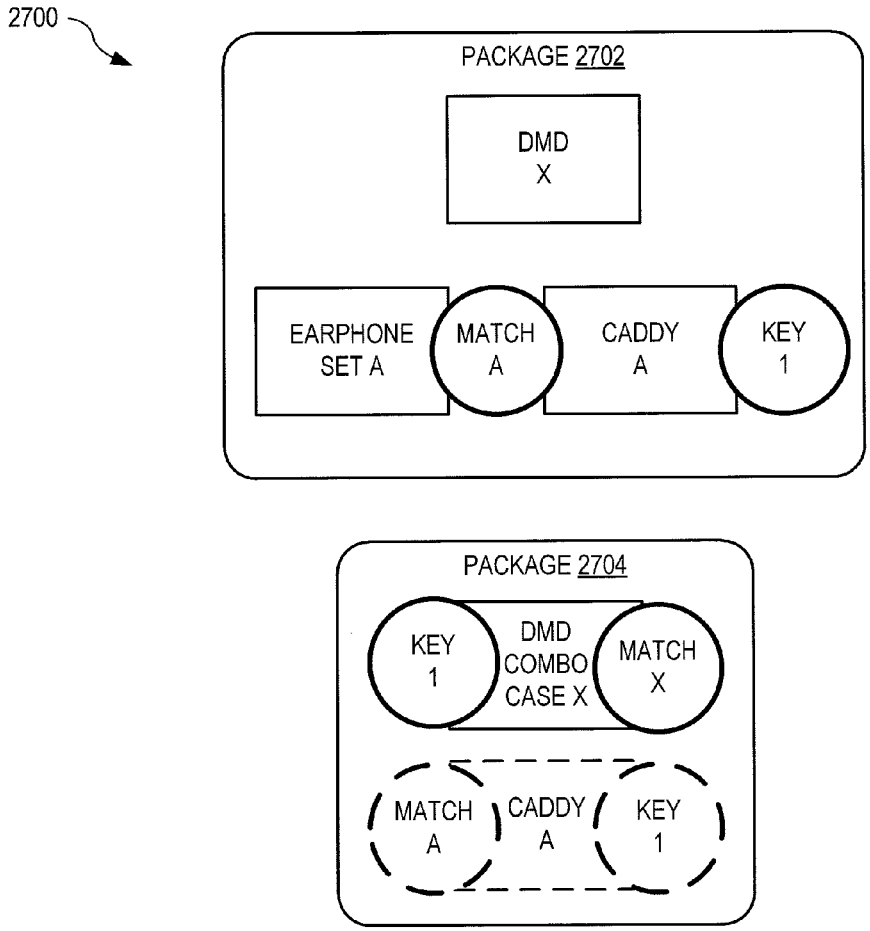
FIG. 27 shows an alternative scenario where a first package includes a DMD X, an earphone set A, and a keyed caddy A, and a second package includes a DMD combo case X, and optionally a keyed caddy A, in an embodiment.

FIG. 27 shows an alternative scenario 2700 with improved packaging, where the DVD manufacturer sells DMD X, earphone set A, and keyed caddy A in a first package 2702, and sells DMD combo case X, and optionally keyed caddy A, in a second package 2704. Earphone set A is for example mounted on keyed caddy A within package 2702. A consumer purchasing package 2702 is immediately aware of the advantages of keyed caddy A for storing and protecting earphone set A. Thus, when looking for a protective case for DMD X, the consumer also immediately sees the advantage of purchasing package 2704 because DMD combo case X is keyed to keyed caddy A.

Figure 28:
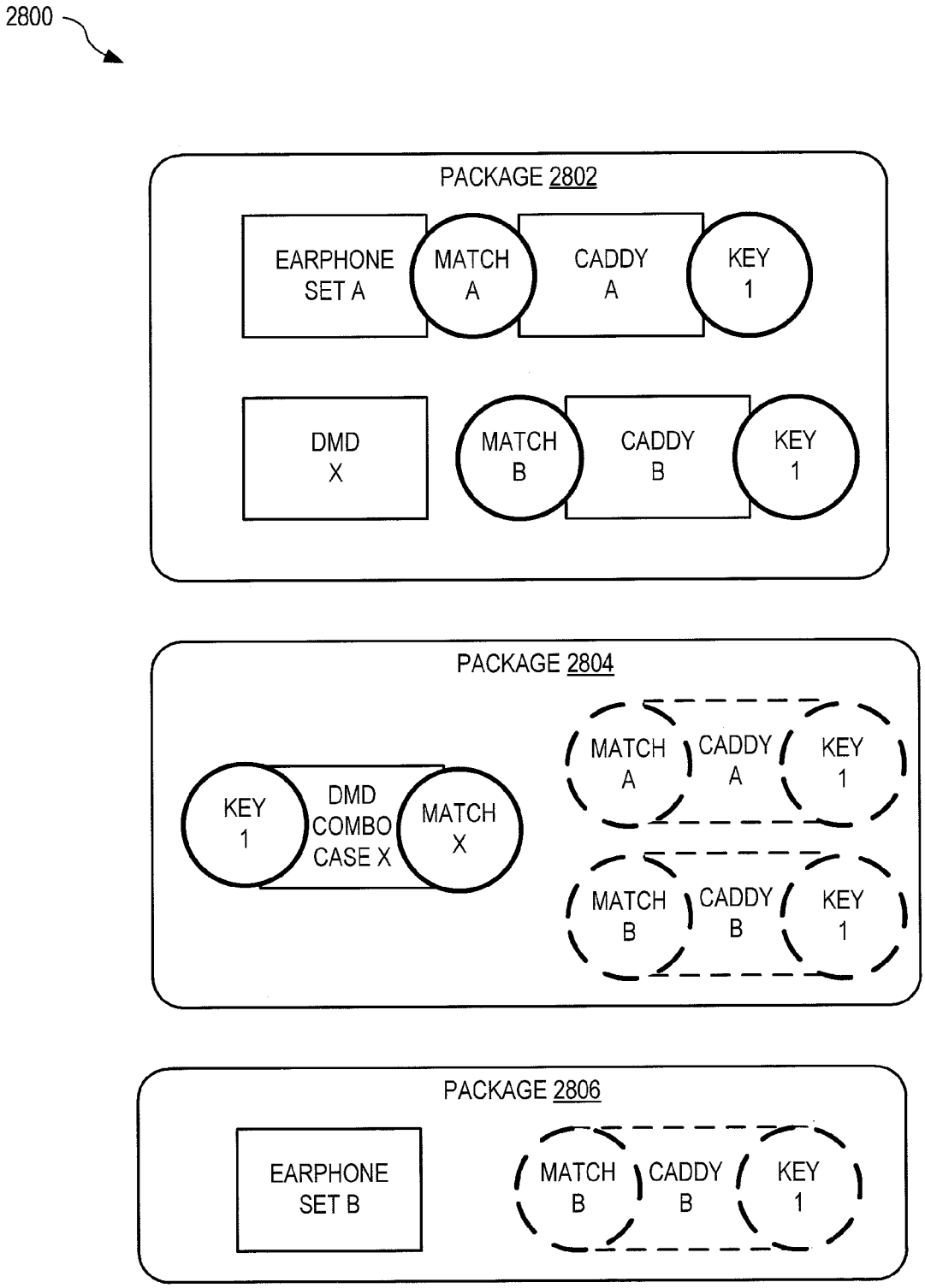
FIG. 28 shows yet another alternative scenario where a first package includes a DMD X, an earphone set A, a keyed caddy A, and a keyed caddy B, a second package includes a DMD combo case X, and optionally keyed caddy A and/or keyed caddy B, and a third package includes an earphone set B and optionally keyed caddy B, in an embodiment.

FIG. 28 shows yet another alternative scenario 2800 with improved packaging, where the DVD manufacturer sells DMD X, earphone set A, keyed caddy A, and a keyed caddy B in a first package 2802, sells DMD combo case X, and optionally keyed caddy A and keyed caddy B, in a second package 2804, and sells earphone set B, optionally keyed caddy B, in a third package 2806. Earphone set A is for example mounted on keyed caddy A within package 2802 and earphone set B is for example mounted on keyed caddy B within package 2806.

Earphone set A is for example a standard quality earphone set as typically supplied with DMDs. Earphone set B is for example improved (e.g., higher quality, better fit within the ear, etc.) as compared to earphone set A, and is provided by a manufacturer or retailer (e.g., the DMD manufacturer or a third-party earphone set manufacturer or a third-party retailer) for purchase in addition to earphone set A. The consumer purchasing package 2802 immediately sees the advantage in purchasing package 2804, because DMD combo case X protects DMD X and also stores and protects earphone set A. Further, the consumer is aware (through inclusion of keyed caddy B) that DMD combo case X will also store and protect earphone set B, if purchased. Thus the consumer is steered toward purchase of package 2804, as its advantages over other non-keyed DMD cases are visible in package 2802. The consumer is also steered towards purchase of package 2806 if an improved earphones set is desired, since DMD combo case X can store either earphone set A mounted on caddy A or earphone set B mounted on caddy B.

Through use of keyed caddies and DMD combo cases, a DMD manufacturer gains advantage over competition. Since DMD case and earphone set markets are very competitive and have little differentiation between products (aside from color, texture, style or endorsement) the use of a keyed caddy combined with earphone storage combined with the DMD case provides a clear marketing advantage. Thus, the use of keyed caddies and DMD combo cases that are matched to a DMD increase the sales of own branded earphone sets and protective covers.

More particularly, by providing graphics on package 2702, 2802 showing the advantages of the included keyed caddy A for storing the included earphone set A within a matching DMD combo case X, the consumer is aware and motivated to purchase the DMD combo case over other products. The inclusion of the second keyed caddy B provides further marketing opportunity for selling earphone set B to the consumer since the provided keyed caddy B allows that product to be stored within the DMD combo case X. Thus, if the consumer is interested in a higher quality earphone set, they are steered towards earphone set B by packages 2802 and 2804.

The cost of including keyed caddies A and B within packaging is insignificant compared to the sales advantage provided by their inclusion. Although other manufacturers may also provide caddies and cases for storing earphone sets, these cases and caddies are not keyed or matched to DMD X and earphone set A. More particularly, keyed caddies A and B will not work with a DMD combo case from another manufacturer.

Separable Keyed Earphone Storage and DMD Protective Case

Figure 29:
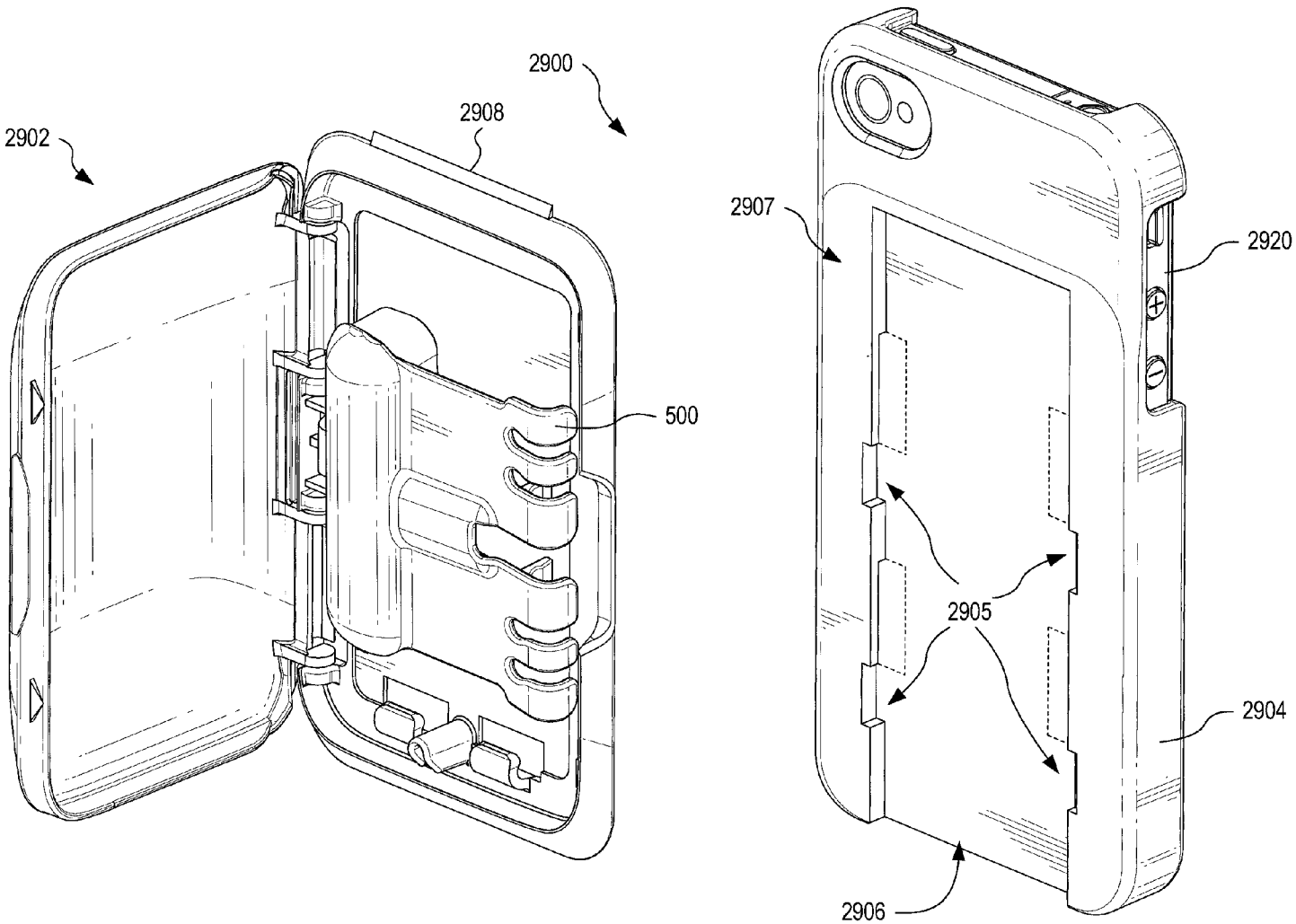
FIG. 29 shows exemplary keyed coupling between a keyed earphone set case and a keyed DMD case, in an embodiment.

FIG. 29 shows exemplary keyed coupling 2900 between a keyed earphone set case 2902 and a keyed DMD case 2904. Keyed DMD case 2904 is shown attached with a DMD 2920. A rear face 2907 of keyed DMD case 2904 has a slot 2906 formed therein to couple with a rail 2908 formed on a rear of keyed earphone set case 2902. Slot 2906 and rail 2908 form keyed coupling 2900. As shown, slot 2906 is configured with notches 2905, into which tabs (not shown) of rail 2908 may be inserted. Case 2902 is then slid upwards, relative to case 2904, to engage the tabs within slot 2906 such that earphone set case 2902 is secured to keyed DMD case 2904. Other interlocking mechanisms may be used to form keyed coupling 2900 without departing from the scope hereof.

Keyed DMD case 2904 is configured to couple with, and protect, DMD 2920. Keyed earphone set case 2902 is configured to couple with one or more of keyed caddies as discussed above with reference to FIGS. 3-20, and is illustratively shown coupled with keyed caddy 500 of FIG. 5. Keyed earphone set case 2902 provides storage and protection of earphone sets (e.g. earphone sets 100 and 200), independently of keyed DMD case 2904, and may couple with DMD case 2904 to provide a combined storage and protection solution. That is, when mated, keyed earphone set case 2902 and keyed DMD case 2904 cooperate to function similar to DMD combo keyed storage case 700 of FIG. 7 for storing an earphone set proximate a DMD.

Figure 30:
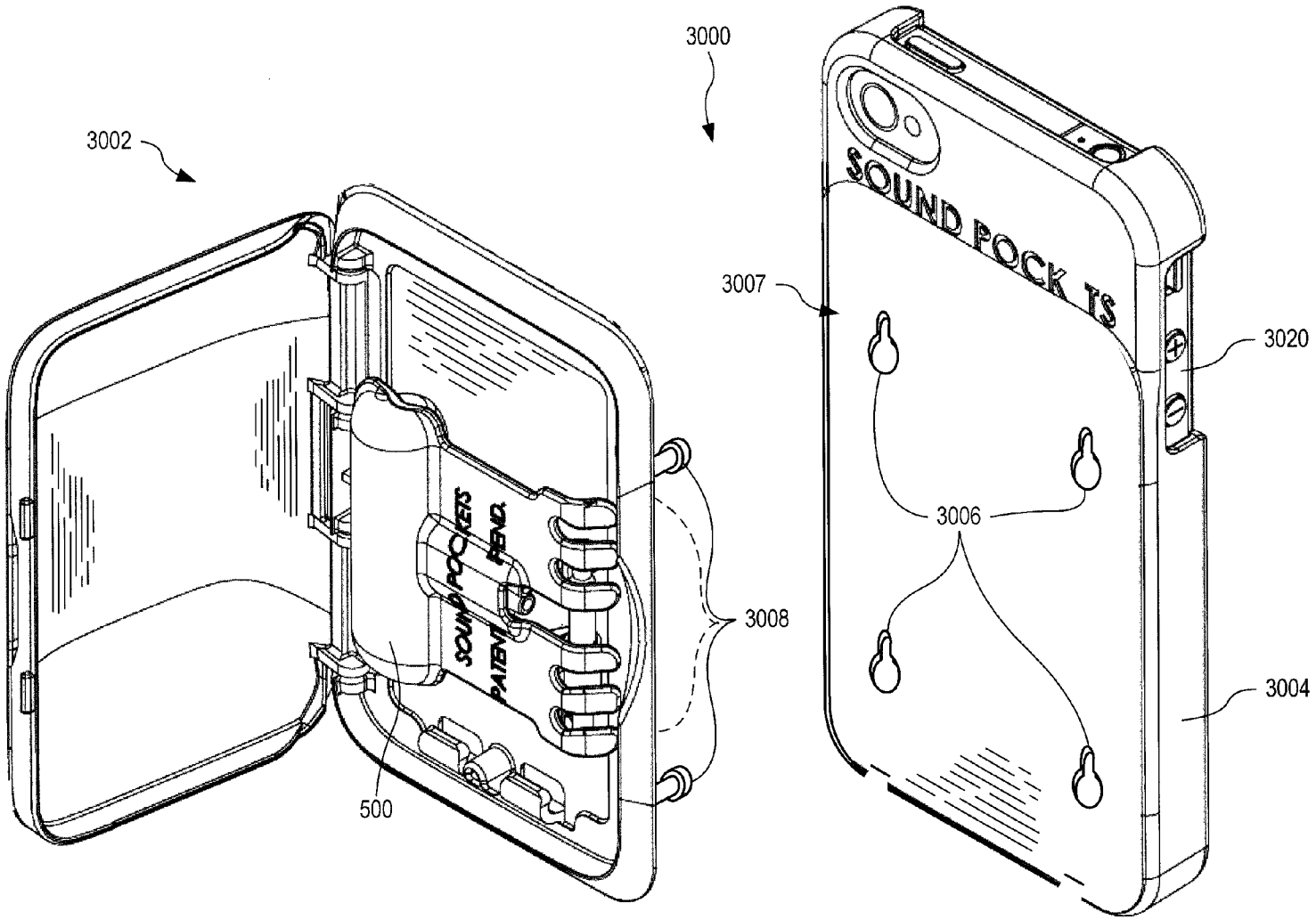
FIG. 30 shows exemplary keyed coupling between a keyed earphone set case and a keyed DMD case, in an embodiment.

FIG. 30 shows one exemplary keyed coupling 3000 between a keyed earphone set case 3002 and a keyed DMD case 3004. Keyed DMD case 3004 is shown coupled to a DMD 3020. A rear face 3007 of keyed DMD case 3004 has four receptacles 3006 formed therein to couple with four capped pins 3008 formed on a rear of keyed earphone set case 3002. Receptacles 3006 and capped pins 3008 form keyed coupling 3000.

Keyed DMD case 3004 is configured to couple with, and protect, DMD 3020. Keyed earphone set case 3002 is configured to couple with one or more of keyed caddies as discussed above with reference to FIGS. 3-20, respectively, and is illustratively shown coupled with keyed caddy 500 of FIG. 5. Keyed earphone set case 3002 provides storage and protection of earphone sets independently of keyed DMD case 3004, and may couple with DMD case 3004 to provide a combined storage and protection solution. That is, when mated, keyed earphone set case 3002 and keyed DMD case 3004 cooperate to function similar to DMD combo keyed storage case 700 of FIG. 7 for storing an earphone set proximate a DMD.

Number and position of each receptacle 3006 and associated capped pin 3008 may be varied to provide different keyed coupling between earphone set cases 3002 and DMD cases 3004.

Figure 31:
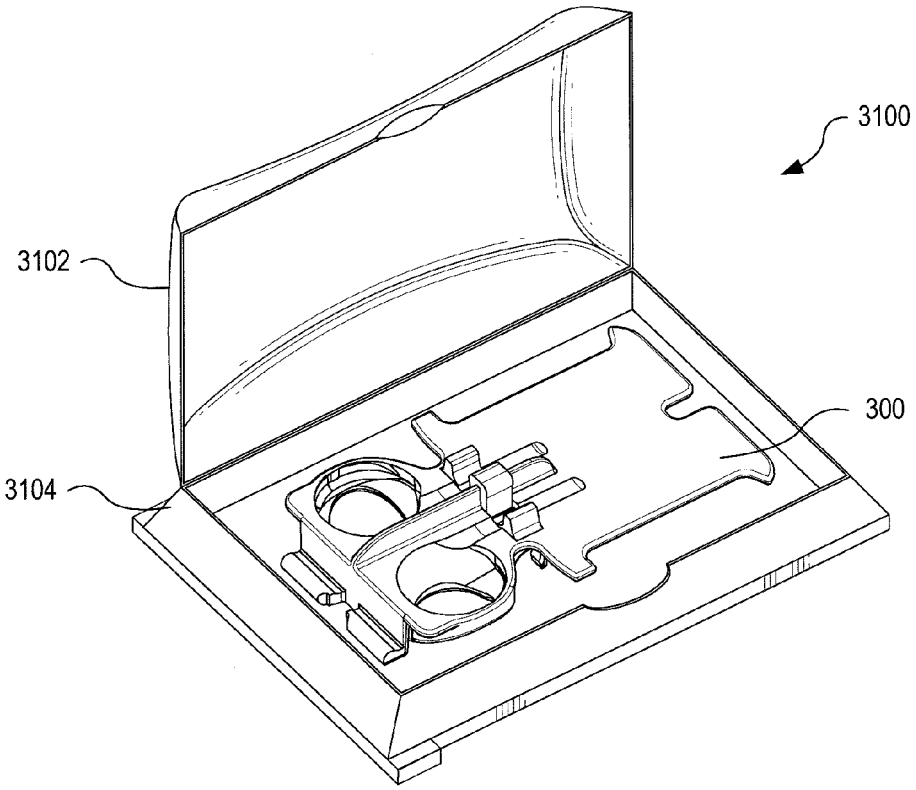
FIG. 31 is a perspective view of one exemplary stand-alone keyed earphone storage case with the lid open, in an embodiment.
Figure 32:
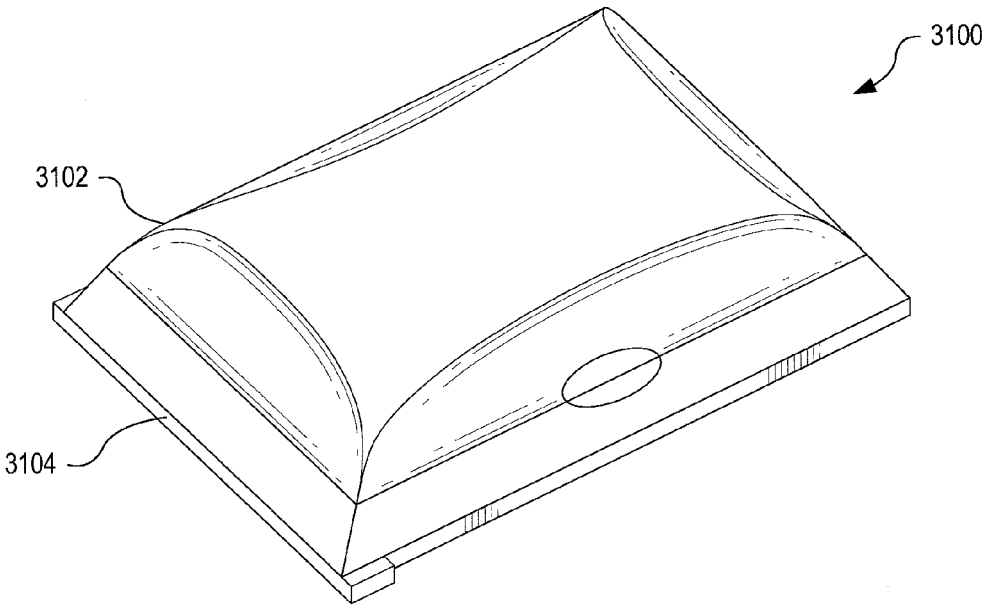
FIG. 32 is a perspective view of the case of FIG. 31 with the lid closed.
Figure 33:
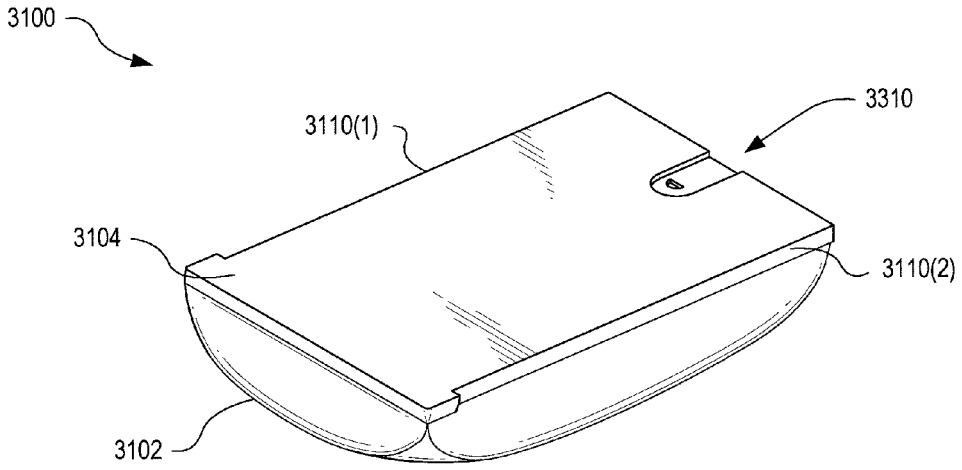
FIG. 33 is a perspective view of the bottom of the case of FIG. 31 showing a catch, in an embodiment.

FIG. 31 is a perspective view of one exemplary stand-alone keyed earphone storage case 3100 with lid 3102 open. FIG. 32 is a perspective view of case 3100 of FIG. 31 with lid 3102 closed. FIG. 33 is a perspective view of the bottom of case 3100 of FIG. 31 showing a catch 3310. Case 3100, as shown, couples with keyed caddy 300 of FIG. 3 and thus including a keyed coupling that matches keyed coupling 302 of caddy 300. However, case 3100 may be used without caddy 300, or configured with an alternate keyed coupling for use with other caddies. For example, case 3100 may be configured to mate with keyed coupling 502 such that caddy 500 may be coupled therein.

Figure 34:
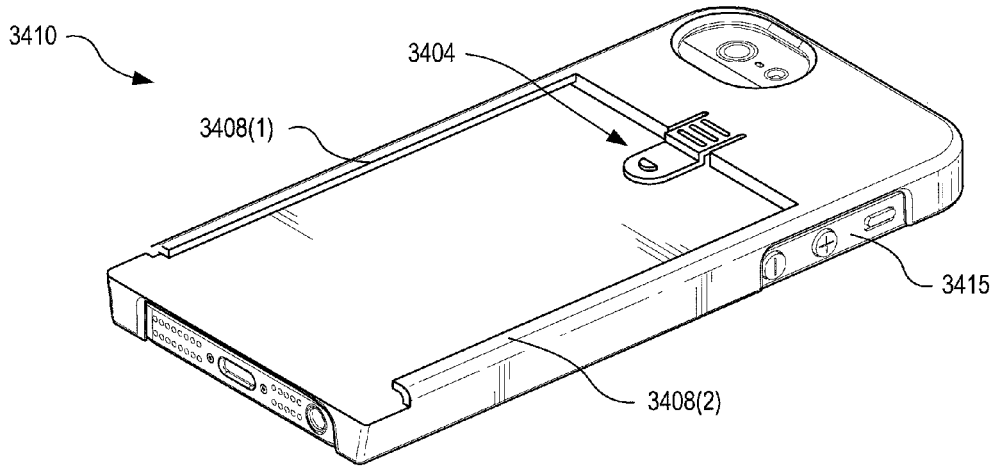
FIG. 34 shows one exemplary DMD protective case for coupling with the case of FIGS. 31-33, in an embodiment.
Figure 35:
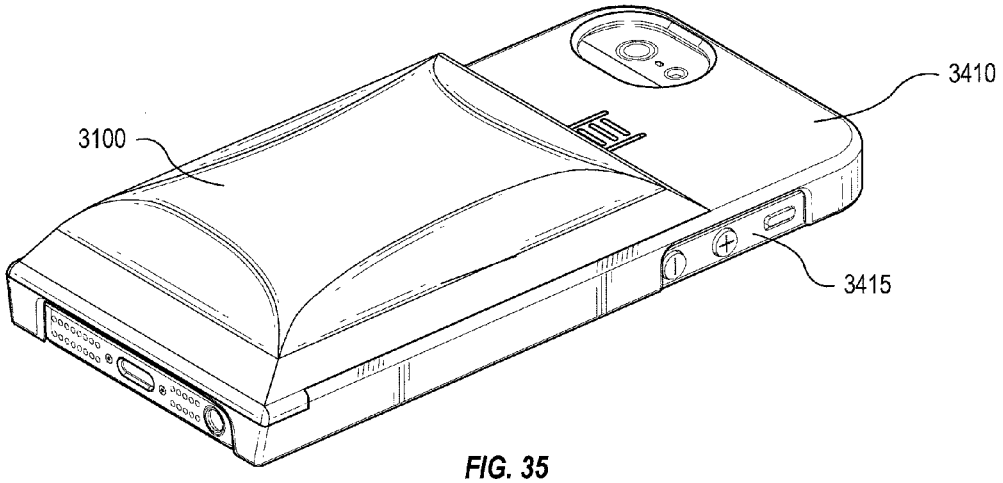
FIG. 35 is a perspective view showing the case of FIG. 31-33 coupled with the case of FIG. 34.

FIG. 34 shows one exemplary DMD protective case 3410 for coupling with earphone storage case 3100 of FIGS. 31-33. Edges 3110 of earphone storage case 3100 slide into rails 3408 of protective case 3410. DMD protective case 3410 is shown coupled to a DMD 3415. A catch 3310 on the underside of earphone storage case 3100 couples with a latch mechanism 3404 of DMD protective case 3410 to secure earphone storage case 3100 to DMD protective case 3410 when slid together. FIG. 35 is a perspective view showing earphone storage case 3100 coupled with DMD protective case 3410. Keyed coupling between DMD protective case 3410 and earphone storage case 3100 is based upon rails 3408(1) and (2) and edges 3110(1) and (2). For example, width and length of rails 3408 and edges 3110 may define a keyed coupling between earphone storage case 3100 and DMD protective case 3410.

Figure 36:
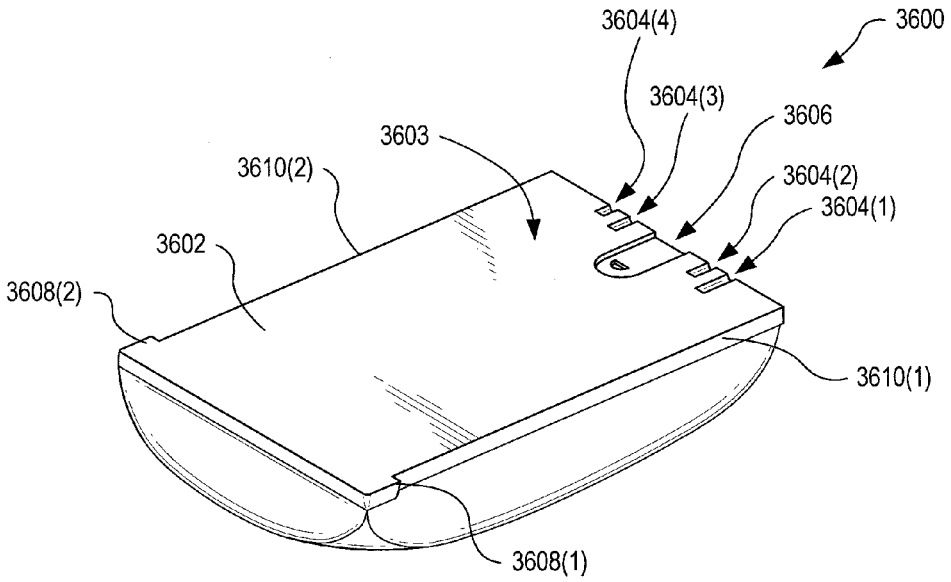
FIG. 36 shows exemplary first keyed coupling formed on an earphone storage case, in an embodiment.

FIG. 36 shows one exemplary first keyed coupling 3600 formed on an earphone storage case 3602. Case 3602 may represent case 3100 of FIG. 31. Keyed coupling 3600 is formed on bottom surface 3603 of earphone storage case 3602 by irregularities that comprise, in this example, four grooves 3604(1)-(4) that are each shaped and sized to provide the combination for keyed coupling 3600.

Figure 37:
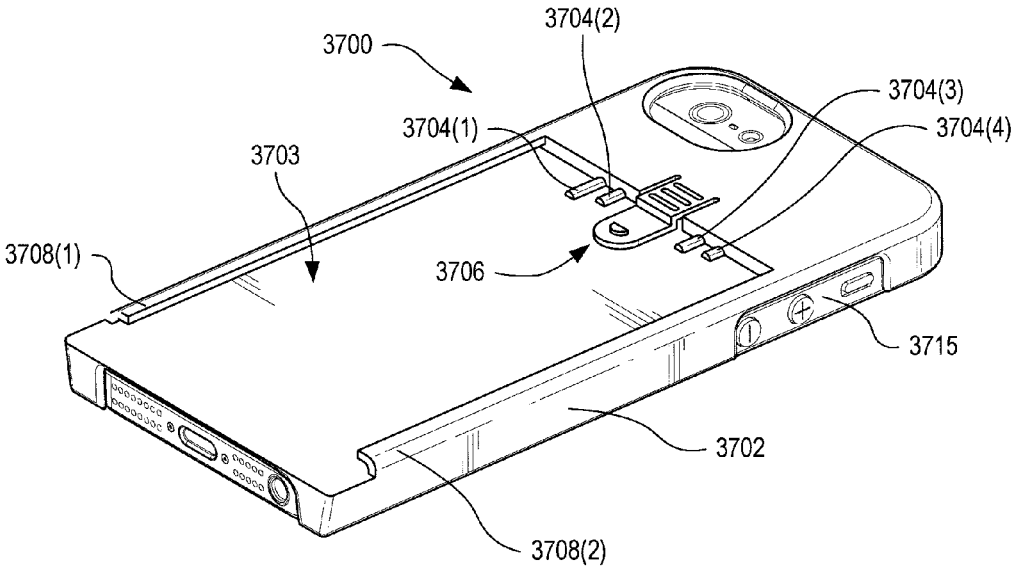
FIG. 37 shows exemplary second keyed coupling that couples with the keyed coupling of FIG. 36, in an embodiment.

FIG. 37 shows one exemplary second keyed coupling 3700 that couples with keyed coupling 3600 and that is formed on a DMD protective case 3702. DMD protective case 3702 is shown coupled with a DMD 3715. Second keyed coupling 3700 is formed on a back surface 3703 of DMD protective case 3700 and has irregularities that comprises, in this example, four ridges 3704(1)-(4) that are each shaped and sized to provide the irregular combination for second keyed coupling 3700 to match keyed coupling 3600. Case 3702 has two rails 3708 that receive edges 3610 of case 3602. Keyed coupling 3700 is configured such that ridges 3704 are received by grooves 3604 of case 3602 as it slides into a locking (by clasp 3706 and catch 3606) position between rails 3708.

Figure 38:
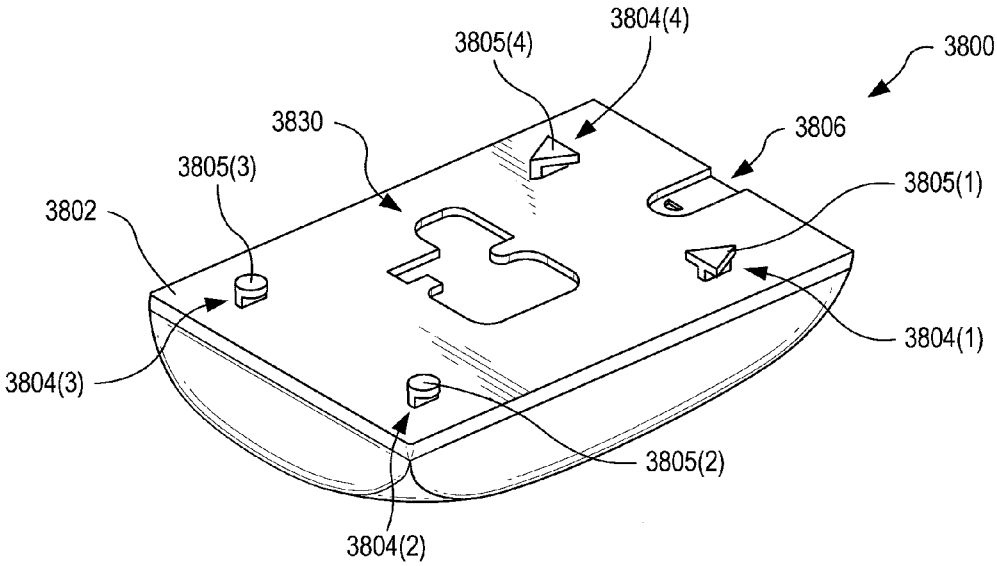
FIGS. 38 and 39 show exemplary paired keyed couplings that cooperate to selectively couple an earphone storage case and a DMD protective case, in an embodiment.
Figure 39:
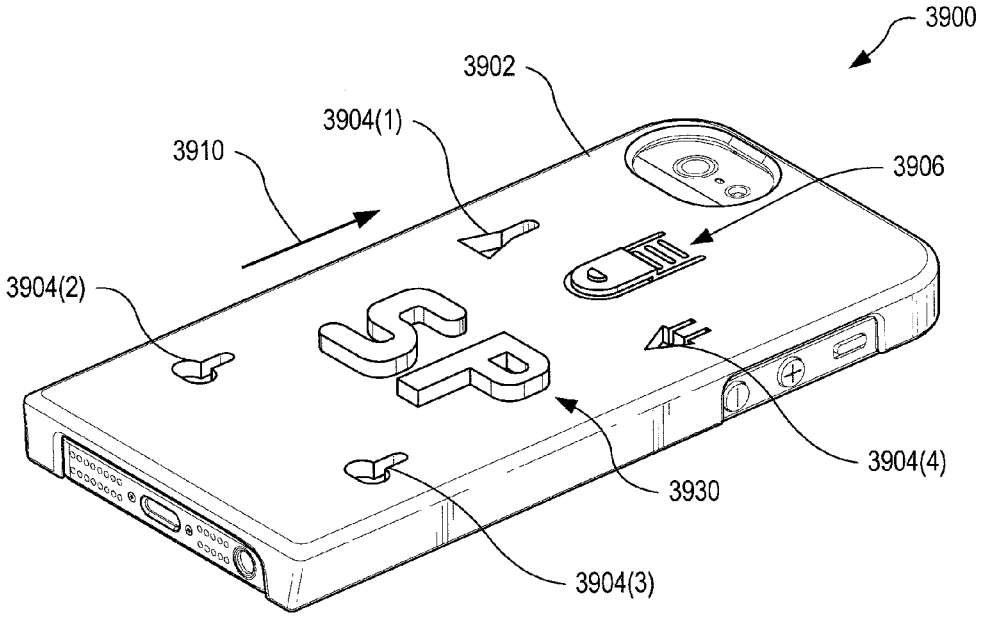

FIGS. 38 and 39 show exemplary paired (matched) keyed couplings 3800 and 3900, respectively, that cooperate to selectively mate an earphone storage case 3802 and a DMD protective case 3902. Case 3802 is configured with four posts 3804(1)-(4) each with a cap 3805(1)-(4), respectively. One or more of caps 3805 may be irregular in shape. As shown in the example of FIG. 38, cap 3805(1) is triangular in shape and cap 3805(4) is triangular in shape but is inverted as compared to cap 3805(1). Caps 3805(2) and 3805(3) are elliptical in shape, but could also be configured with other shapes. Caps 3805 thereby form irregularities of keyed coupling 3800.

Receptacles 3904(1)-(4) are formed in a back surface of case 3902 and are shaped and positioned to receive caps 3805(1)-(4), respectively, of case 3802. That is, receptacle 3904(1) is shaped to receive the triangular shape of cap 3805 (1) and receptacle 3904(4) is shaped to receive the inverted triangular shape of cap 3805(4). To couple case 3802 to case 3902, caps 3805 are simultaneously inserted fully into receptacles 3904 and then case 3802 is slid in the direction of arrow 3910, relative to case 3902, until catch 3806 is captured by clasp 3906. Receptacles 3904 are extend beneath the surface of case 3900 in the direction of arrow 3910 to allow case 3802 to securely couple with case 3902. Receptacles 3904 thereby form irregularities of keyed coupling 3900. In the example of FIGS. 38 and 39, DMD protective case 3902 is formed with a raised logo 3930 (the letters "SP" in this example) that is received by a recess 3830 formed in earphone storage case 3802. Recess 3830 is elongated relative to raised logo 3930 to allow earphone storage case 3802 to slide relative to DMD protective case 3902 for coupling and decoupling.

Figure 40:
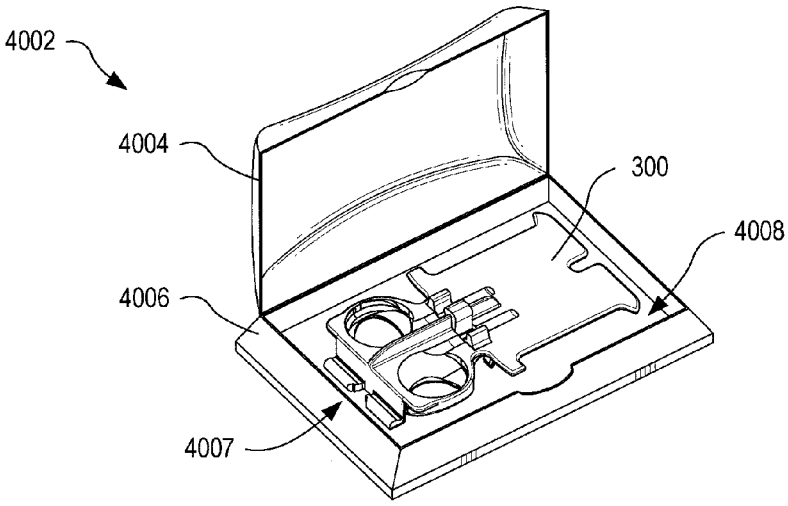
FIGS. 40-44 show an exemplary earphone storage case for storing an earphone set proximate a DMD using a stylistic keyed coupling, in an embodiment.

FIGS. 40-44 show an earphone storage case 4400 for storing an earphone set proximate a DMD, where an earphone set storage portion 4002 couples with a DMD protection portion 4202 using a stylistic keyed coupling. Style may be provided by a company logo, or other promotional icon. In this example, skull and crossbones are used to provide style for the stylistic keyed coupling. FIG. 40 shows storage portion 4002 with a hinged lid 4004 in the open position and coupled with a base 4006. Base 4006 includes a keyed coupling 4007 for coupling with caddy 300 of FIG. 3, as shown, to position caddy 300 within storage area 4008 of portion 4002. Base 4007 may include other keyed couplings to couple with other keyed caddies (e.g., caddy 500 of FIG. 5) without departing from the scope hereof.

Figure 41:
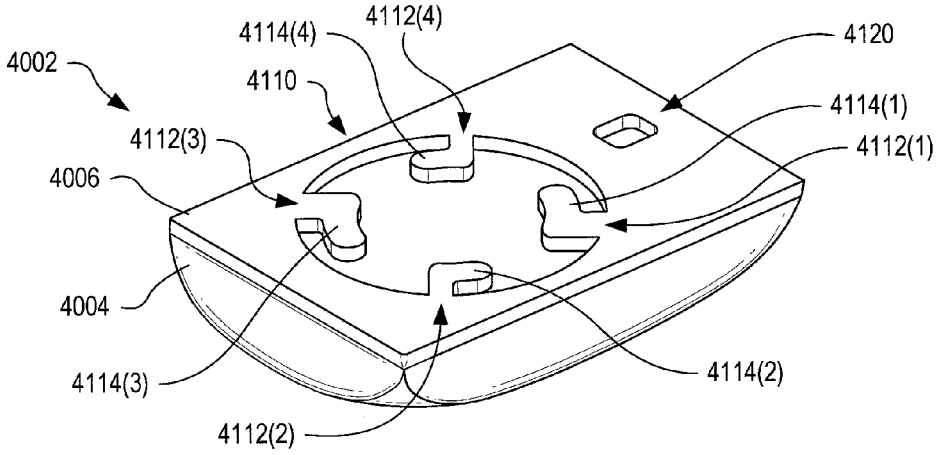
Figure 42:
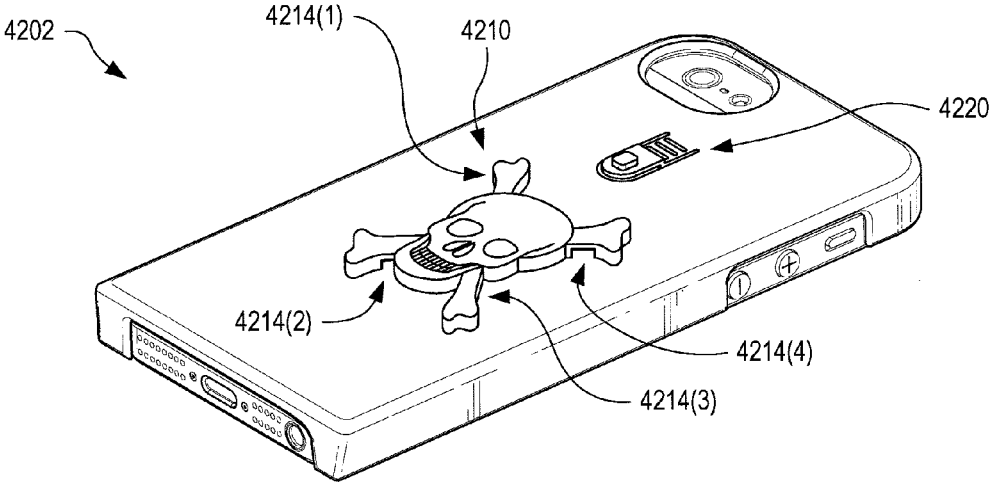

FIG. 41 shows the bottom of portion 4002 illustrating a first keyed coupling 4010 that couples with a second keyed coupling 4210 of protection portion 4202. As shown, second keyed coupling 4210 is styled with skull and crossbones. Other suitable designs may be used without departing from the scope hereof. More particularly, each different design provides features that make second keyed coupling 4210 both irregular and unique. Each first keyed coupling 4110 is designed specifically to couple with one second keyed coupling 4210, based upon the selected stylistic design, thus variation between designs also provides unique keying between couplings 4110 and 4210.

In this example, the design that forms second keyed coupling 4210 is raised above the back surface of portion 4202 first keyed coupling 4110 is recessed into base 4006 of portion 4002. Tabs 4114 of second keyed coupling 4110 are positioned to fit into recesses 4214 formed within the ends of the crossed bones of second keyed coupling 4210.

Figure 43:
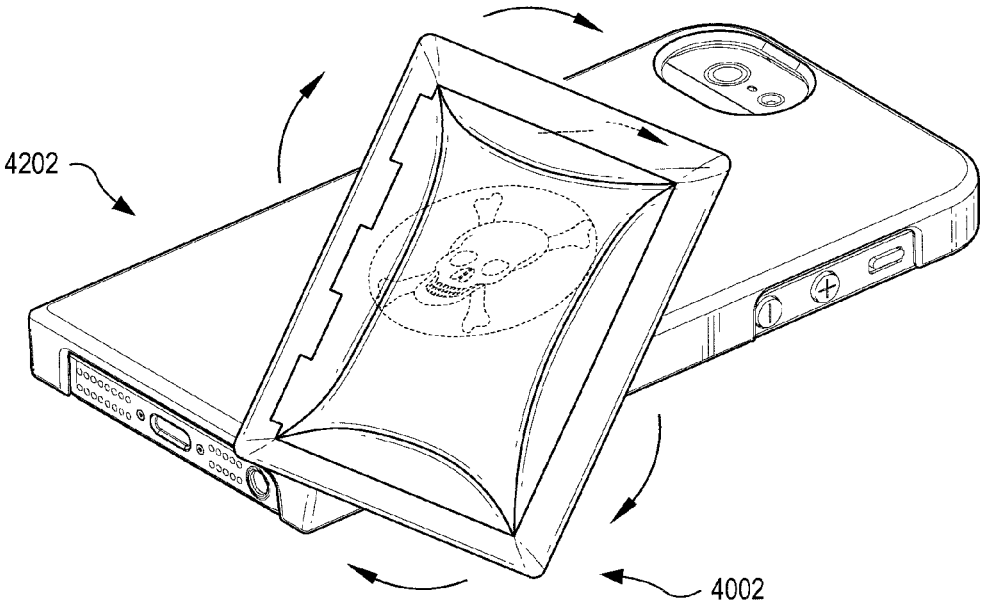
Figure 44:
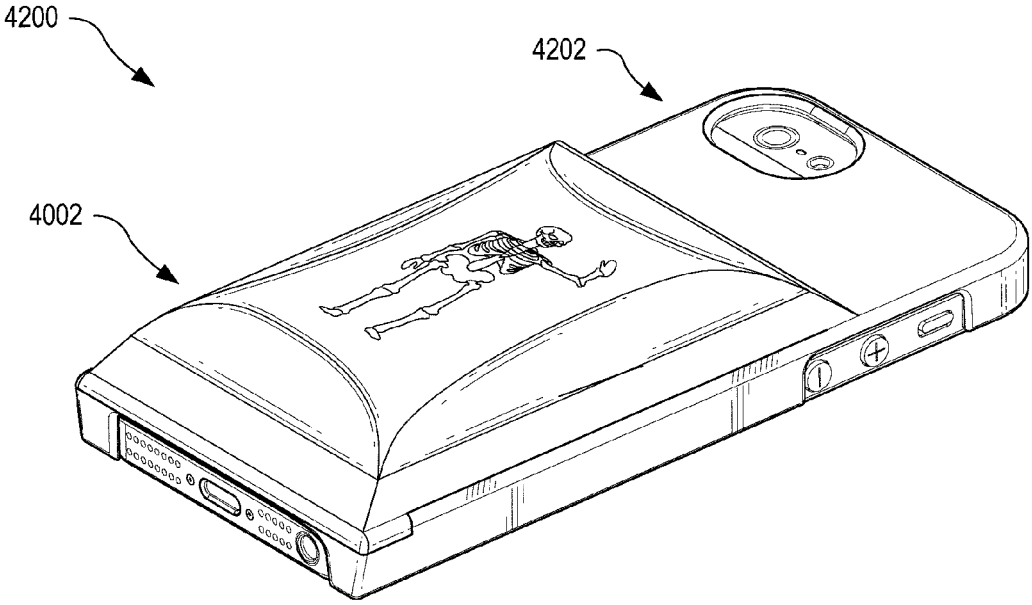

As shown in FIG. 43, coupling is obtained in this example by rotating portion 4002, when positioned over portion 4202, relative to portion 4202 such that tabs 4114 simultaneously engage with recesses 4214 when portion 4002 is aligned with portion 4202, as shown in FIG. 44. A clasp 4220 on portion 4202 retains clip 4120 to prevent unintended rotation of portion 4002 relative to portion 4202 and there prevent unintended decoupling of portion 4002 from portion 4202.

There are many beneficial reasons to allow the earphone storage case to function independently from the DMD and yet still be mateable when desired by the user.

Advantages of the Two-in-One Case to the Consumer.

Some users may wish to separate earphone storage compartment from the DMD case for a short period of time while maintaining the two storage components in close proximity. For example, a person going to the gym for a workout session may enter the facility with a earphone case and a DMD protective case locked together. Once inside the facility, the user may wish to leave his/her phone in a locker, but take the protective case containing the earphones into the facilities workout area. Many modern workout machines, such a stationary bikes and treadmills are earphone compatible and feed TV and audio signals through the equipment making sound available to owners of earphones who bring the earphones into the workout facility. When the user is finished exercising, he/she can reattach the earphone case to the DMD case and head off work or out for the day with the two devices recombined in a single ergonomic package.

Other users may wish to use the DMD separately from the stored earphones and leave the earphones behind for a period of time, but in close proximity and fully protected with a case. One occasion whereby a user may wish to separate the earphones storage case containing the earphone and caddy from the DMD is, when going out to a nightclub or to an evening dinner. New clothing styles, such as skinny jeans, may make the bulge of the combo case uncomfortable when placed in a tight pocket. The user may wish to take the phone along, but choose to leave the earphones behind in the car. The earphones may have been used during the day but not needed in the evening.

Some earphone buyers may wish have the option of storing their earphones separately from time to time from their handheld DMD, so that they are available for use in conjunction with notebook computer in a hotel room while the phone is taken outside and alone to meetings.

The retail packaging arrangement provides the earphone purchaser a fully organized earphone secured by a caddy and contained within a protective case. The purchaser would then have the option of purchasing compatible matable DMD protective case if desired, or being content knowing the earphones are packaged with a caddy that organizes the earphones, and a earphone storage case that protects their investment better than being packaged with just an exposed caddy, a cloth bag for example. More precise examples follow an explanation of the rest of the embodiments.

Figure 45:
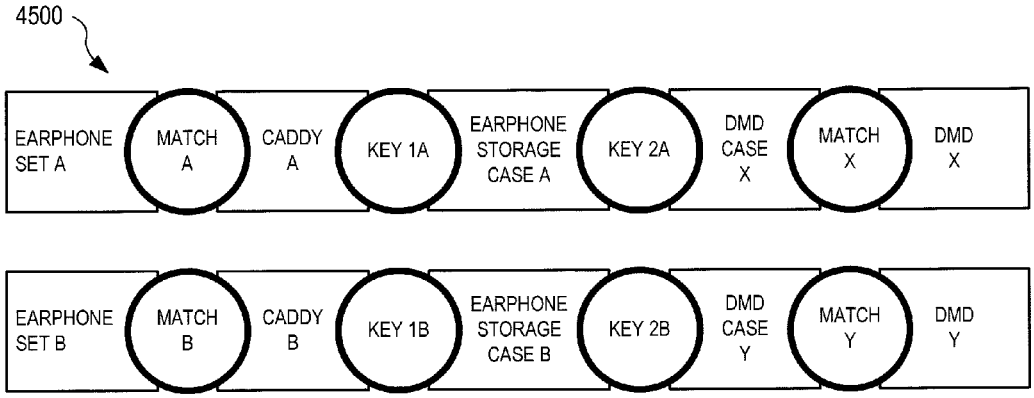
FIG. 45 shows one exemplary scenario wherein a first manufacturer sells a DMD X accompanied by an earphone set A mounted on a caddy A that is configured specifically for storing earphone set A, in an embodiment.

FIG. 45 shows one exemplary scenario 4500 wherein a first manufacturer sells a DMD X accompanied by an earphone set A mounted on a caddy A that is configured specifically for storing earphone set A. The first manufacturer also sells a DMD case X, which is configured to protect DMD X, and an earphone storage case A. Caddy A and earphone storage case A are configured with a first keyed coupling (key 1A), such that caddy A may couple with case A to store earphone set A, mounted on caddy A, within the storage area of case A. Earphone storage case A and DMD case X are configured with a second keyed coupling (key 2A), such that earphone storage case A may couple with case X to store earphone set A mounted on caddy A proximate and coupled with DMD case X and thus DMD X.

In the example of FIG. 45, a second manufacturer sells a DMD Y accompanied by an earphone set B mounted on a caddy B which is configured specifically for storing earphone set B. The second manufacturer also sells a DMD case Y that is configured to protect DMD Y and an earphone storage case B. Caddy B and earphone storage case B are configured with a first keyed coupling (key 1B), such that caddy B may couple with earphone storage case B to store earphone set B, mounted on caddy B, within the storage area of earphone storage case B. Earphone storage case B and DMD case Y are configured with a second keyed coupling (key 2B), such that earphone storage case B may couple with case Y to store earphone set B mounted on caddy B proximate and coupled with DMD case Y and thus DMD Y.

In scenario 4500, the first manufacturer thus defines a relationship (A, 1A, 2A, X) between DMD, caddy, earphone storage case, and matching DMD case. The second manufacturer thus defines a relationship (B, 1B, 2B, Y) between DMD, caddy, earphone storage case, and matching DMD case.

Figure 46:
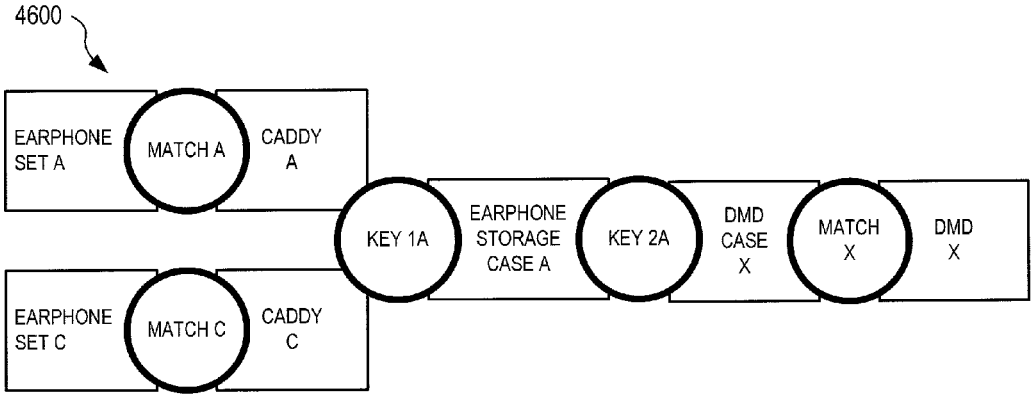
FIG. 46 shows one exemplary scenario wherein the first manufacturer optionally supplies a second earphone set C on a caddy C that is also configured to store earphone set C within the storage area of earphone storage case A, in an embodiment.

FIG. 46 shows one exemplary scenario 4600 wherein the first manufacturer optionally supplies a second earphone set C on a caddy C that is also configured with keyed coupling (key 1A) such that caddy C couples with earphone storage case A to store earphone set C, mounted on caddy C, within the storage area of earphone storage case A. Thus, the consumer of the first manufacturer, selecting either earphone set A or earphone set C, may purchase earphone storage case A and DMD case X to store the selected earphone set. In another exemplary scenario, earphone set C is sold by a third manufacturer in cooperation with the first manufacturer, wherein the first manufacturer allows the third manufacturer to configure caddy C with keyed coupling (key 1A) to allow its use with earphone storage case A and DMD case X.

In scenario 4600, first configuration of DMD, caddy, earphone storage case, and matching DMD case may be described as (A, 1A, 2A, X) and the second configuration may be described as (C, 1A, 2A, X).

Figure 47:
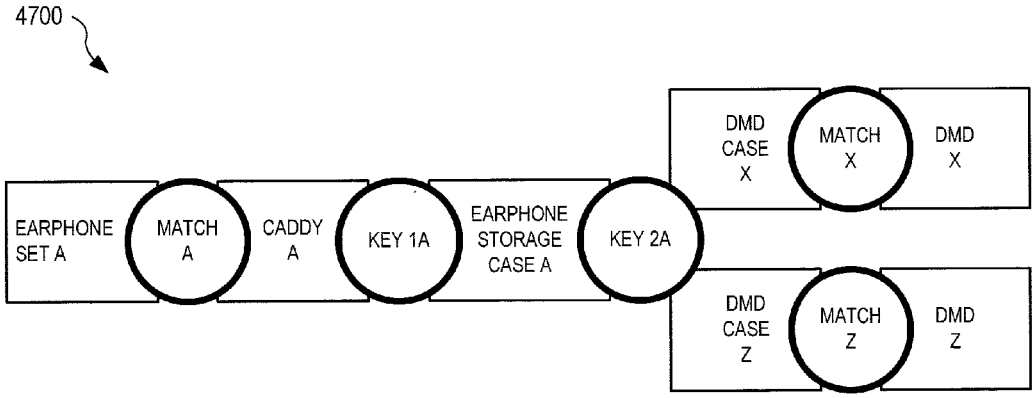
FIG. 47 shows one exemplary scenario wherein the first manufacturer also sells a second DMD Z and a matching DMD case Z, in an embodiment.

FIG. 47 shows one exemplary scenario 4700 wherein the first manufacturer also sells a second DMD Z and a matching DMD case Z for protecting DMD Z. DMD case Z is also configured with the second keyed coupling (key 2A) such that earphone storage case A couples with DMD case Z. Thereby, earphone storage case A may couple with either DMD case A or DMD case Z. Thus, the consumers of the first manufacturer, selecting either DMD X and matching DMD case X or DMD Z and matching DMD case Z, may store earphone set A, mounted on caddy A, within the storage area of earphone storage case A coupled with their selected DMD case. In another exemplary scenario, DMD case Z is sold by a third manufacturer (e.g., a case manufacturer) in cooperation with the first manufacturer, wherein the first manufacturer allows the third manufacturer to configure DMD case Z with keyed coupling (key 2A) to allow its use with earphone storage case A, caddy A, and earphone set A.

In scenario 4700, first configuration of DMD, caddy, earphone storage case, and matching DMD case may be described as (A, 1A, 2A, X) and the second configuration may be described as (A, 1A, 2A, Z).

Figure 48:
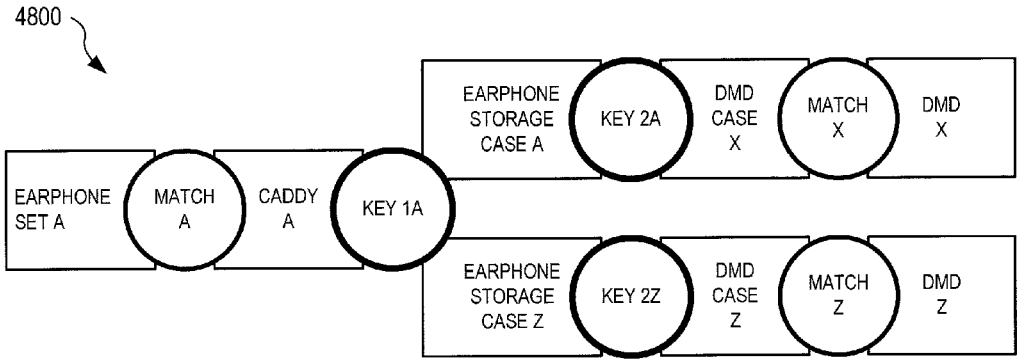
FIG. 48 shows one exemplary scenario wherein the first manufacturer also sells a second earphone storage case Z, in an embodiment.

FIG. 48 shows one exemplary scenario 4800 wherein the first manufacturer also sells a second earphone storage case Z. Earphone storage case Z is configured with first keyed coupling (key 1A) such that caddy A couples with earphone storage case Z to store earphone set A, mounted on caddy A, within the storage area of earphone storage case Z. Earphone storage case Z and DMD case Z are configured with a keyed coupling (key 2Z) that allows earphone storage case Z to couple with DMD case Z. Thus, the consumers of the first manufacturer, selecting either DMD X and matching DMD case X or DMD Z and matching DMD case Z, may store earphone set A, mounted on caddy A, within the storage area of earphone storage case A and couple it to their selected DMD storage case. In another exemplary scenario, one or both of earphone storage case Z and DMD case Z are sold by a third manufacturer (e.g., a case manufacturer) in cooperation with the first manufacturer, wherein the first manufacturer allows the third manufacturer to configure earphone storage case Z with the first keyed coupling (key 1A) to allow its use with caddy A and earphone set A.

In scenario 4800, first configuration of DMD, caddy, earphone storage case, and matching DMD case may be described as (A, 1A, 2A, X) and the second configuration may be described as (A, 1A, 2Z, Z).

By keying each specific caddy to a specific earphone storage case, and each earphone storage case to a specific DMD case, exclusive relationships are provided that encourages brand loyalty. For example, where a caddy is matched to an earphone set that is provided with a DMD, and the caddy is keyed to a particular case sold by the same manufacturer, the consumer is encouraged to also buy the matching earphone storage case and matching DMD case to obtain optimal earphone set storage and protection. More particularly, to use the case efficiently for storing an earphone set, the consumer is limited to use an earphone set provided (with the appropriate caddy) by that manufacturer. Consumers may find brand loyalty advantageous because it allows them to carry the DMD and a well-organized earphone set together in the most compact form achievable (i.e., wound onto a specifically matched caddy and stored within an optimally sized and shaped earphone storage case that attaches to a case protecting the DMD).

By controlling use of each keyed coupling (e.g., key 1A, key 2A), a manufacturer may advantageously steer consumers to specific products, since caddies and cases that do not have the same keyed coupling (e.g., do not share the same key 1A) cannot couple to allow storage of the earphone set within the storage area in the most convenient and protective form.

Figure 49:
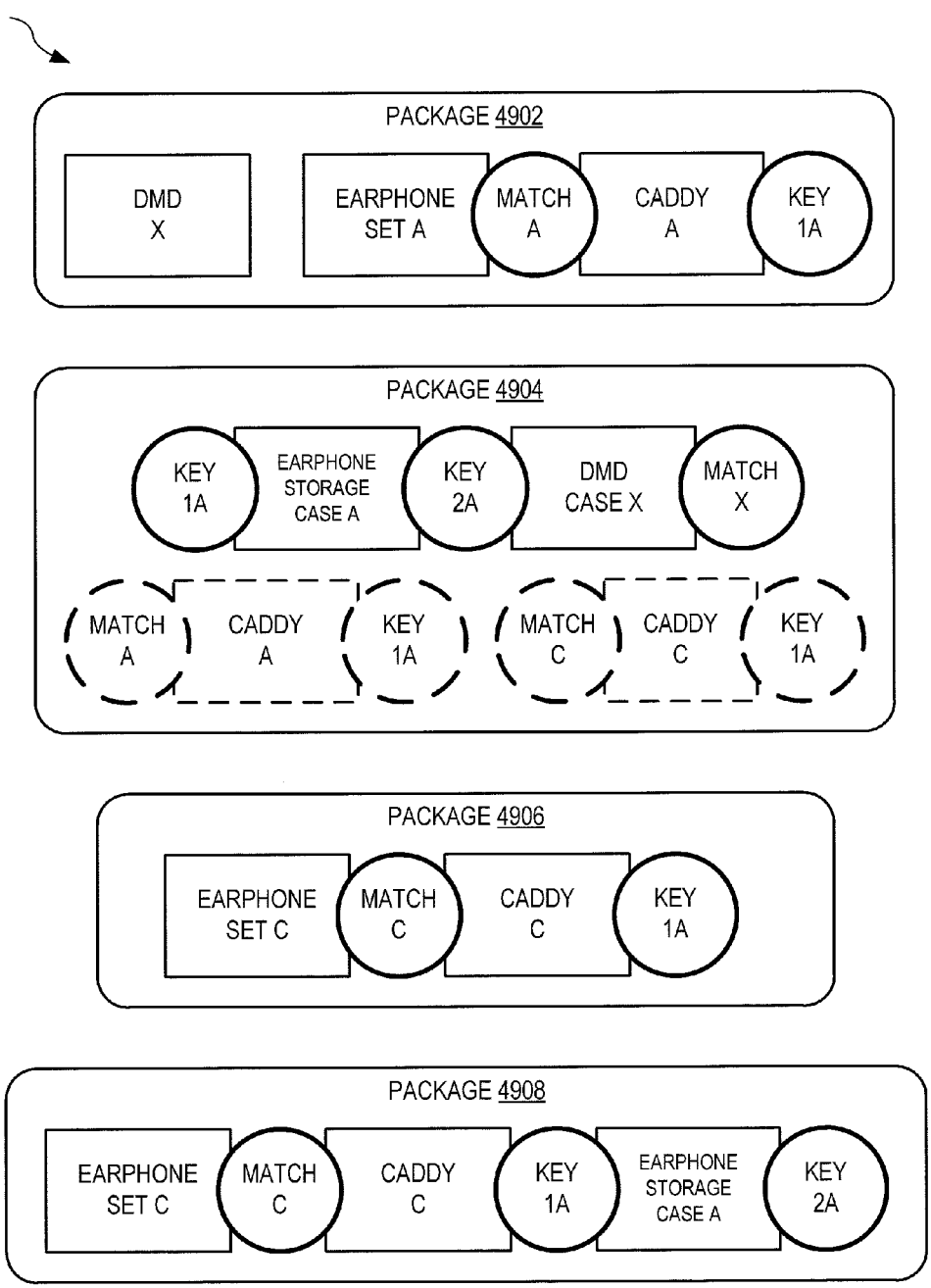
FIG. 49 shows exemplary packaging for the scenario of FIG. 48, in an embodiment.

FIG. 49 shows one exemplary scenario 4900 with improved packaging, where the DVD manufacturer sells DMD X, earphone set A, and keyed caddy A (optionally earphone set A is mounted on keyed caddy A) in a first package 4902, sells DMD case X, earphone storage case A, and optionally keyed caddy A and/or keyed caddy B in a second package 4904, sells earphone set C and keyed caddy C (optionally earphone set C is mounted on keyed caddy C) in a third package 4906, and sells earphone set C, keyed caddy C (optionally earphone set C is mounted on keyed caddy C), and earphone storage case A in a fourth package 4908.

As shown in FIGS. 45-48, the consumer is encouraged to purchase one or more of packages 4902, 4904, 4906, and 4908 based upon matches A, C, and X, and keys 1A and 1B to obtain optimal flexibility, storage, and protection of DMD X and earphone set A and/or C, using one or more of keyed caddies A and C, earphone storage case A, and DMD case X. For example, by purchasing packages 4902 and 4904, the consumer obtains DMD case X to protect DMD X, and earphone storage case A, that couples with DMD case X based upon key 2A, to provide storage of earphone set A on keyed caddy A when earphone storage case A is coupled with DMD case. The inclusion of one or both of keyed caddies A and C within packages 4902, 4904, 4906, and 4908, particularly when the matching earphone set is mounted on the caddy, shows the convenience and utility of the caddy to the consumer who is then more likely to purchase a matching case to take advantage of the caddy. Similarly, knowing that earphone set C has a matching keyed caddy C that also couples with earphone storage case A encourages the consumer to purchase earphone set C rather than a different earphone set from a different manufacturer (unless that manufacturer has an agreement with the DMD manufacturer to be able to use key 1A).

Separable Exoskeleton Keyed Protective Case

Figure 50:
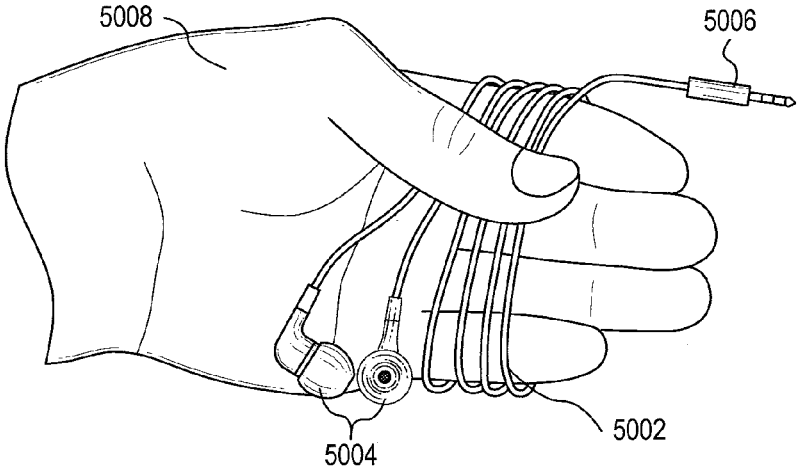
FIG. 50 shows a prior art earphone set wound around a user's hand.

FIG. 50 shows earphone set 5002 wound around a user's hand 5008. Earphone set 5002 has "linguini" style cables and wires that are manufactured to have an oval or rectangular cross section, as opposed to the conventional round cross sections of other wires and cables, such that the wires and cables are less pliable and more controllable once wound. Earphone set 5002 has ear pieces 5004 and a jack 5006.

Figure 51:
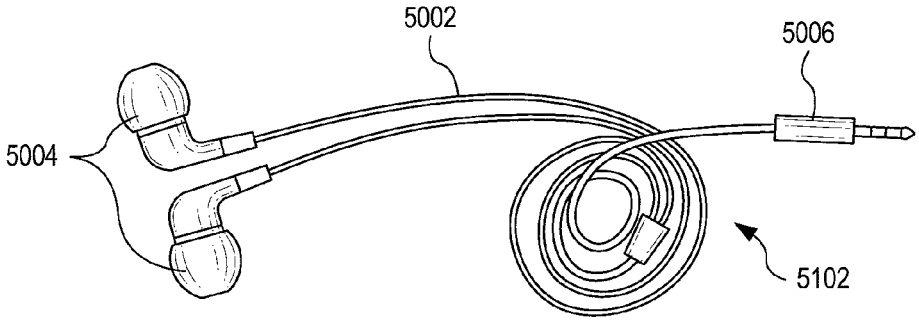
FIG. 51 shows the prior art earphone set of FIG. 50 removed from the user's hand and allowed to relax.
Figure 52:
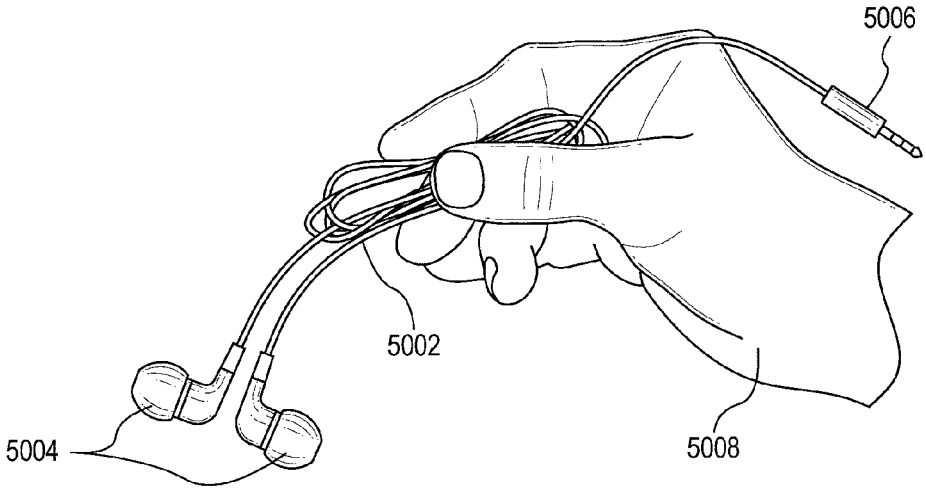
FIG. 52 shows the user's hand gripping the coiled cables of earphone set to change the circular coil into an elongated shape in preparation for storing the earphone set within an exoskeleton case.

FIG. 51 shows earphone set 5002 of FIG. 50 removed from the user's hand 5008 and allowed to relax, wherein the wires and cables form a more circular shape 5102 because of the more springy nature of the cables and wires as compared to earphone sets 100, and 200 of FIGS. 1 and 2 for example which are very pliable in nature. FIG. 52 shows the user's hand 5008 gripping the coiled cables of earphone set 5002 to change the circular coil into an elongated shape in preparation for storing earphone set 5002 within an exoskeleton case (see FIGS. 53-59 and 72-77).

Figure 53:
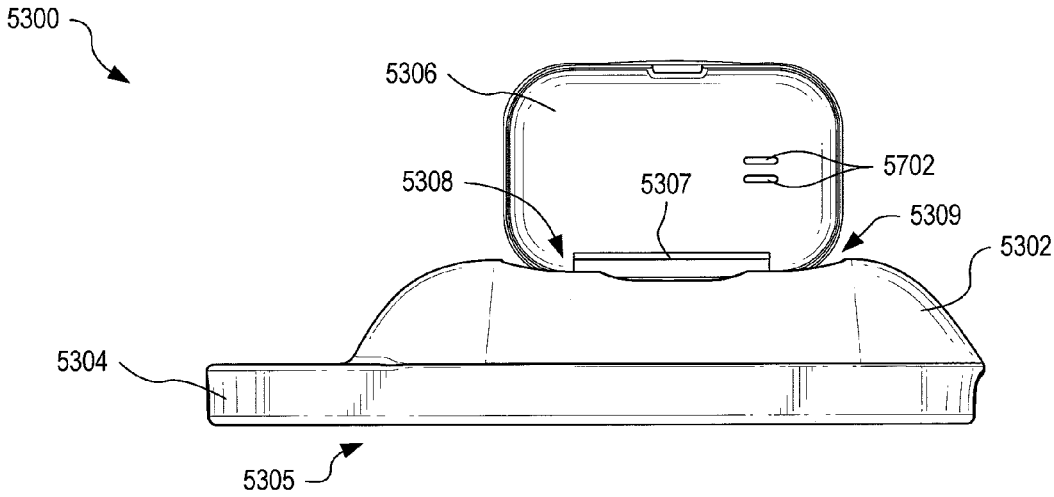
FIG. 53 is a side view showing one exemplary DMD exoskeleton combo case, in an embodiment.

FIG. 53 is a side view showing one exemplary DMD exoskeleton combo case 5300 formed with a domed earphone storage portion 5302 and a base portion 5304 that couples with and protects a DMD 5305. Storage portion 5302 forms a storage area 5308 through an open portion 5309 that may be closed by a lid 5306, illustrated in the open position and attached to storage portion 5302 by a hinge 5307. Open portion 5309 is smaller than the perimeter of storage portion 5302 (see also FIG. 54) and functions to retain earphone set 5002 within storage area 5308 prior to closing of lid 5306.

Figure 54:
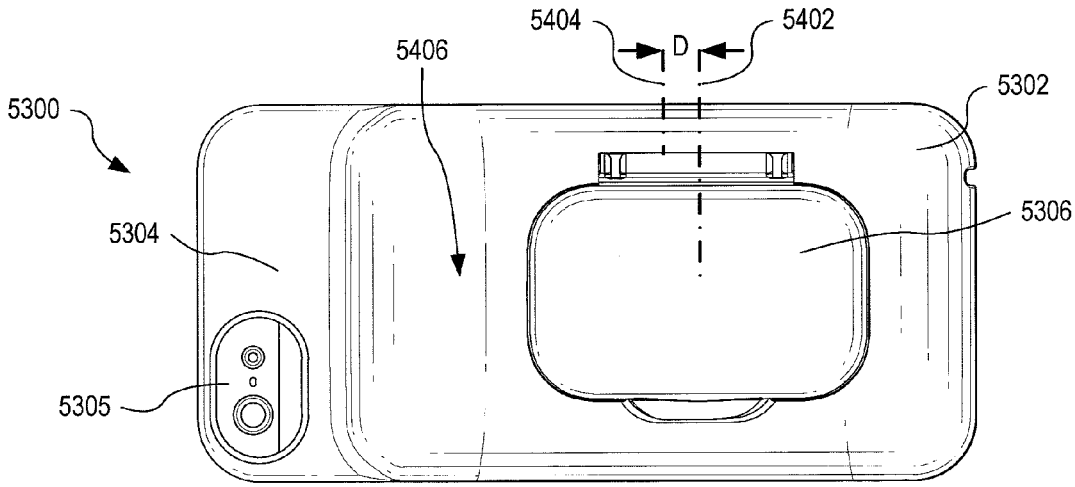
FIG. 54 is a top view of the case of FIG. 53 illustrating the lid closing the opening.

FIG. 54 is a top view of case 5300 with lid 5306 closing opening 5309. The center position 5402 of opening 5309 (and lid 5306 when closed) is offset by a distance D from a center position 5404 of storage area 5308 and storage portion 5302. The offset of the center 5402 of opening 5309 from the center 5404 of storage area 5308 by distance D provided additional "roof" area 5406 at one end of storage area 5308, as compared to the roof area at the other end of storage area 5308, to facilitate storage of ear pieces 5004 of earphone set 5002 therein.

Figure 55:
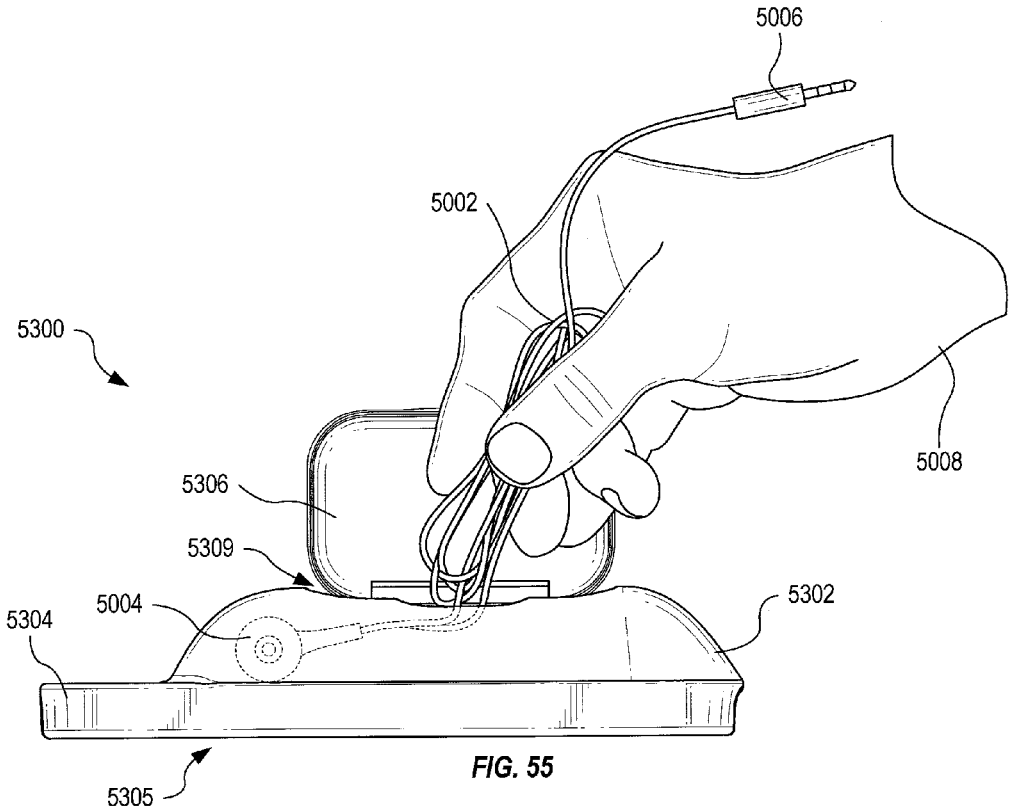
FIG. 55 is a side view illustrating how the earphone set of FIG. 50 is inserted through the opening and into the storage area of the DMD exoskeleton combo case of FIG. 53.
Figure 56:
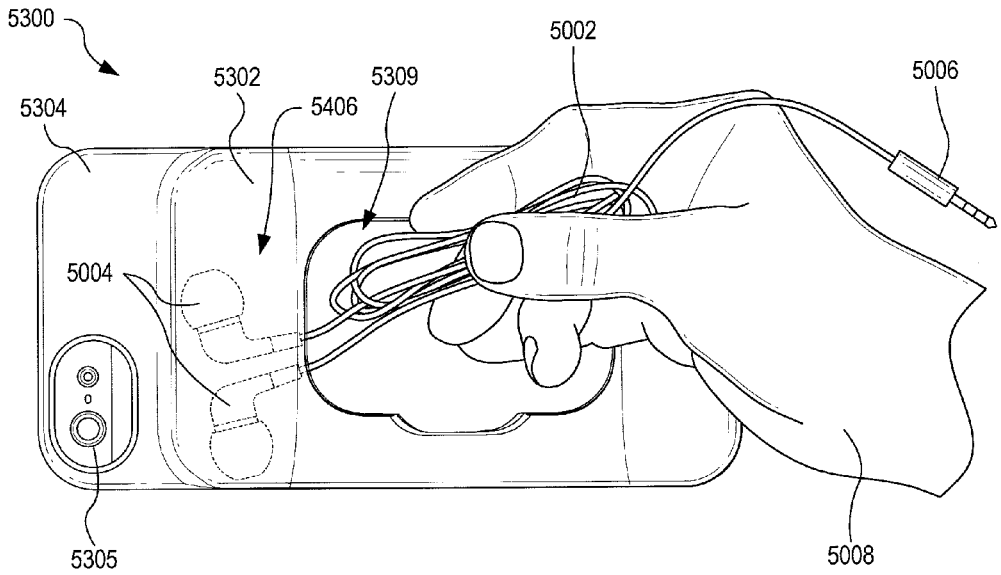
FIG. 56 is a top view illustrating how the earphone set of FIG. 50 is inserted through the opening and into storage area of the case of FIG. 53.

FIG. 55 is a side view illustrating how earphone set 5002 is inserted through opening 5309 and into storage area 5308 of DMD exoskeleton combo case 5300. FIG. 56 is a top view illustrating how earphone set 5002 is inserted through opening 5309 and into storage area 5308 of case 5300. Lid 5306 is omitted from FIG. 56 for clarity of illustration. As shown in FIGS. 55 and 56, earpieces 5004 are inserted first through opening 5309 and are accommodated beneath roof area 5406. Then, the compressed coil of wires and cables of earphone set 5002 are inserted through opening 5309, as shown.

Figure 57:
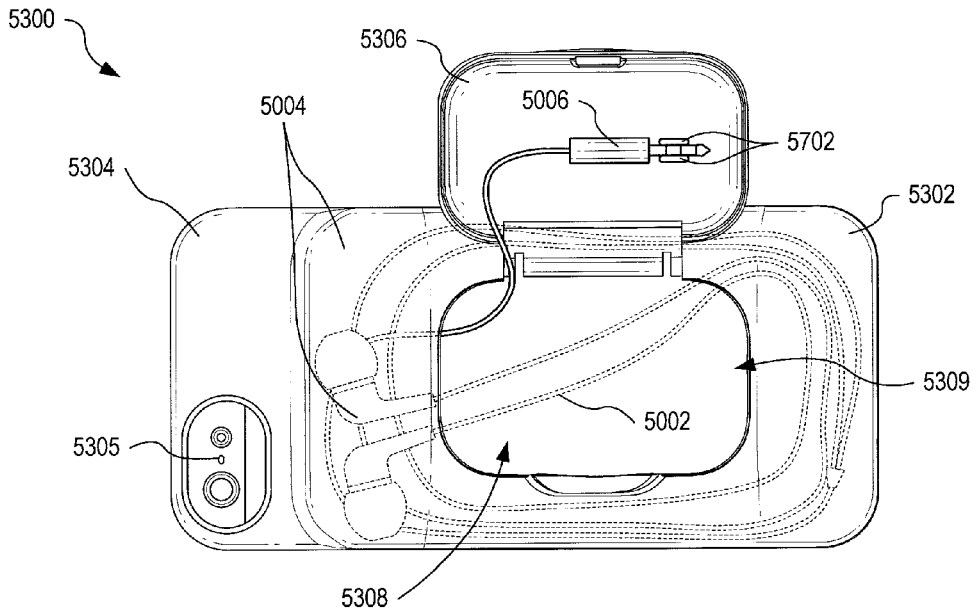
FIG. 57 is a top view illustrating capture of the jack of the earphone set of FIG. 50 by a clamp of the lid of the case of FIG. 53, in an embodiment.
Figure 58:
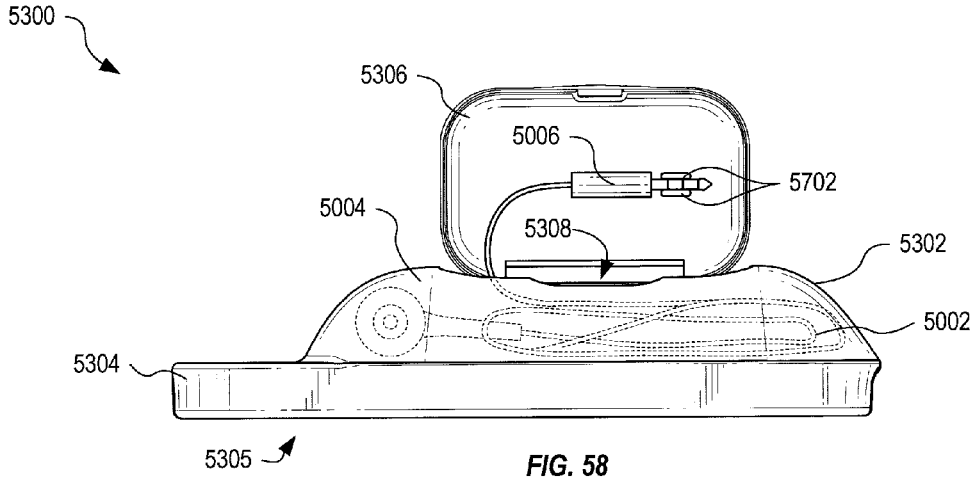
FIG. 58 is a side view illustrating capture of the jack of the earphone set of FIG. 50 within the clamp of the lid of the case of FIG. 53.

FIG. 57 is a top view illustrating earphone set 5002 partially within storage area 5308 of case 5300 and capture of jack 5006 within clamp 5702 of lid 5306. FIG. 58 is a side view illustrating earphone set 5002 partially within storage area 5308 of case 5300 and capture of jack 5006 within clamp 5702 of lid 5306. FIGS. 57 and 58 are best viewed together with the following description. When inserted into storage area 5308 and released from the user's hand (not shown), wires and cables of earphone set 5002 relax and resumed a more circular shaped coil with a size restricted by the internal size of storage area 5308. Since this coil size is larger than opening 5309, the coiled cable and wires remain within storage area 5308. Further, the oval or rectangular cross section of the cables and wires maintain the two dimensional "flat" coiled shape, unlike cables and wires with a round cross sections that typically coil in additional planes, thereby possibly extruding from opening 5309. Thus case 5300 is preferred for use with the linguini style cables and wires of earphone set 5002. Jack 5006 is secured to lid 5306 by means of a retention clip 5702 that is formed for example of two shaped posts positioned to capture and retain the ⅛ inch metal portion of jack 5006. Lid 5306 is for example constructed from plastic or rubber.

Figure 59:
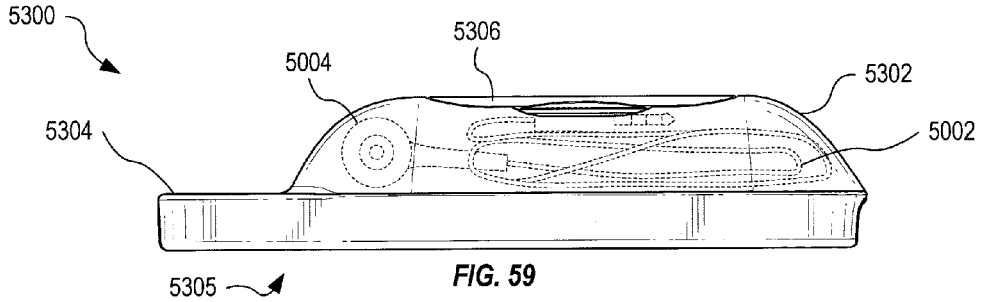
FIG. 59 is a side view showing the case of FIG. 53 storing the earphone set of FIG. 50 with the lid closed.

FIG. 59 is a side view showing case 5300 storing earphone set 5002 with lid 5306 closed. To remove earphone set 5002 from storage area 5308 of case 5300, lid 5306 is opened first, and then jack 5006 is extracted from retention clip 5702. Retention clip 5702 facilitates retrieval of jack 5006 as compared to if jack 5006 were simply pushed through opening 5309 and loosely contained within storage area 5308. By pulling jack 5006 away from opening 5309, coils of earphone set 5002 are easily extracted from storage area 5308 without tangle.

Figure 60:
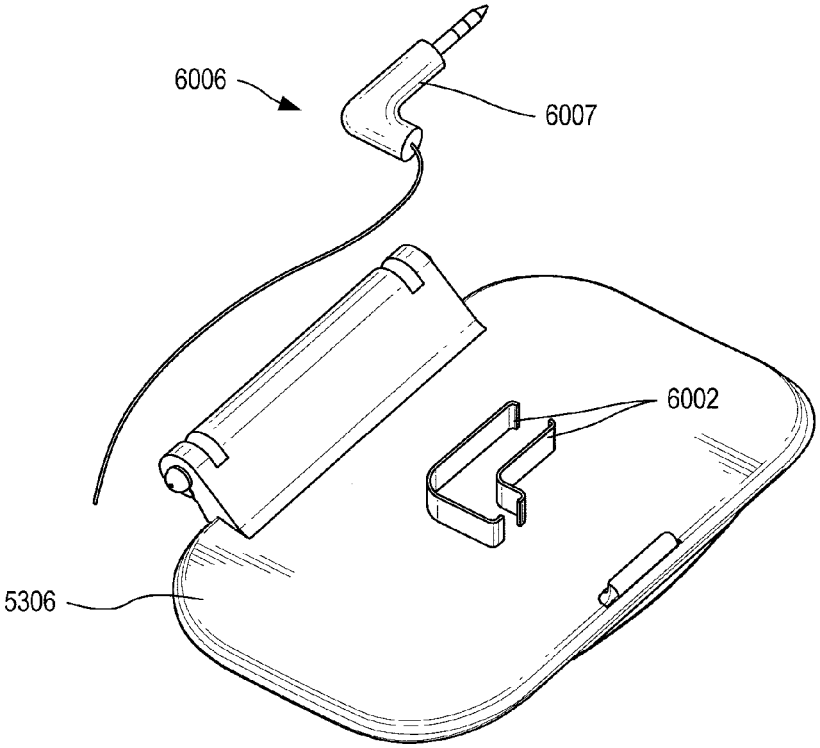
FIGS. 60 and 61 show capture of an earphone set jack with an alternatively shaped body portion by a clamp formed on the lid of the case of FIG. 53 that is keyed (shaped) to capture the jack, in an embodiment.
Figure 61:
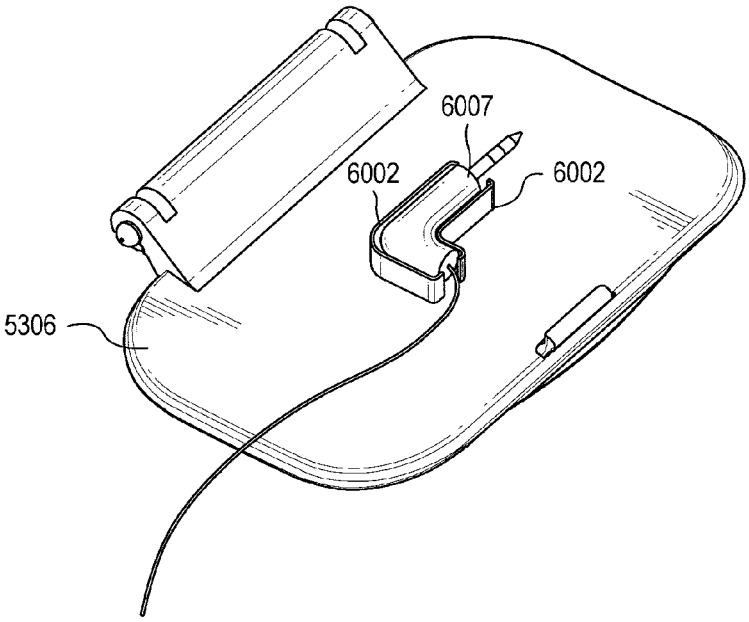

FIGS. 60 and 61 show capture of a jack 6006 with an alternatively shaped body portion 6007, where clamp 6002, formed on lid 5306, is keyed (shaped) to capture jack 6006. Specifically, clamp 6002 is formed to capture only the body portion 6007, and will therefore only retain jack 6006. Thus, clamp 6002 is keyed to certain earphone sets having jacks with a body portion substantially the same shape and size as body portion 6007.

Figure 62:
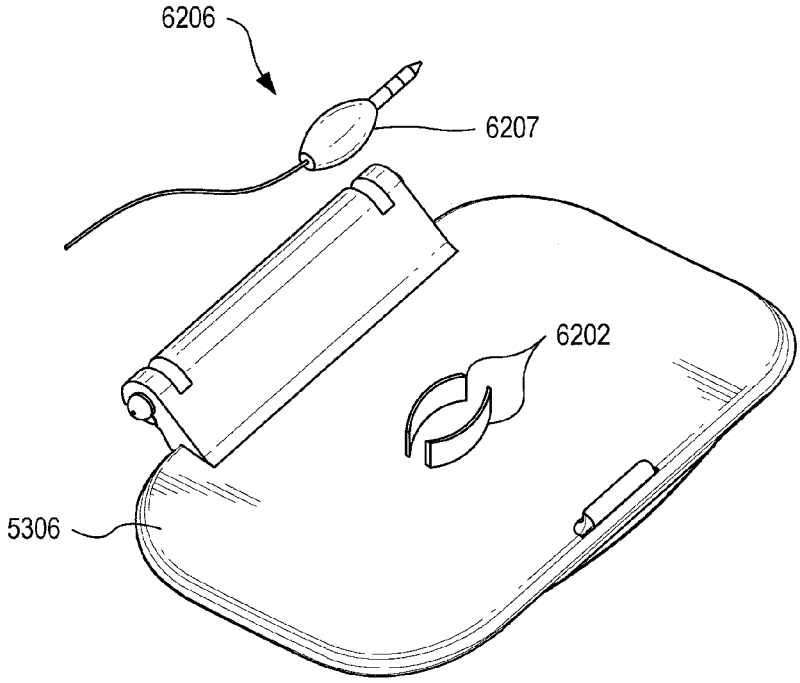
FIG. 62 shows an earphone set jack with another alternatively shaped body portion that is captured by a matching clamp formed on the lid of the case of FIG. 53, in an embodiment.
Figure 63:
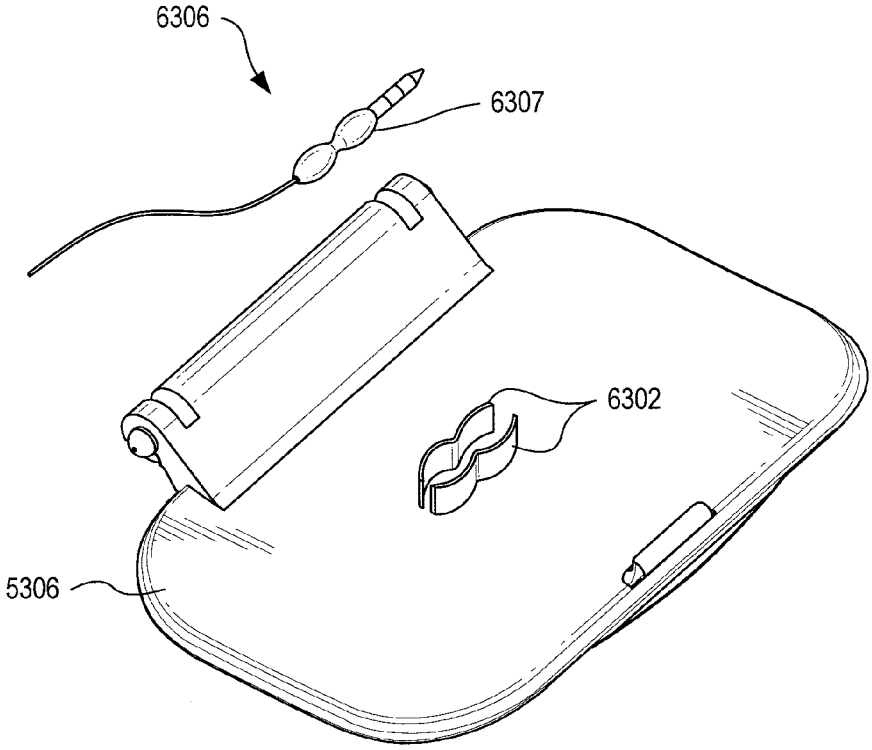
FIGS. 63-67 show further variations in the shape and size of the body portion of earphone set jacks and exemplary matching clamps for capturing the jacks, in various embodiments.
Figure 64:
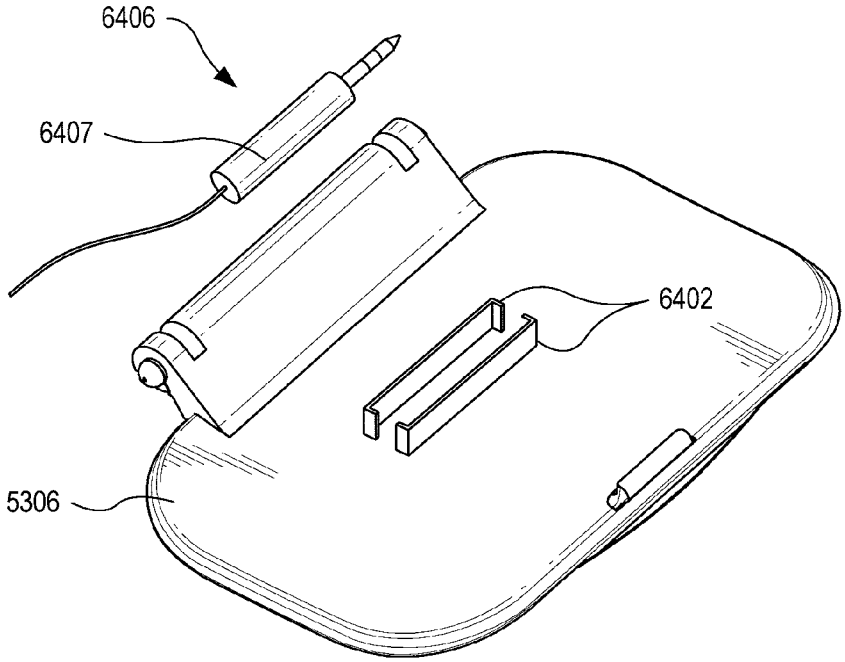
Figure 65:
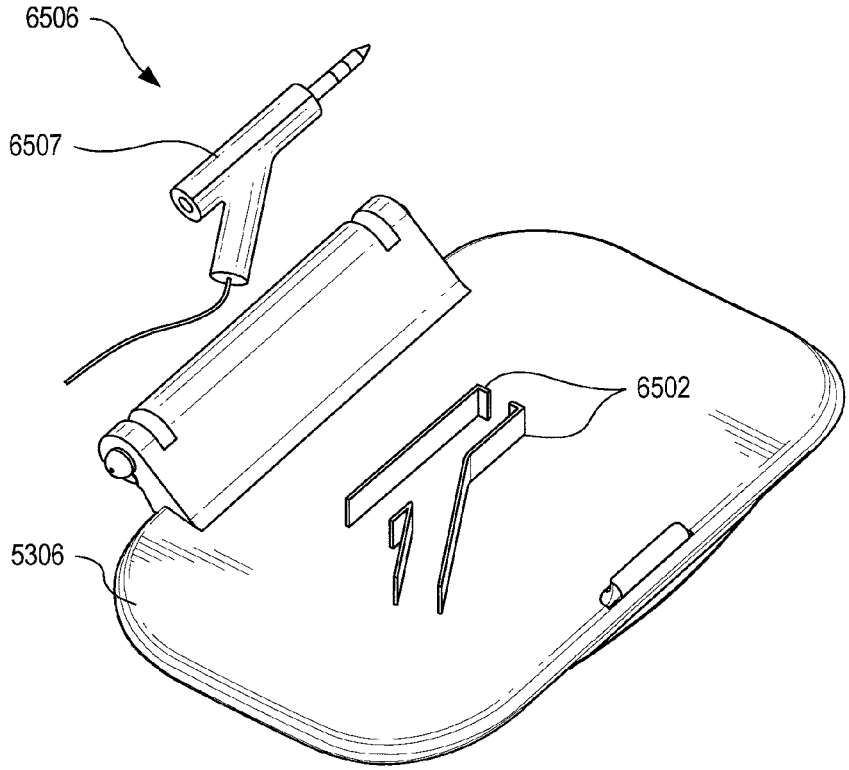
Figure 66:
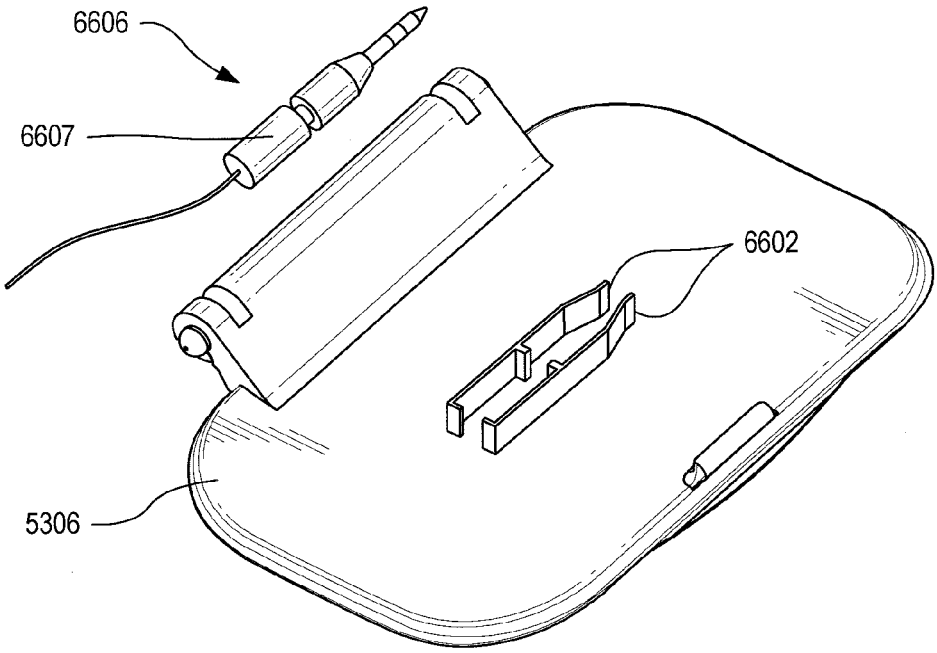
Figure 67:
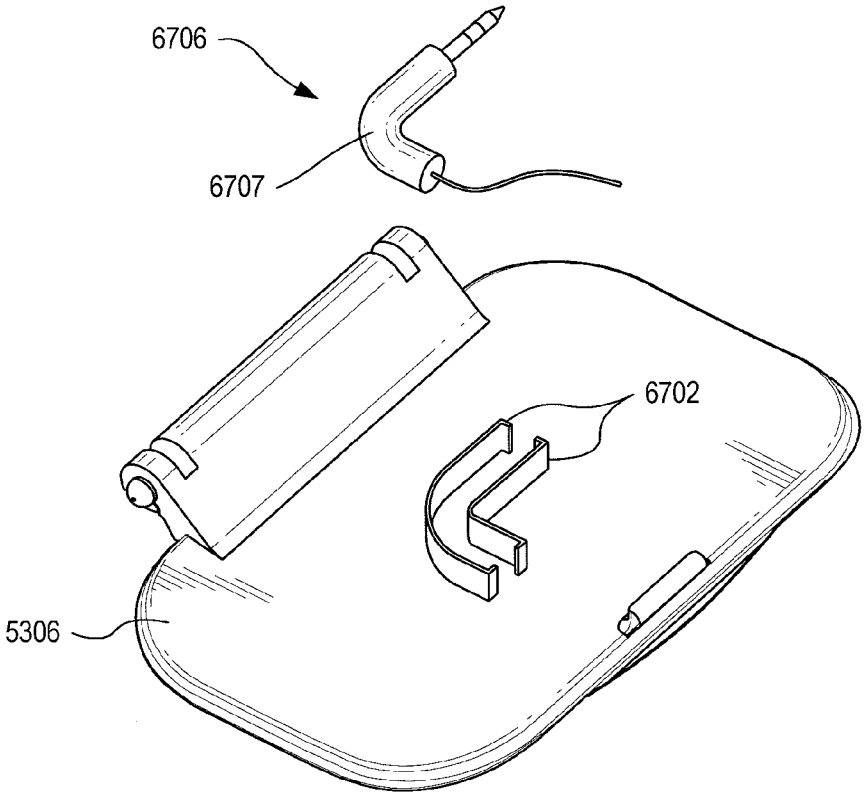

FIG. 62 shows a jack 6206 with another alternatively shaped body portion 6207 and lid 5306 formed with a matching clamp 6202, wherein body portion 6207 is retained by clamp 6202. Shape and size of body portion 6207 is selected to be unique from other earphone set manufacturers, thereby making DMD earphone combo case 5300 specific for use with earphone sets having jack 6206.

FIGS. 63-67 show further variations in the shape and size of body portion 6307, 6407, 6507, 6607, 6707 and matching clamps 6302, 6402, 6502, 6602, 6702, to illustrate alternative keying between lid 5306 and jacks 6306, 6406, 6506, 6606, and 6706, respectively.

Figure 68:
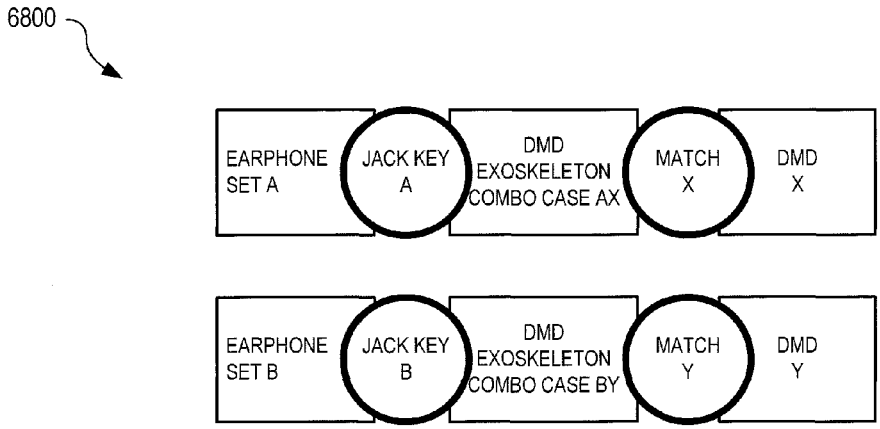
FIG. 68 shows one exemplary scenario wherein a first manufacturer sells a DMD accompanied by an earphone set, and a DMD exoskeleton case for protecting the DMD and for storing the earphone set, in an embodiment.

FIG. 68 shows one exemplary scenario 6800 wherein a first manufacturer sells a DMD X accompanied by an earphone set A (e.g., earphone set 5002 of FIG. 50). The first manufacturer also sells a DMD exoskeleton combo case AX (e.g., DMD exoskeleton combo case 5300 of FIG. 53), which is configured to protect DMD X, and to store earphone set A. DMD exoskeleton combo case AX is configured with a jack keyed coupling (jack key A), such that the lid of DMD exoskeleton combo case AX captures the jack of earphone set A. DMD exoskeleton combo case AX, when coupled with DMD X, allows earphone set A to be stored proximate DMD X.

In the example of FIG. 58, a second manufacturer sells a DMD Y accompanied by an earphone set B. The second manufacturer also sells a DMD exoskeleton combo case BY that is configured to protect DMD Y and to store earphone set B. DMD exoskeleton combo case BY is configured with a jack keyed coupling (jack key B), such that a lid of DMD exoskeleton combo case BY captures a jack of earphone set B. DMD exoskeleton combo case BY, when coupled with DMD Y, allows earphone set B to be stored proximate DMD Y.

In scenario 6800, the first manufacturer thus defines a relationship (A, X) between earphone set A, DMD exoskeleton combo case AX, and DMD X. The second manufacturer thus defines a relationship (B, Y) between earphone set B, DMD exoskeleton combo case BY, and DMD Y.

Figure 69:
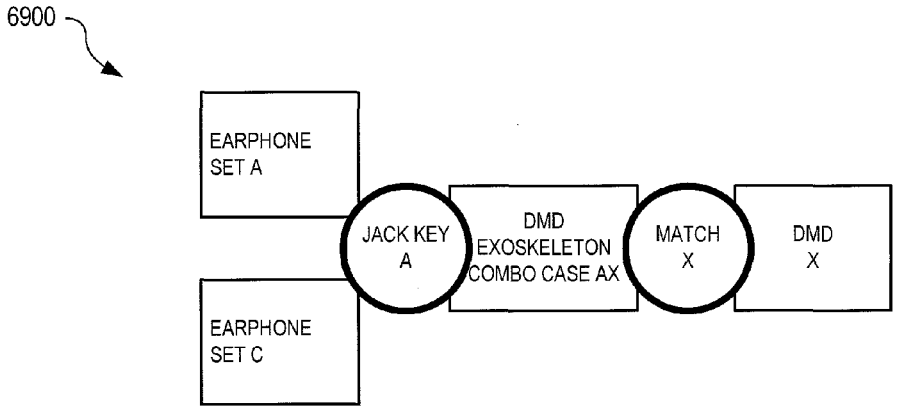
FIG. 69 shows one exemplary scenario wherein the DMD exoskeleton case stores each of two earphone sets, in an embodiment.

FIG. 69 shows one exemplary scenario 6900 wherein the first manufacturer optionally supplies a second earphone set C that is also configured with the same keyed jack (jack key A) such that earphone set C may be stored within DMD exoskeleton combo case AX. Thus, the consumer of the first manufacturer, selecting either earphone set A or earphone set C, may purchase DMD exoskeleton combo case AX to store the selected earphone set. In another exemplary scenario, earphone set C is sold by a third manufacturer in cooperation with the first manufacturer, wherein the first manufacturer allows the third manufacturer to configure earphone set C with the jack keyed coupling (jack key A) to allow its use with DMD exoskeleton combo case AX.

In scenario 6900, first configuration of earphone set, DMD exoskeleton combo case, and DMD may be described as (A, A, X) and the second configuration may be described as (C, A, X).

Figure 70:
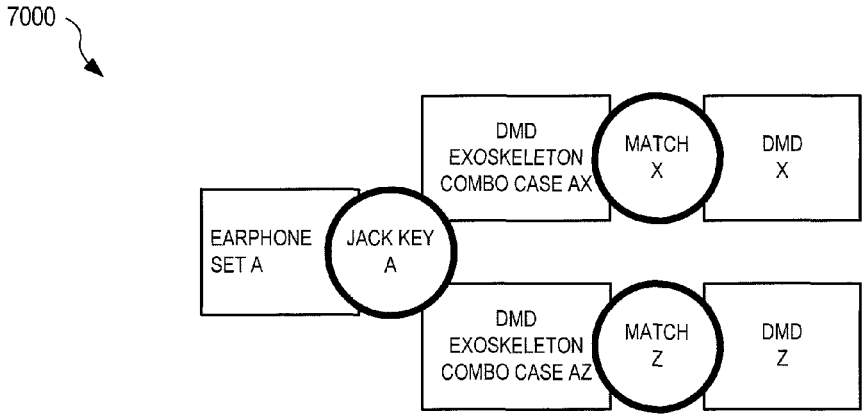
FIG. 70 shows one exemplary scenario wherein the first manufacturer also sells a second DMD and a matching DMD exoskeleton combo case for protecting the DMD and for storing the earphone set, in an embodiment.

FIG. 70 shows one exemplary scenario 7000 wherein the first manufacturer also sells a second DMD Z and a matching DMD exoskeleton combo case AZ for protecting DMD Z and for storing earphone set A. A lid of DMD exoskeleton combo case AZ is configured with the jack key A for securing the jack of earphone set A. Thus, the consumers of the first manufacturer, selecting either DMD X and matching DMD exoskeleton combo case AX or DMD Z and matching DMD exoskeleton combo case AZ, may store earphone set A proximate the selected DMD. In another exemplary scenario, DMD exoskeleton combo case AZ is sold by a third manufacturer (e.g., a case manufacturer) in cooperation with the first manufacturer, wherein the first manufacturer allows the third manufacturer to configure DMD exoskeleton combo case AZ with keyed coupling for earphone set A (jack key A) to allow its use with DMD Z and earphone set A.

In scenario 7000, first configuration of earphone set, exoskeleton storage case, matching DMD case, and the DMD may be described as (A, A, X) and the second configuration may be described as (A, A, Z).

By keying each earphone set to a specific DMD exoskeleton combo case, exclusive relationships are provided that encourages brand loyalty. For example, where an earphone set that is provided with a DMD, and the earphone set is keyed to a particular case sold by the same manufacturer, the consumer is encouraged to also buy the matching DMD exoskeleton combo case to obtain optimal earphone set storage and protection. By controlling use of each keyed coupling (e.g., key A), a manufacturer may advantageously steer consumers to specific products, since earphones and cases that do not have the same keyed coupling (e.g., do not share the same jack key A) operate less efficiently.

Figure 71:
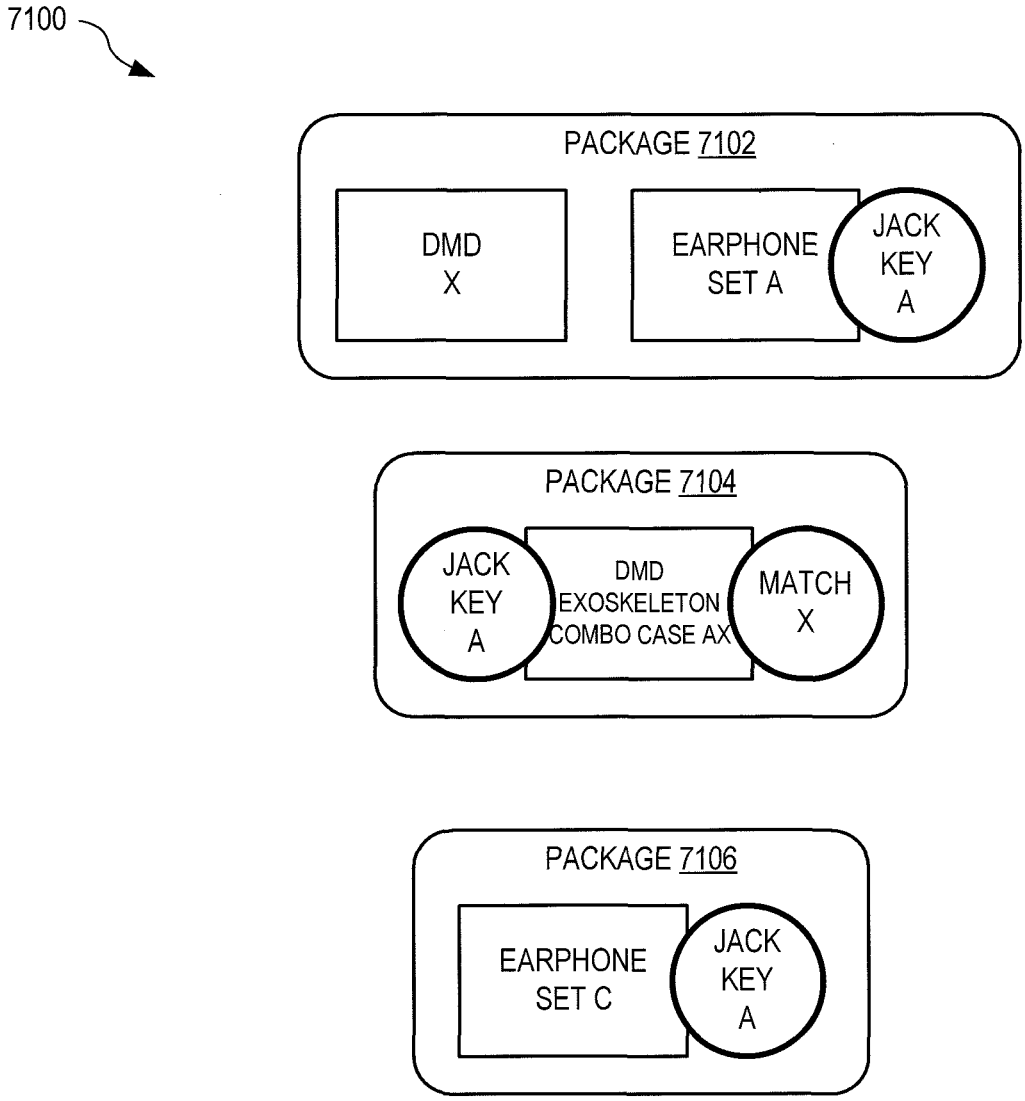
FIG. 71 shows one exemplary scenario where a first package includes a DMD X and an earphone set A, a second package includes a DMD exoskeleton combo case AX, and a third package includes an earphone set C, in an embodiment.

FIG. 71 shows one exemplary scenario 7100 with improved packaging, where the DVD manufacturer sells DMD X and earphone set A in a first package 7102, sells a DMD exoskeleton combo case AX in a second package 7104, and sells earphone set C in a third package 7106. As shown in FIGS. 68-70, the consumer is encouraged to purchase one or more of packages 7102, 7104, and 7106 based upon matches X and Z, and jack key A to obtain optimal flexibility, storage, and protection of the selected DMD and earphone set. For example, by purchasing packages 7102 and 7104, the consumer obtains DMD exoskeleton combo case AX to protect DMD X and to store earphone set A proximate DMD X.

Figure 72:
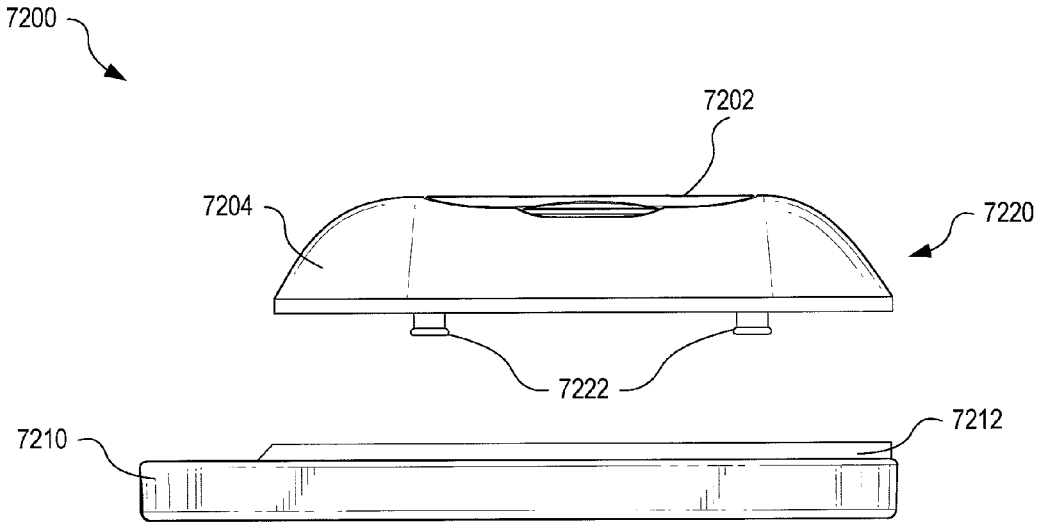
FIG. 72 shows one exemplary separable DMD protection and exoskeleton storage case for storing an earphone set proximate a DMD, in an embodiment.

FIG. 72 shows one exemplary exoskeleton case 7200 for storing an earphone set (e.g., earphone set 5002 of FIG. 50), wherein an earphone set storage portion 7220 is shown detached from a DMD protection portion 7210. Storage portion 7220 is formed with a lid 7202 that is removable from an exoskeleton shell 7204. Shell 7204 includes a coupling mechanism 7222 that couples with a mechanism 7212 of DMD protection portion 7210. When coupled together, storage portion 7220 and DMD protection portion 7210 facilitate storage and protection of an earphone set proximate a DMD. When storage portion 7220 is detached from DMD protection portion 7210, the earphone set remains protected and securely stored. In one example of operation, a user goes to a gym to exercise and separates storage portion 7220 from DMD protection portion 7210, storing the protected DMD within a locker while carrying the protected earphone set within storage portion 7220 while using the facilities at the gym.

Figure 73:
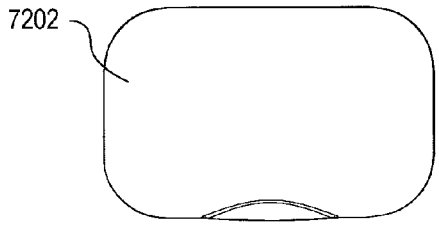
FIG. 73 shows the lid of the exoskeleton case of FIG. 72 in further detail.
Figure 74:
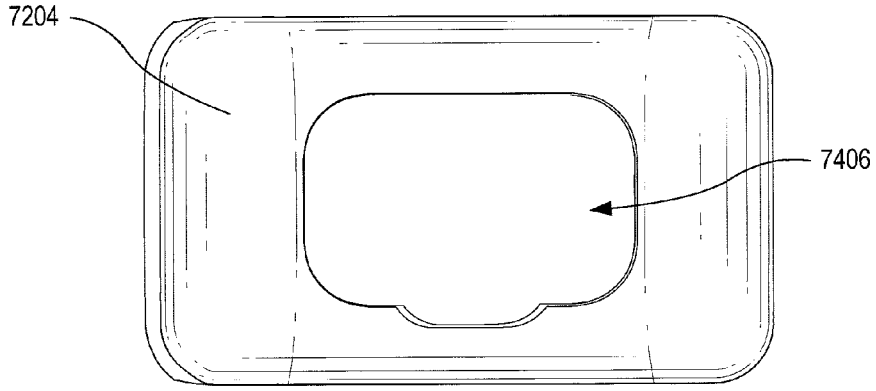
FIG. 74 is a top view of a shell of the exoskeleton case of FIG. 72.
Figure 75:
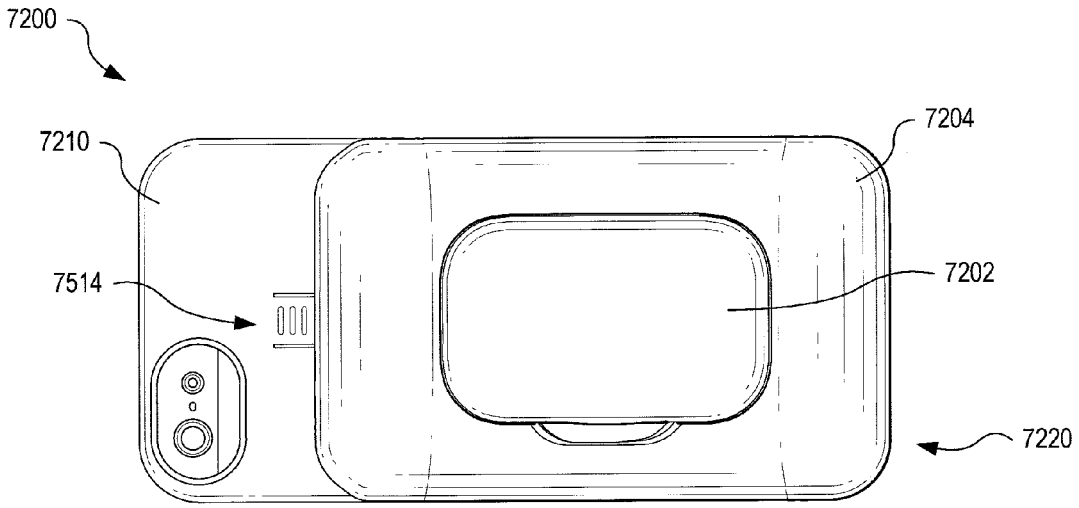
FIG. 75 is a top view showing a storage portion of the DMD protection and exoskeleton case of FIG. 72 coupled with the DMD protection portion.

FIG. 73 shows lid 7202 of exoskeleton case 7200 in further detail. Lid 7202 is for example made from a flexible plastic or rubber material. FIG. 74 is a top view of shell 7204 illustrating opening 7406 (with lid 7202 removed) through where the earphone set (e.g., earphone set 5002 of FIG. 50) is inserted and removed. FIG. 75 is a top view showing storage portion 7220 coupled with DMD protection portion 7210. A releasable clip 7514 secures storage portion 7220 to DMD protection portion 7210, and is released when depressed by a thumb or finger, for example, to allow storage portion 7220 to slide and separate from DMD protection portion 7210.

Figure 76:
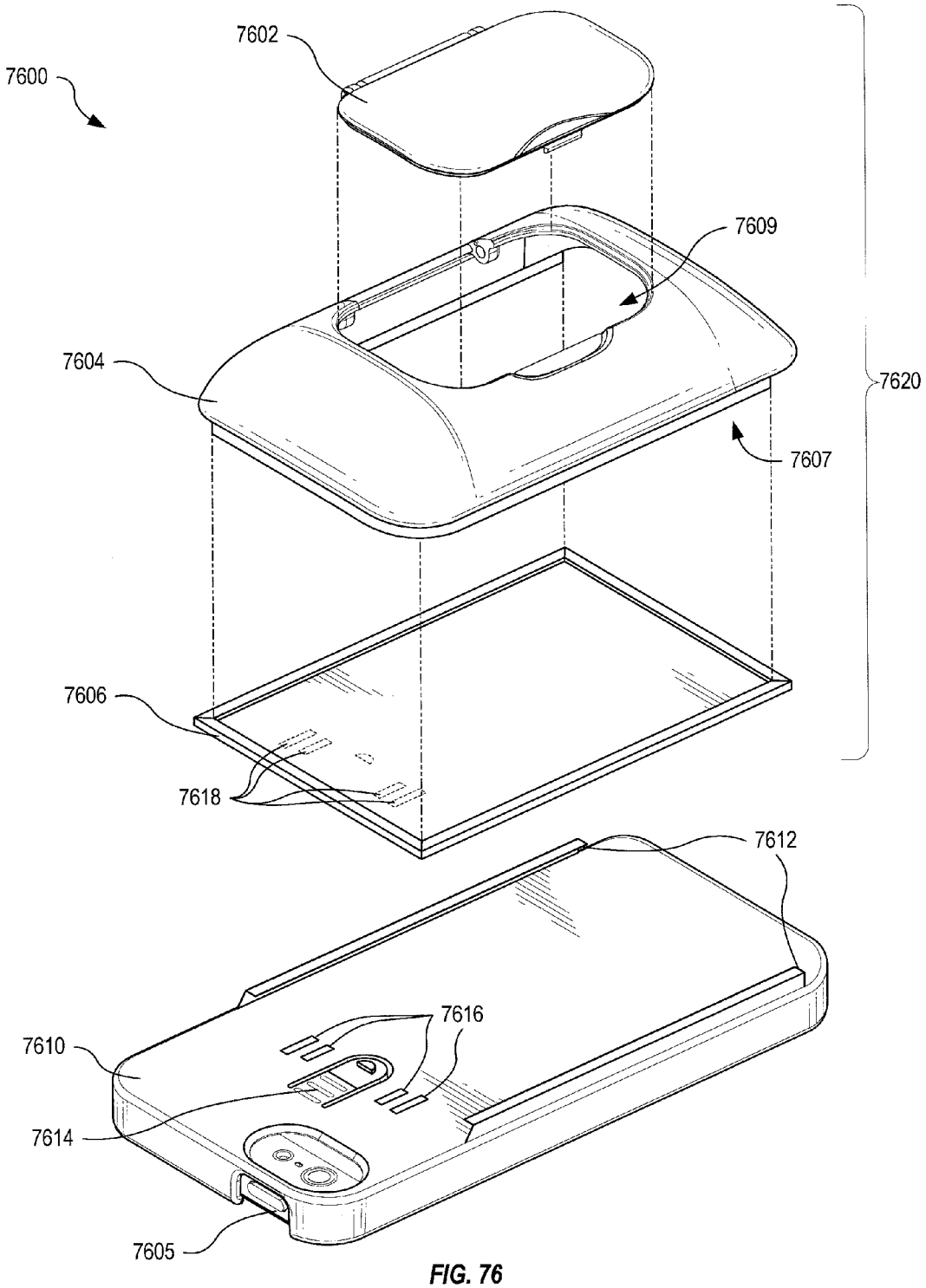
FIG. 76 is an exploded view of one exemplary detachable earphone storage case, in an embodiment.
Figure 77:
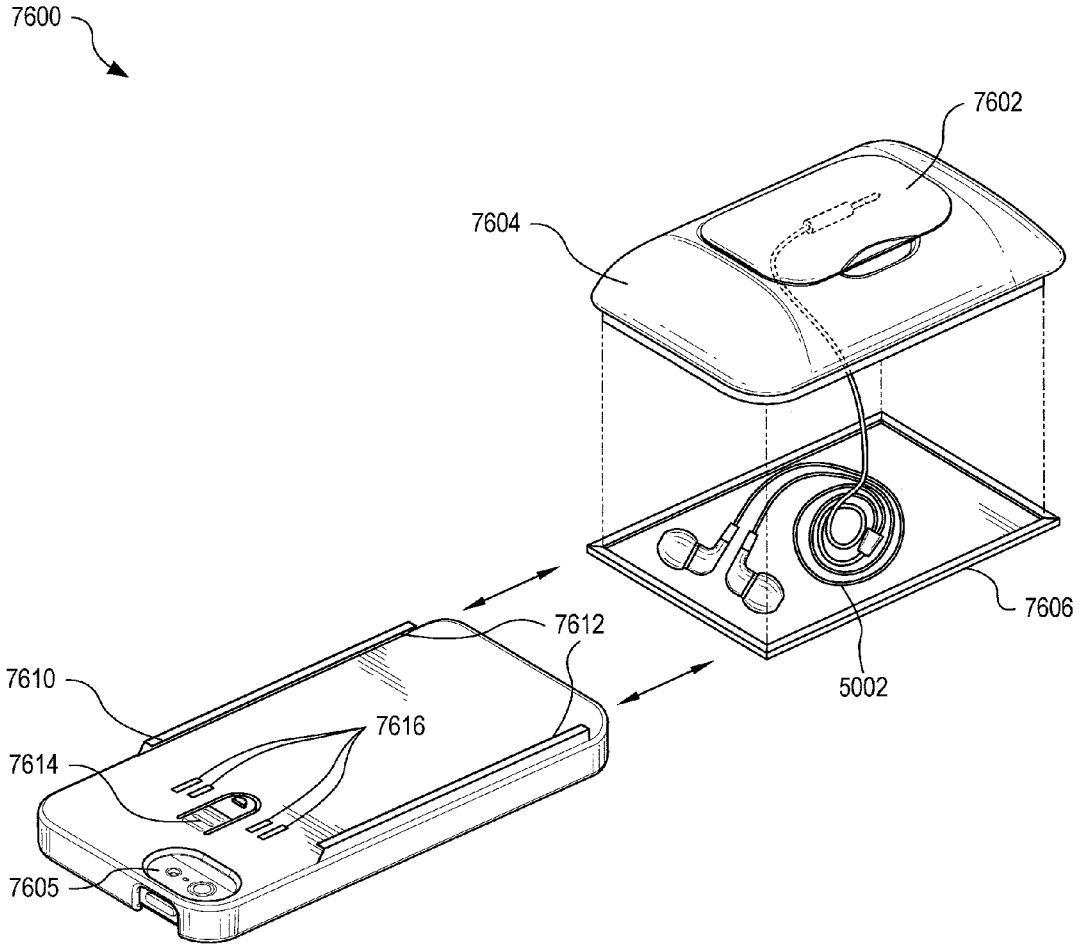
FIG. 77 shows exemplary operation of the case of FIG. 76.

FIG. 76 is an exploded view of one exemplary detachable earphone storage case 7600 that is similar to case 7200 of FIGS. 72-75. FIG. 77 shows exemplary operation of case 7600. FIGS. 76 and 77 are best viewed together with the following description.

Case 7600 has a storage portion 7620 and a DMD protection portion 7610. Storage portion 7620 is formed of a lid 7602, a dome 7604, and a base 7606, where lid 7602 is constructed of a malleable plastic or rubber and may be removably secured within an upper opening 7609 of dome 7604. Base 7606 is formed of a malleable plastic or rubber and is removably secured to dome 7604 to close a lower opening 7607. Although shown as a substantially flat plate, base 7606 may be otherwise shaped to couple with dome 7604 such that the join between dome 7604 and base 7606 is positioned higher on the domed shape.

DMD protection portion 7610 is configured with two rails 7612 that capture base 7606 when slid therebetween. DMD protection portion 7610 and base 7606 may also include matched keys 7616 and 7618 that prevent both base 7606 and DMD protection portion 7610 from coupling with non-matched (keyed) units. For example, key 7616 is formed of raised areas of material that require matching key 7618 to be formed of omitted areas of material positioned to overlay the raised material when base 7606 is slid into position between rails 7612 of DMD protection portion 7610 and secured by latch 7614. The position and length of each raised portion and omitted portion of matched keys 7616 and 7618 defines the keying (keyed coupling) between storage portion 7620 and DMD protective portion 7610.

As shown in FIGS. 76 and 77, upper opening 7609 is smaller than lower opening 7607. With base 7606 attached to dome 7604, an earphone set (e.g., earphone set 5002 of FIG. 50) is easily inserted and retained within storage portion 7620 by the curved "roof" of dome 7604, as compared to inserting earphone set through lower opening 7607 where no roof is available to help retain the earphone set while attaching base 7606. However, a user may prefer to remove base 7606 from dome 7604 to remove the earphone set from storage portion 7620.

Storage portion 7620 need not be configured with keys 7618 to couple with DMD protection portion 7610 when intended to be use independent thereof.

Figure 78:
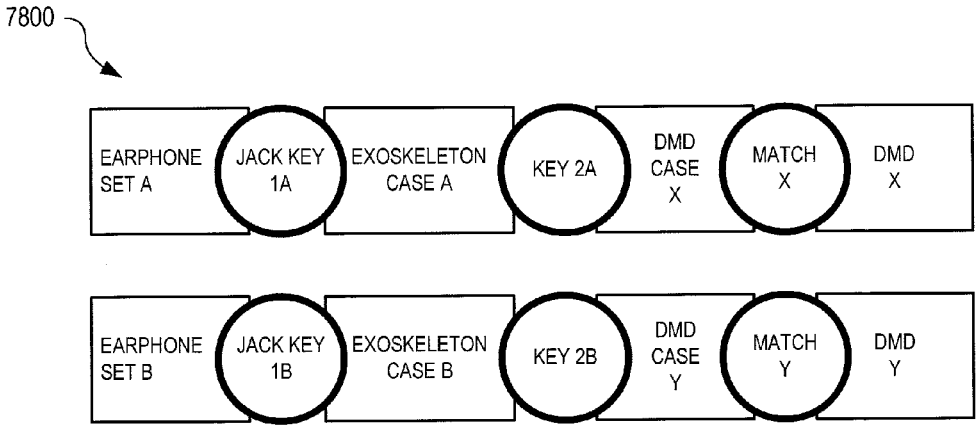
FIG. 78 shows one exemplary scenario wherein a first manufacturer sells a DMD X, a keyed exoskeleton case, a keyed DMD case, and a keyed earphone set A, in an embodiment.

FIG. 78 shows one exemplary scenario 7800 wherein a first manufacturer sells a DMD X accompanied by an earphone set A. The first manufacturer also sells a DMD case X, which is configured to protect DMD X, and an exoskeleton storage case A. Exoskeleton storage case A is configured with a first jack keyed coupling (jack key 1A), such that the lid of exoskeleton case A captures the jack of earphone set A. Exoskeleton storage case A and DMD case X are configured with a second keyed coupling (key 2A), such that exoskeleton storage case A may couple with case X to store earphone set A mounted on caddy A proximate and coupled with DMD case X and thus DMD X.

In the example of FIG. 78, a second manufacturer sells a DMD Y accompanied by an earphone set B. The second manufacturer also sells a DMD case Y that is configured to protect DMD Y and an exoskeleton storage case B. Exoskeleton storage case B is configured with a first jack keyed coupling (jack key 1B), such that a lid of exoskeleton storage case B captures a jack of earphone set B. Exoskeleton storage case B and DMD case Y are configured with a second keyed coupling (key 2B), such that exoskeleton storage case B may couple with case Y to store earphone set B proximate and coupled with DMD case Y and thus DMD Y.

In scenario 7800, the first manufacturer thus defines a relationship (i.e., keys 1A, 2A, X) between earphone set A, exoskeleton storage case A, matching DMD case X, and DMD X. The second manufacturer thus defines a relationship (i.e., keys 1B, 2B, Y) between earphone set B, exoskeleton storage case B, matching DMD case Y, and DMD Y.

Figure 79:
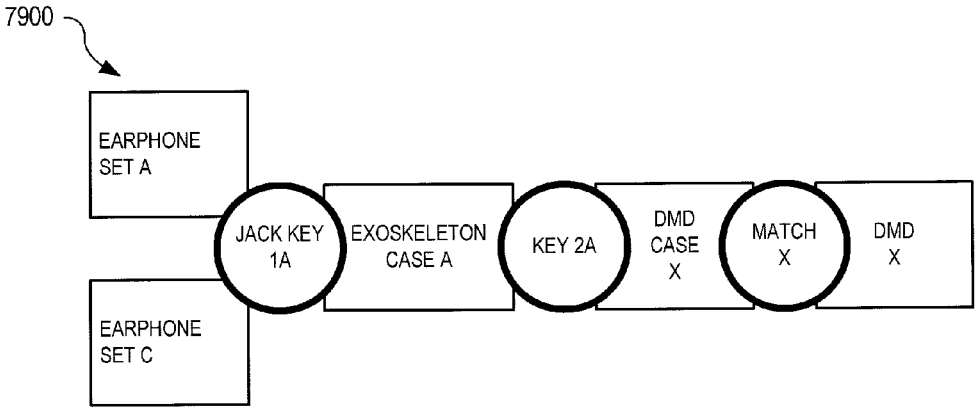
FIG. 79 shows one exemplary scenario wherein the first manufacturer optionally supplies a second earphone set C that is keyed for storage in the keyed exoskeleton case of FIG. 78.

FIG. 79 shows one exemplary scenario 7900 wherein the first manufacturer optionally supplies a second earphone set C that is also configured with the same keyed jack (jack key 1A) such that earphone set C may be stored within exoskeleton case A. Thus, the consumer of the first manufacturer, selecting either earphone set A or earphone set C, may purchase exoskeleton storage case A and DMD case X to store the selected earphone set. In another exemplary scenario, earphone set C is sold by a third manufacturer in cooperation with the first manufacturer, wherein the first manufacturer allows the third manufacturer to configure earphone set C with the jack keyed coupling (jack key 1A) to allow its use with exoskeleton storage case A and DMD case X.

In scenario 7900, first configuration of earphone set, exoskeleton storage case, matching DMD case, and DMD may be described as (A, 1A, 2A, X) and the second configuration may be described as (C, 1A, 2A, X).

Figure 80:
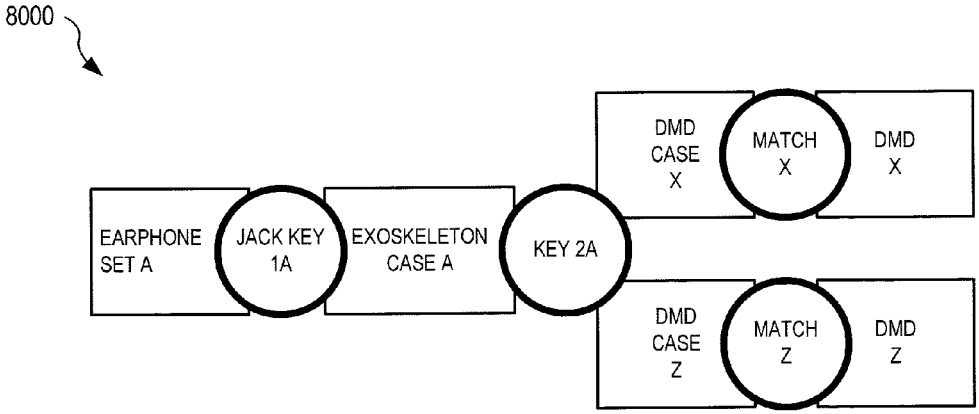
FIG. 80 shows one exemplary scenario wherein the first manufacturer also sells a second DMD Z and a matching DMD case Z for protecting DMD Z and that is keyed to couple with the exoskeleton case of FIG. 78.

FIG. 80 shows one exemplary scenario 8000 wherein the first manufacturer also sells a second DMD Z and a matching DMD case Z for protecting DMD Z. DMD case Z is also configured with the second keyed coupling (key 2A) such that exoskeleton storage case A couples with DMD case Z. Thereby, exoskeleton storage case A may couple with either DMD case A or DMD case Z. Thus, the consumers of the first manufacturer, selecting either DMD X and matching DMD case X or DMD Z and matching DMD case Z, may store earphone set A within the storage area of exoskeleton storage case A coupled with their selected DMD case. In another exemplary scenario, DMD case Z is sold by a third manufacturer (e.g., a case manufacturer) in cooperation with the first manufacturer, wherein the first manufacturer allows the third manufacturer to configure DMD case Z with keyed coupling (key 2A) to allow its use with exoskeleton storage case A and earphone set A.

In scenario 8000, first configuration of earphone set, exoskeleton storage case, matching DMD case, and the DMD may be described as (A, 1A, 2A, X) and the second configuration may be described as (A, 1A, 2A, Z).

Figure 81:
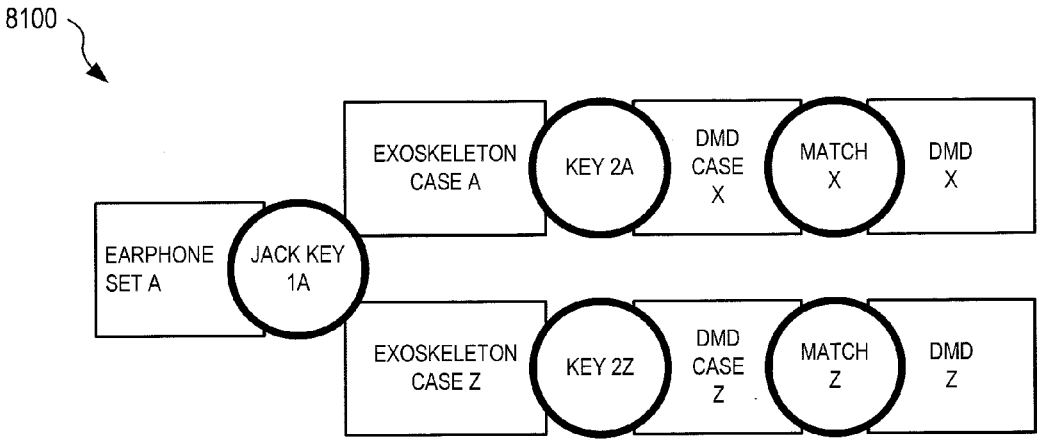
FIG. 81 shows one exemplary scenario wherein the first manufacturer also sells a second exoskeleton case Z that is keyed to couple with the DMD case of FIG. 80.

FIG. 81 shows one exemplary scenario 8100 wherein the first manufacturer also sells a second exoskeleton case Z. Exoskeleton case Z is configured with first jack keyed coupling (jack key 1A) such that a jack of earphone set A is captured by a lid of exoskeleton case Z to store earphone set A within the storage area of earphone storage case Z. Earphone storage case Z and DMD case Z are configured with a keyed coupling (key 2Z) that allows exoskeleton case Z to couple with DMD case Z. Thus, the consumers of the first manufacturer, selecting either DMD X and matching DMD case X or DMD Z and matching DMD case Z, may store earphone set A within the storage area of exoskeleton case A that optionally couples to their selected DMD storage case. In another exemplary scenario, one or both of exoskeleton case Z and DMD case Z are sold by a third manufacturer (e.g., a case manufacturer) in cooperation with the first manufacturer, wherein the first manufacturer allows the third manufacturer to configure exoskeleton case Z with the first jack keyed coupling (key 1A) to allow its use with earphone set A.

In scenario 8100, first configuration of earphone set, exoskeleton case, matching DMD case, and the DMD may be described as (A, 1A, 2A, X) and the second configuration may be described as (A, 1A, 2Z, Z).

By keying each earphone set to a specific exoskeleton case, and each exoskeleton case to a specific DMD case, exclusive relationships are provided that encourages brand loyalty. For example, where an earphone set that is provided with a DMD, and the earphone set is keyed to a particular case sold by the same manufacturer, the consumer is encouraged to also buy the matching exoskeleton case and matching DMD case to obtain optimal earphone set storage and protection. More particularly, to use the case efficiently for storing an earphone set, the consumer is limited to use an earphone set (with a keyed jack) provided by that manufacturer. Consumers may find brand loyalty advantageous because it allows them to carry the DMD and a well-organized earphone set together.

By controlling use of each keyed coupling (e.g., key 1A, key 2A), a manufacturer may advantageously steer consumers to specific products, since earphones and cases that do not have the same keyed coupling (e.g., do not share the same key 1A) operate less efficiently.

Figure 82:
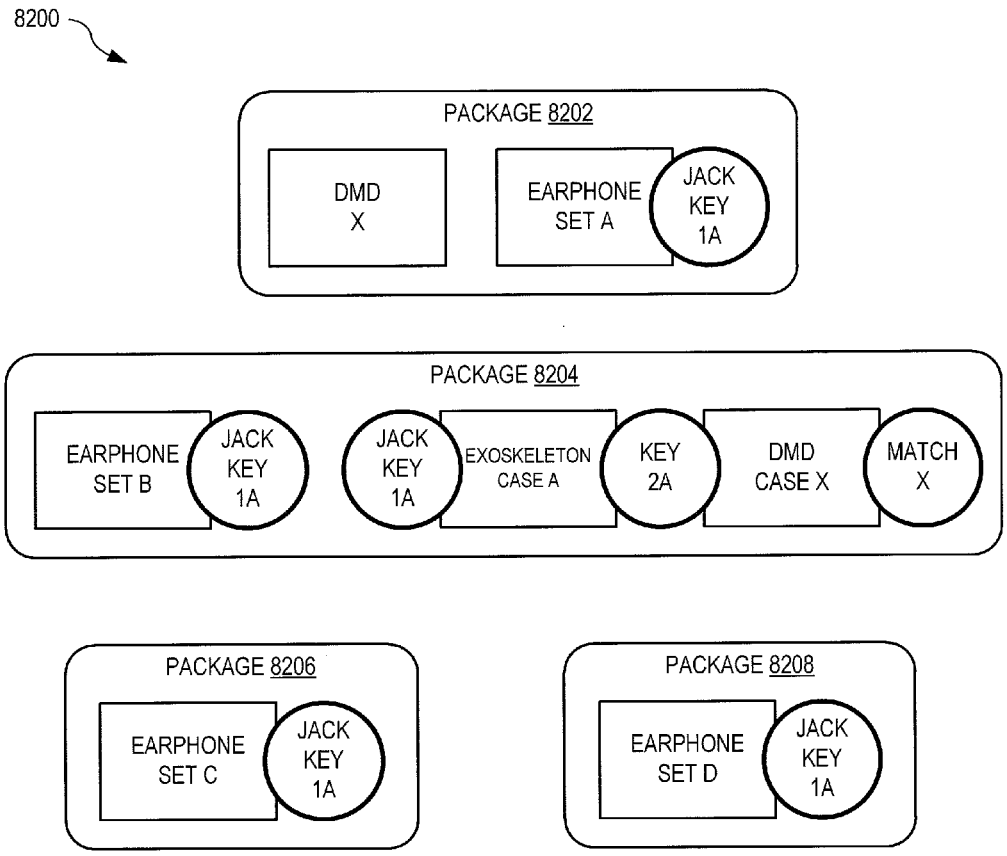
FIG. 82 shows one exemplary scenario where the DVD manufacturer sells a first package including a DMD X and an earphone set A, sells a second package including an earphone set B, an exoskeleton case A, and a DMD case X, sells a third package including an earphone set C, and sells a fourth package including an earphone set D, in an embodiment.

FIG. 82 shows one exemplary scenario 8200 with improved packaging, where the DVD manufacturer sells DMD X and earphone set A in a first package 8202, sells earphone set B, exoskeleton case A, and DMD case X in a second package 8204, sells earphone set C in a third package 8206, and sells earphone set D in a fourth package 8208.

As shown in FIGS. 78-81, the consumer is encouraged to purchase one or more of packages 8202, 8204, 8206, and 8208 based upon match X, and keys 1A and 2A to obtain optimal flexibility, storage, and protection of DMD X and one or more of earphone sets A, B, C and D, using exoskeleton case A and DMD case X. For example, by purchasing packages 8202 and 8204, the consumer obtains DMD case X to protect DMD X, and exoskeleton case A, that couples with DMD case X based upon key 2A, to provide storage of earphone set A proximate DMD X.

Keyed Protective Case for Wireless Earphone Set

Figure 83:
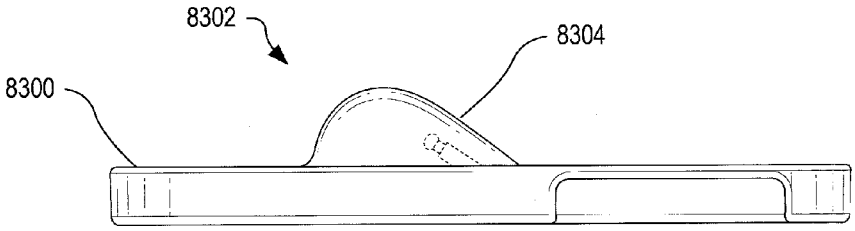
FIGS. 83-86 show one exemplary wireless earphone set storage case, without a wireless earphone set.
Figure 84:
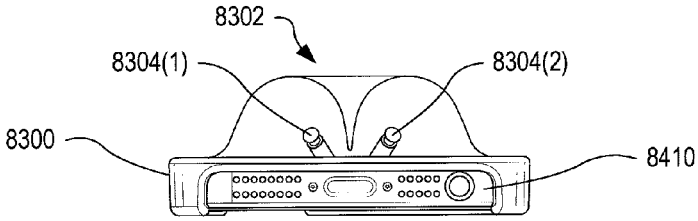
Figure 85:
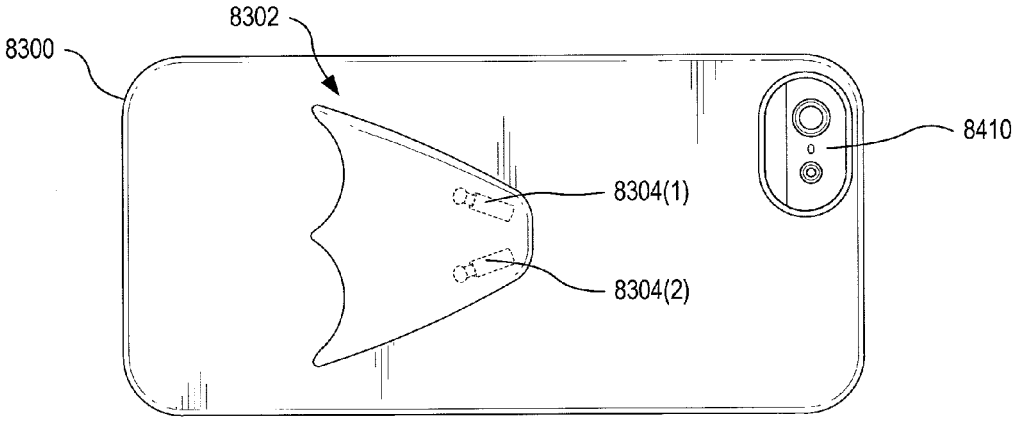
Figure 86:
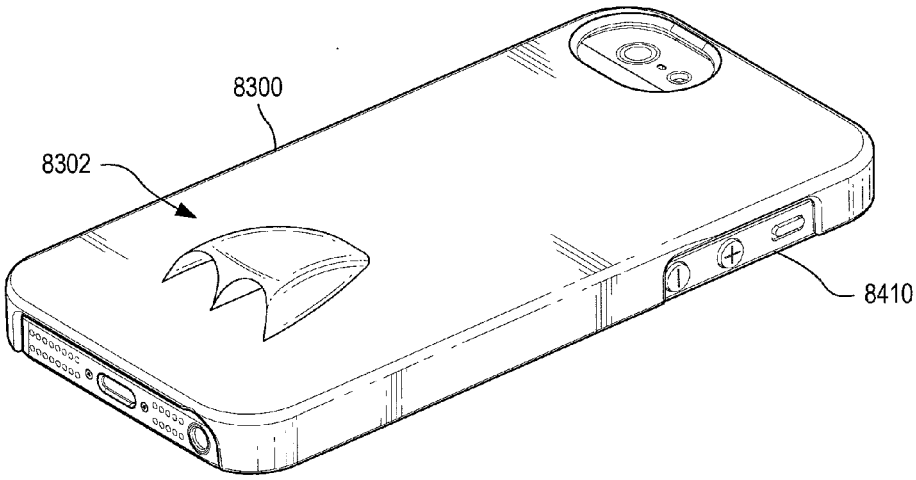
Figure 87:
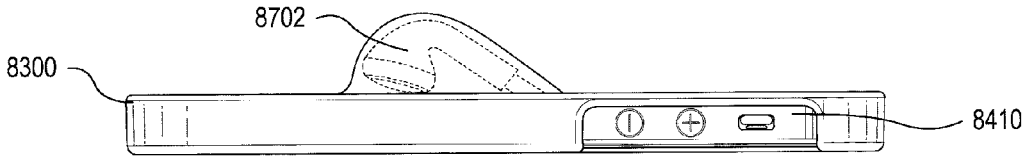
FIGS. 87-90 show the case of FIGS. 83-86 mounted on a DMD and storing a wireless earphone set, in an embodiment.
Figure 88:
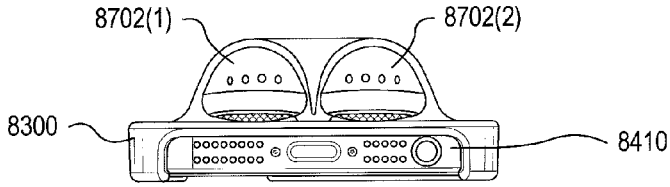

FIGS. 83-86 show one exemplary wireless earphone set storage case 8300, without a wireless earphone set. FIG. 83 is a side view of case 8300. FIG. 84 is an end view of case 8300 mounted on a DMD 8410 and without a wireless earphone set. FIG. 85 is a top view of case 8300 and FIG. 86 is a perspective view of case 8300 coupled to DMD 8410.

FIGS. 87-90 show case 8300 of FIGS. 83-86 mounted on DMD 8410 and storing a wireless earphone set 8702. Wireless earphone set 8702 may represent wireless earphone set 1800 of FIG. 18, for example.

Figure 89:
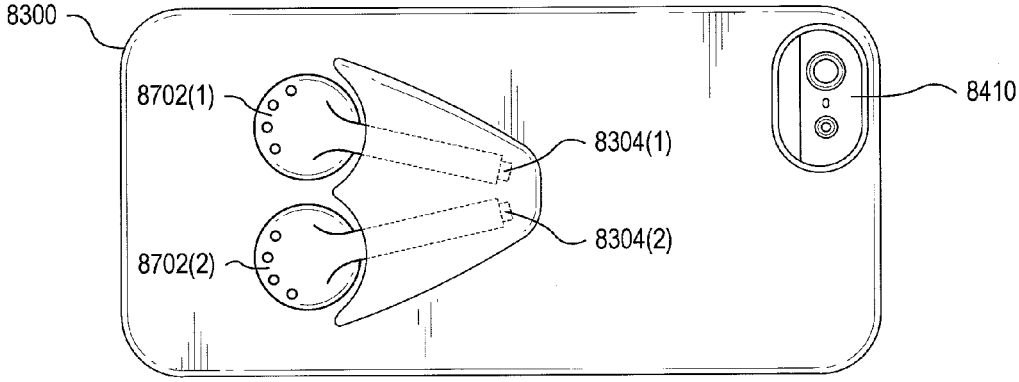

Case 8300 includes a raised portion 8302 shaped to receive and securely hold and protect earphone set 8702. Portion 8302 is contoured to have smooth curves such that case 8300 is comfortable to hold when coupled with a DMD during use. Within portion 8302, each of two power connectors 8304 connect with one wireless earphone set piece 8702. For example, as shown in FIG. 89, wireless earphone set piece 8702(1) is coupled with connector 8304(1) and wireless earphone set piece 8702(2) is coupled with connector 8304(2). Connectors 8304 provide power to charge each wireless earphone set piece 8702 when stored within case 8300. In an alternate embodiment, connectors 8304 do not provide power, but function to retain wireless earphone set 8702 within raised portion 8302.

Figure 90:
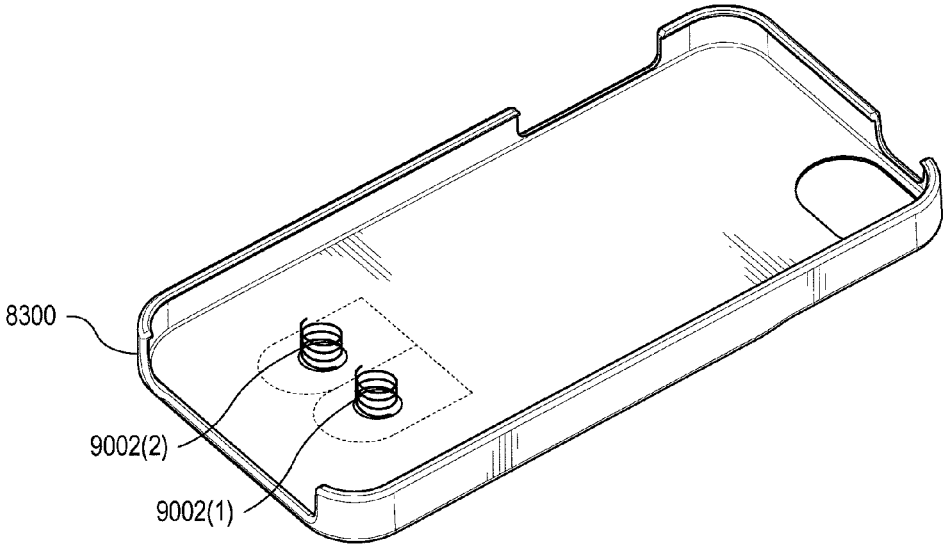

FIG. 90 is a perspective view of the underside of case 8300 illustrating exemplary contacts 9002(1) and (2) that electrically couple with DMD 8410 when case 8300 is mounted thereon. Specifically, contacts 9002 provide electrical power to connectors 8304 to simultaneously charge both wireless earphone set pieces 8702 when coupled with DMD 8410.

Figure 91:
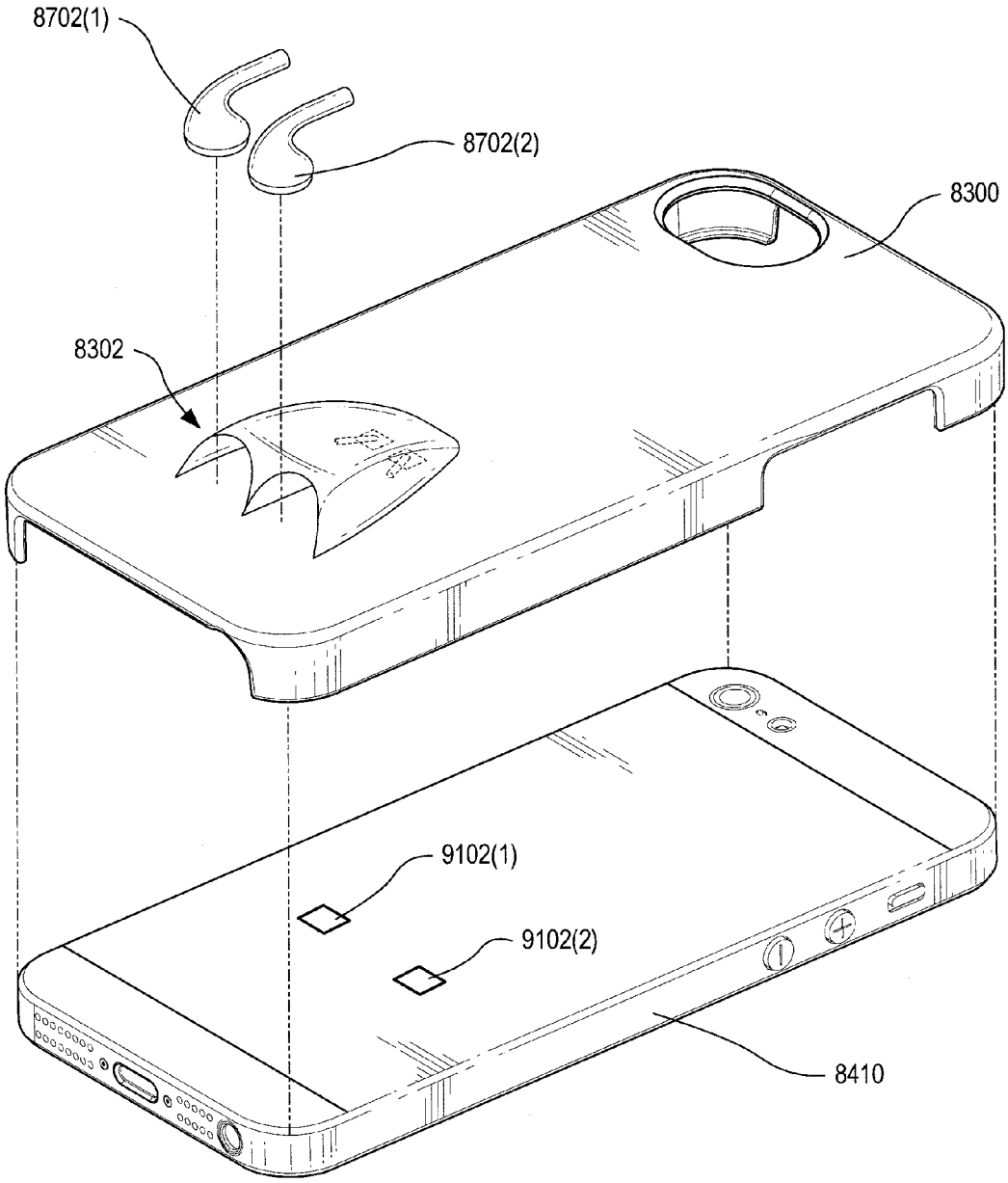
FIG. 91 is an exploded view showing the case, the wireless earphone set pieces, and the DMD of FIGS. 83-90.

FIG. 91 is an exploded view showing case 8300, wireless earphone set pieces 8702, and DMD 8410. In particular, DMD 8410 is shown with electrical contacts 9102(1) and (2) that electrically couple with contacts 9002(1) and (2), respectively, to provide power to case 8300 for charging wireless earphone set pieces 8702(1) and (2).

Figure 92:
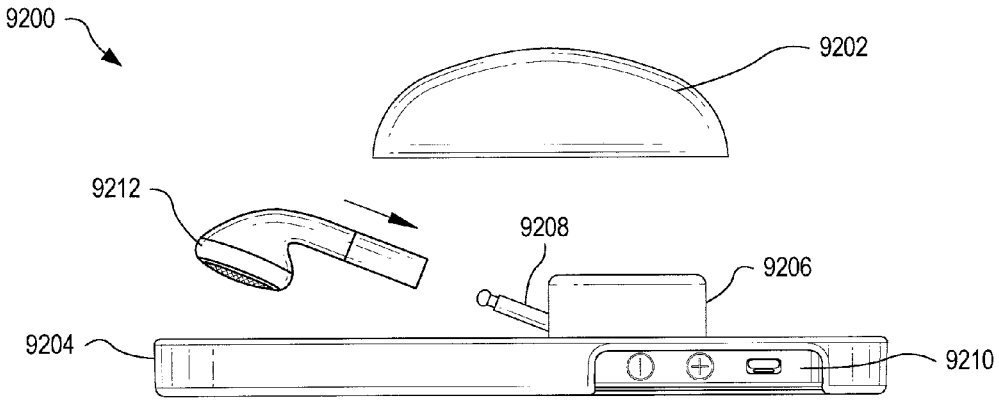
FIG. 92 shows one exemplary wireless earphone storing and charging case, in an embodiment.
Figure 93:
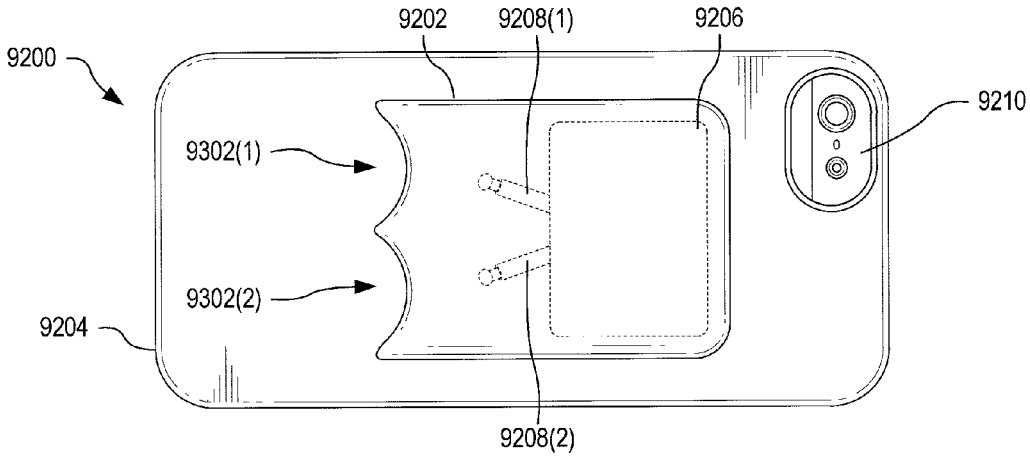
FIG. 93 is a top view of the case of FIG. 92.
Figure 94:
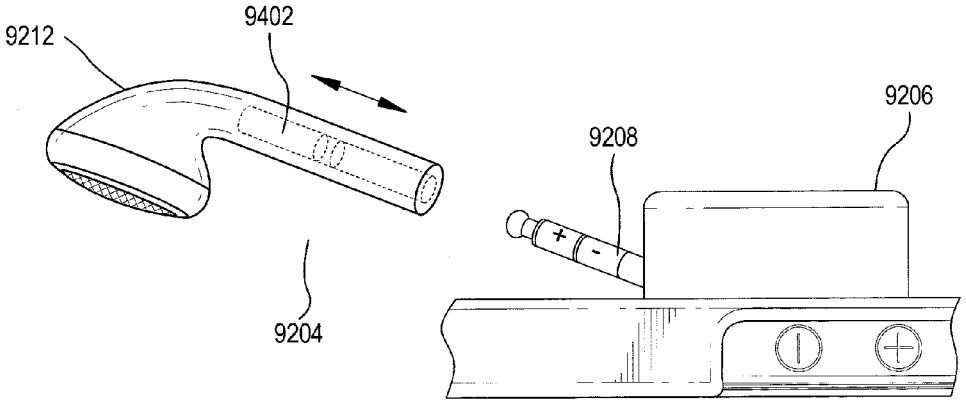
FIG. 94 shows exemplary coupling of a connector of the case of FIG. 92 to a wireless earphone set piece.
Figure 95:
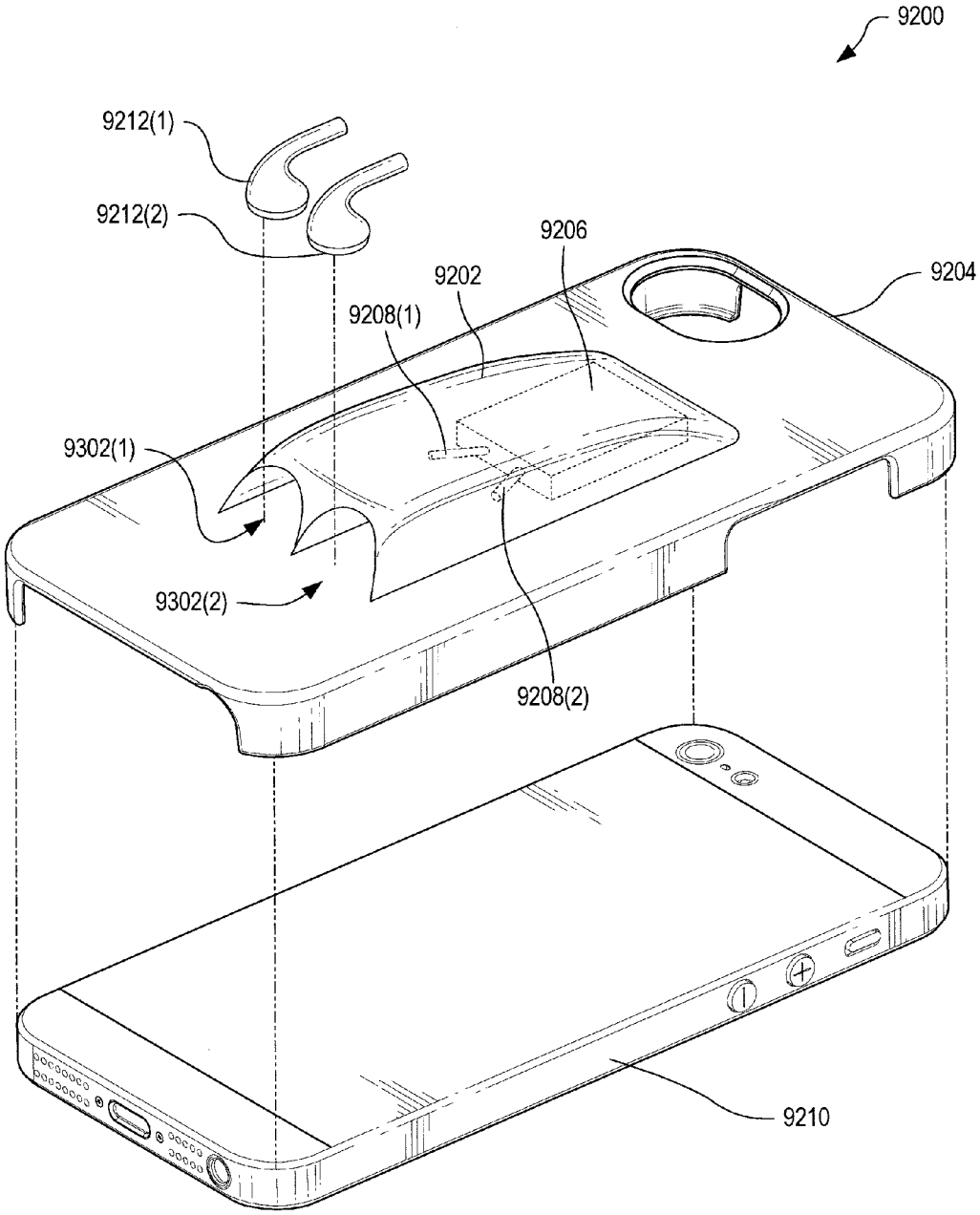
FIG. 95 is an exploded view showing exemplary coupling of the case of FIG. 92 with the DMD and coupling of wireless earphone set pieces with case, in an embodiment.

FIG. 92 shows one exemplary wireless earphone storing and charging case 9200. FIG. 93 is a top view of case 9200 of FIG. 92. FIG. 94 shows exemplary coupling of connector 9208 of case 9200 of FIG. 92 to wireless earphone set piece 9212. Earphone set pieces 9212 are similar to earphone set pieces 8702 of FIG. 87. FIG. 95 is an exploded view showing exemplary coupling of case 9200 with DMD 9210 and coupling of wireless earphone set pieces 9212 with case 9200. FIGS. 92, 93, 94, and 95 are best viewed together with the following description.

Case 9200 has a cover 9202, a base 9204, a battery 9206, and a pair of electrical connectors 9208. Base 9204 couples with a DMD 9210 to provide protection to the DMD and to facilitate storage and charging, proximate the DMD, of wireless earphone set pieces 9212 that electrically couple with, and are retained by, connectors 9208. Battery 9206 provides power to connectors 9208 to charge wireless earphone set pieces 9212. Cover 9202 covers connectors 9208 and battery 9206 and has openings to allow insertion and removal of wireless earphone set pieces 9212. Cover 9202 provides an ergonomic shape that facilitates handling and operating of DMD 9210 when coupled with case 9200. As shown in FIGS. 93 and 95, cover 9202 attaches to base 9204 and need not be removed when inserting and removing wireless earphone set pieces 9212. Cover 9202 may be removed to access battery 9206 if needed.

As shown in FIG. 94, connector 9208 has electrical contacts that couple with contacts within wireless earphone set piece 9212 to provide power from battery 9206 to charge a rechargeable battery 9402 within wireless earphone set piece 9212. Connector 9208 also operates to retain earphone set piece 9212 within case 9200. Connector 9208 may take other forms with more electrical connectors without departing from the scope hereof. In an alternate embodiment, wireless earphone set pieces 9212 are retained by the shape of cover 9202 that may also include an ejection button that ejects wireless earphone set pieces 9212 from case 9200 when depressed by the user.

Figure 96:
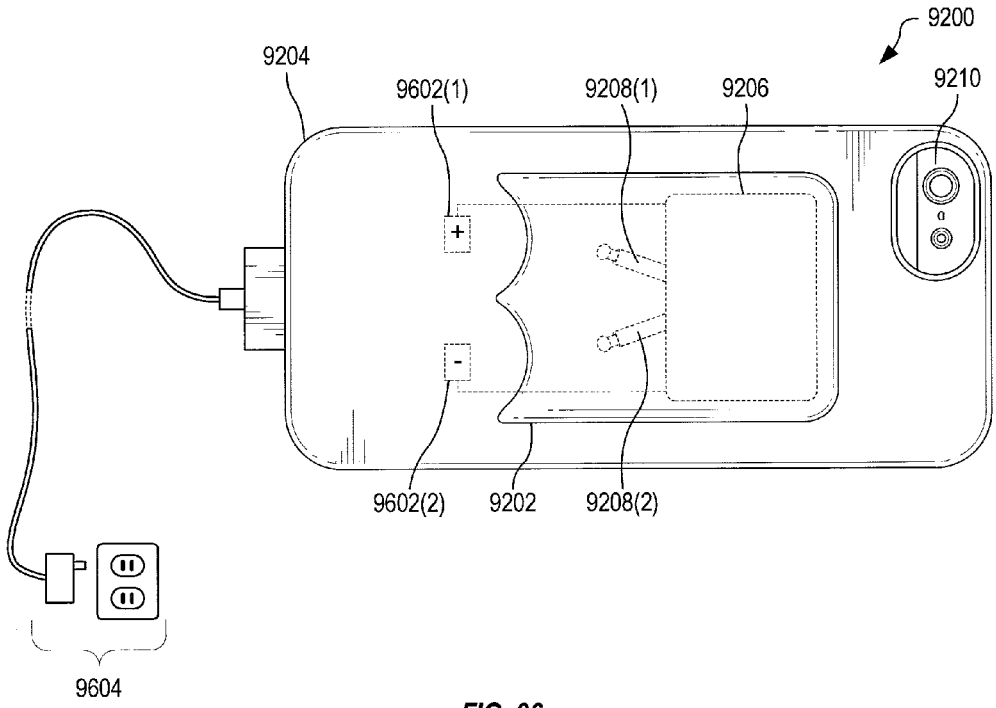
FIG. 96 shows the case of FIGS. 92-95 coupled with the DMD which is coupled to a power source.

FIG. 96 shows case 9200 of FIGS. 92-95 coupled with DMD 9210 where DMD 9210 is coupled to a power source 9604. Case 9200 has at least two electrical contacts 9602(1) and (2) that are similar to contacts 9002 of case 8300 of FIG. 90 for example. DMD 9210 includes electrical contacts, similar to contacts 9102 of DMD 8410 of FIG. 91 for example, that electrically couple with contacts 9602 of case 9200 such that power is transferred from power source 9604 to charge battery 9206 via DMD 9210. DMD 9210 transfers power from power source 9604, when connected thereto, to charge battery 9206 via contacts 9602. That is, battery 9206 charges when DMD 9210 is being charged.

Figure 97:
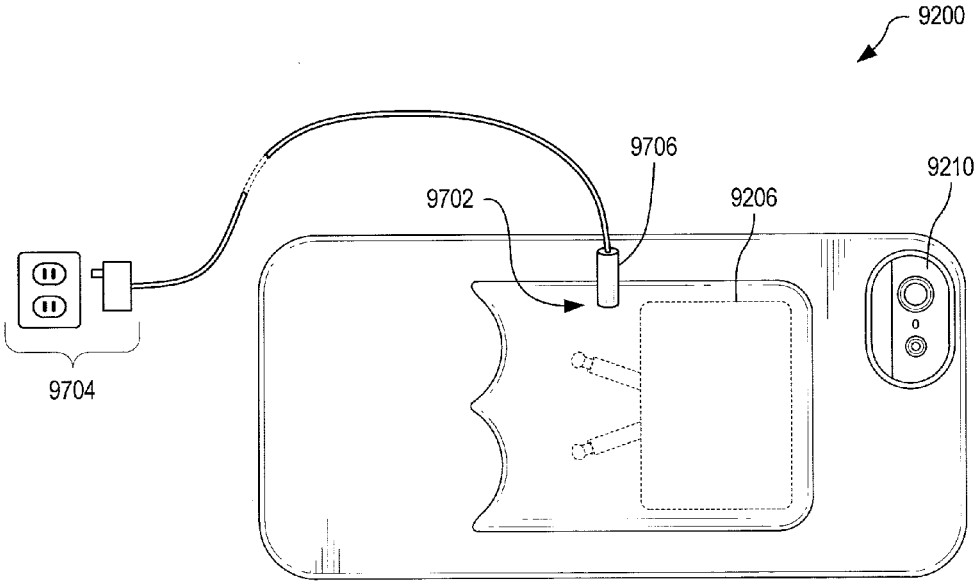
FIG. 97 shows an alternate configuration of the case of FIGS. 92-95 where a cover includes a charging port that electrically couples with a plug to charge the battery from a power source, in an embodiment.

FIG. 97 shows an alternate configuration of case 9200 where cover 9202 includes a charging port 9702 that electrically couples with a plug 9706 to charge battery 9206 from power source 9704. Case 9200 may include other methods of charging battery 9206 without departing from the scope hereof. For example, case 9200 may include a magnetic coupling element that receives power magnetically from one or both of DMD 9210 and power source 9704.

Figure 98:
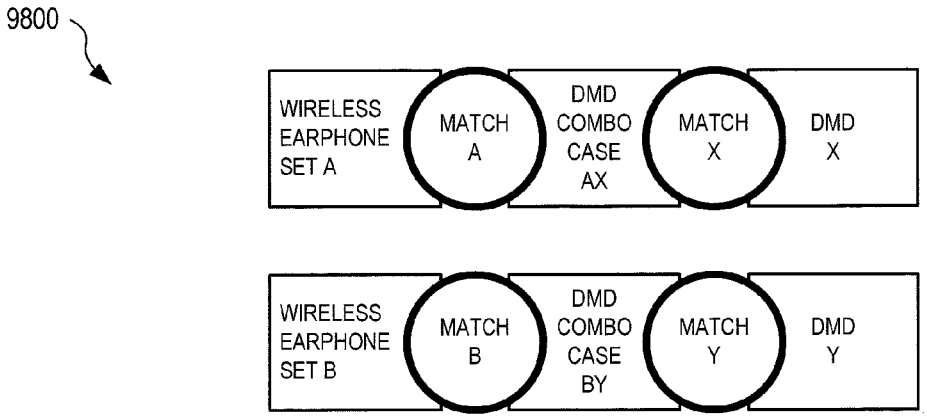
FIG. 98 shows one exemplary scenario where a first manufacturer sells a DMD X, a wireless earphone set A, and a DMD combo case, in an embodiment.

FIG. 98 shows one exemplary scenario 9800 where a first manufacturer sells DMD X accompanied by an earphone set A. The first manufacturer also sells a wireless earphone set and a DMD combo case AX, which is configured to protect DMD X and to capture, protect, and charge the wireless earphone set A. DMD combo case AX is matched (keyed) to DMD X, and is also matched to wireless earphone set A.

In the example of FIG. 98, a second manufacturer sells a DMD Y accompanied by a wireless earphone set B. The second manufacturer also sells a DMD combo case BY, which is configured to protect DMD Y and to capture, protect, and charge the wireless earphone set B. DMD combo case BY is matched (keyed) to DMD Y, and is also matched to wireless earphone set B.

In scenario 9800, the first manufacturer thus defines a relationship (A, X) between wireless earphone set A, DMD combo case AX, and DMD X. The second manufacturer thus defines a relationship (B, Y) between wireless earphone set B, DMD combo case BY, and DMD Y.

Figure 99:
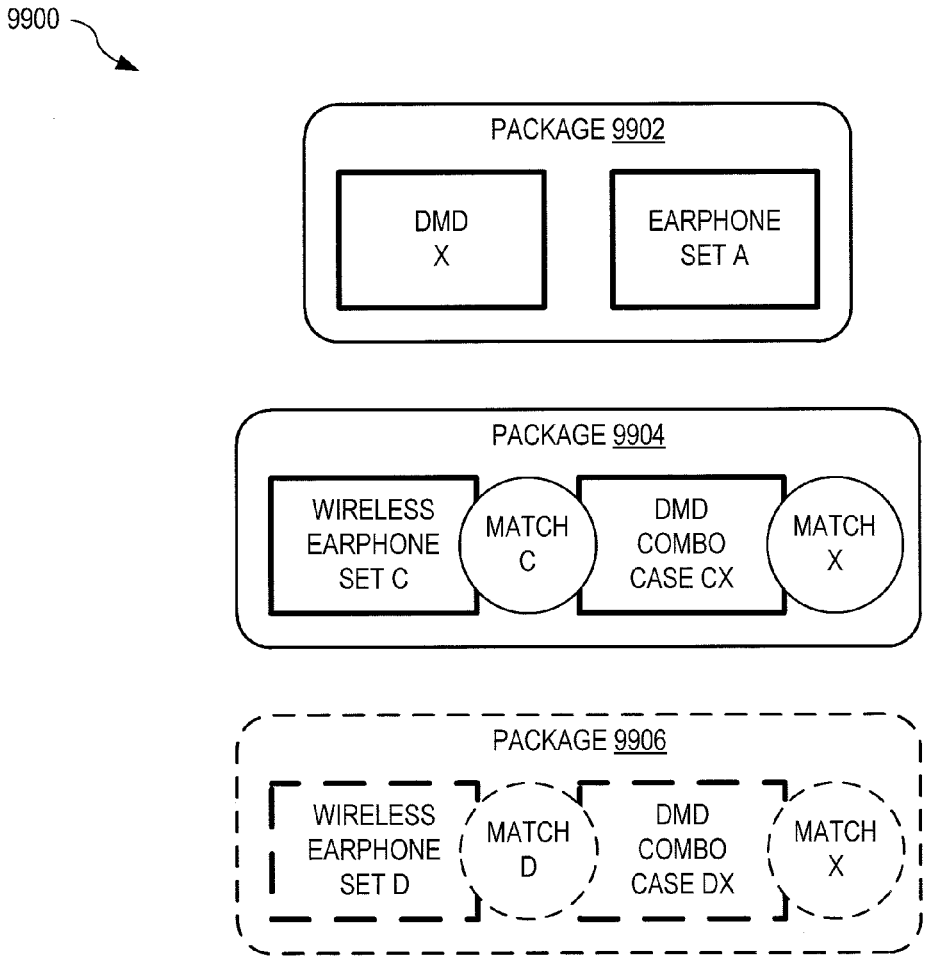
FIG. 99 shows one exemplary scenario where the DVD manufacturer sells a first package including a DMD X and an earphone set A, sells a second package including a wireless earphone set C and a DMD combo case CX, and optionally sells a third package including a wireless earphone set D, in an embodiment.

FIG. 99 shows one exemplary scenario 9900 with improved packaging, where the DVD manufacturer sells DMD X and earphone set A in a first package 9902, sells wireless earphone set C and DMD combo case CX in a second package 9904, and optionally sells wireless earphone set D in a third package 9906.

As shown in FIG. 98, the consumer is encouraged to purchase one or more of packages 9902, 9904, and 9906 based upon matches A, B, X, and Y to obtain optimal flexibility, storage, and protection of the DMD wireless earphone set. For example, by purchasing packages 9902 and 9904, the consumer obtains DMD combo case CX to protect DMD X, which also protects, charges, and stores, wireless earphone set C proximate DMD X.

Alternative Embodiments

Figure 100:
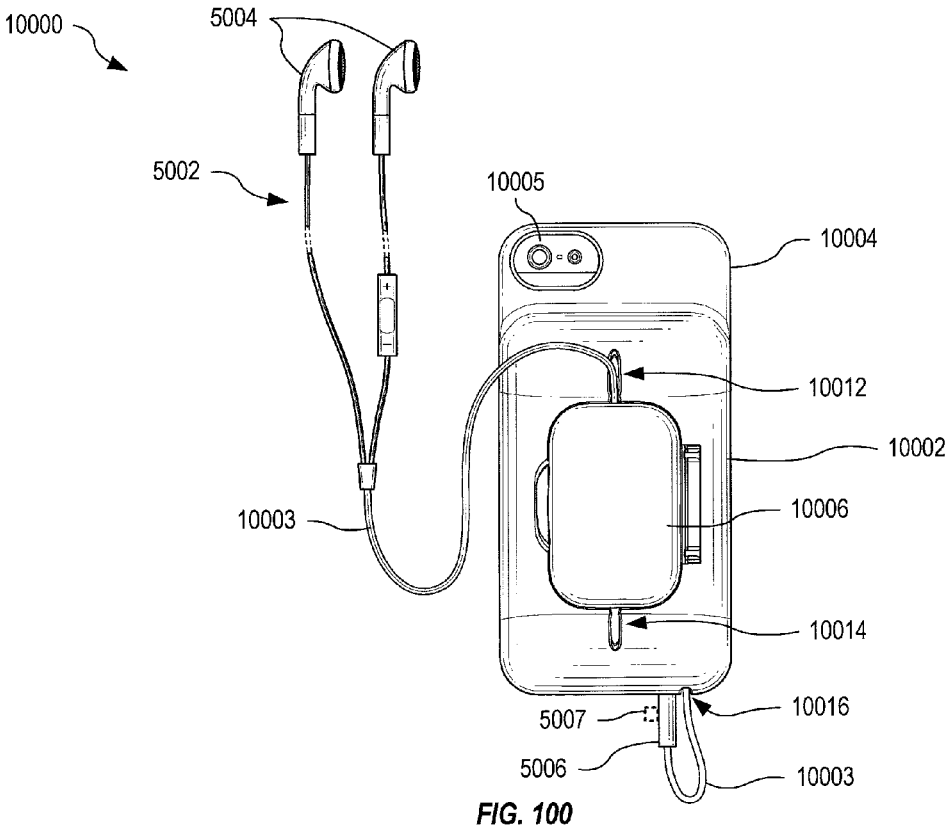
FIGS. 100-102 show one exemplary slotted exoskeleton case formed with a domed earphone storage portion and a base portion that couples with and protects a DMD, in an embodiment.
Figure 101:
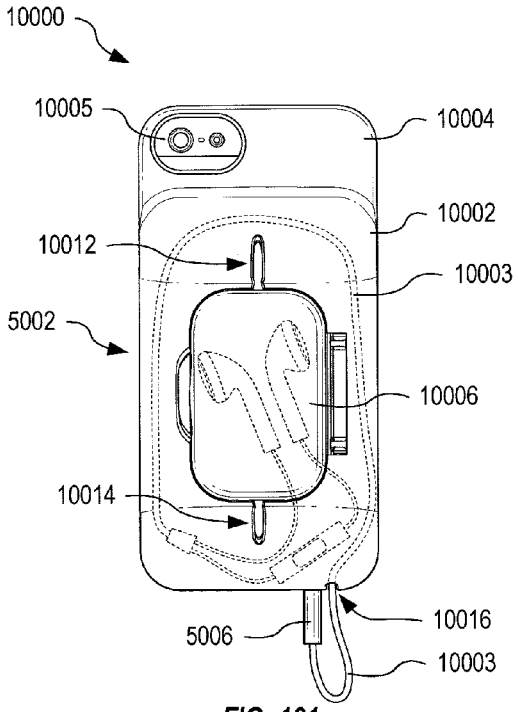
Figure 102:
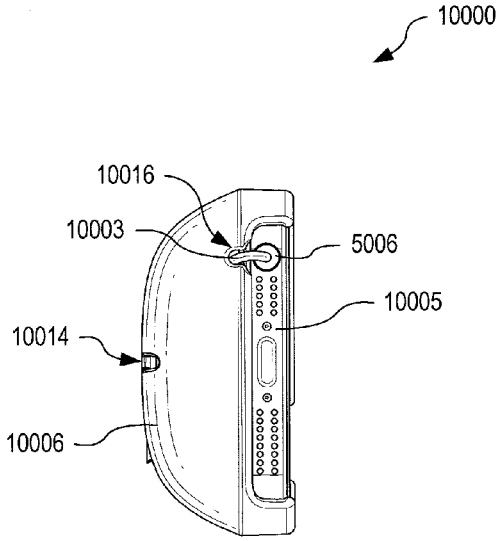

FIGS. 100-102 show one exemplary slotted exoskeleton case 10000 that is similar to the exoskeleton case 5300 of FIGS. 53-67 and is formed with a domed earphone storage portion 10002 and a base portion 10004 that couples with and protects a DMD 10005. Domed earphone storage portion 10002 has a lid 10006 for inserting or removing earphone set 5002 and has slots 10012, 10014, and 10016 that may accommodate wires and/or cable 10003 of earphone set 5002 such that lid 10006 may close while cable 10003 passes from inside to outside of portion 10002.

As shown in FIG. 100, jack 5006 is coupled with DMD 10005 and cable 10003 passes from outside to inside of portion 10002 via slot 10016. In particular, cable 10003 is captured between DMD 10005 and case 10002 when case 10000 is mounted onto DMD 10005. As shown in FIG. 101, this allows storage of cable 10003, earpieces 5004 and other components of earphone set 5002 within case 10000 while jack 5006 is still connected to DMD 10005. Further, as shown in FIG. 100, earpieces 5004 and cable 10003 may be extracted from case 10000 when lid 10006 is opened, and then lid 10006 may be closed when cable 10003 is positioned within one of slots 10012 and 10014. For example, excess cable 10003 of earphone set 5002 may be stored within case 10000 to prevent tangling during use.

Optionally, jack 5006 includes a switch 5007 that disables earphone set 5002 while still plugged into DMD 10005 to allow DMD 10005 to be used without earphone set 5002 without the need to unplug jack 5006. In one embodiment, case 10000 includes a mechanism (not shown) that automatically extracts jack 5006, at least partially, from DMD 10005 to allow use of DMD 10005 without earphone set 5002 and while still retaining jack 5006.

Figure 103:
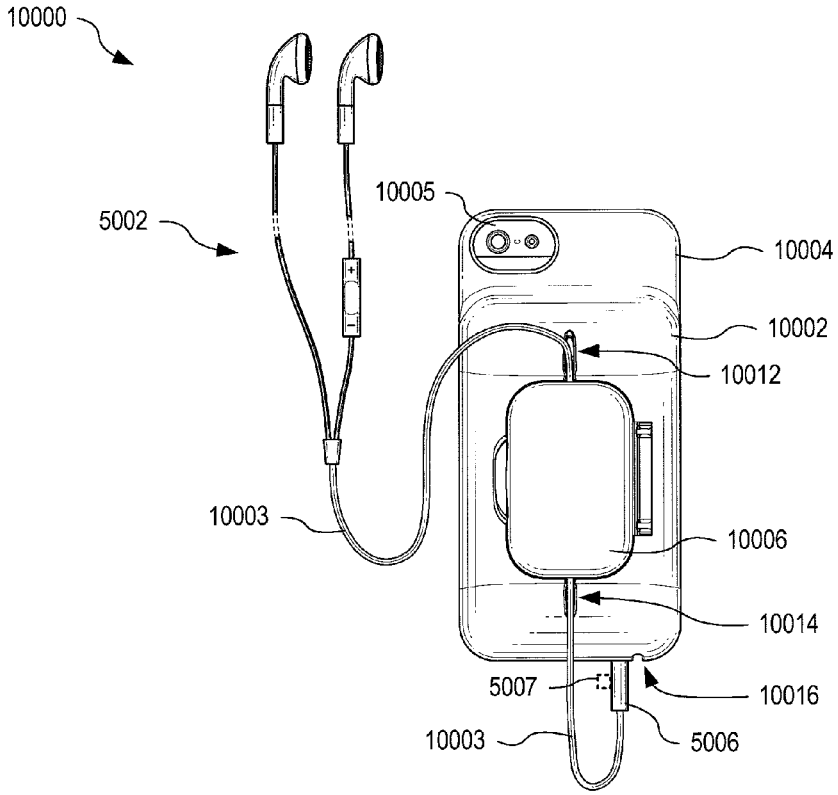
FIG. 103-105 show another exemplary use of the slotted exoskeleton case of FIGS. 100-102 to store excess cable of an earphone set during use.
Figure 104:
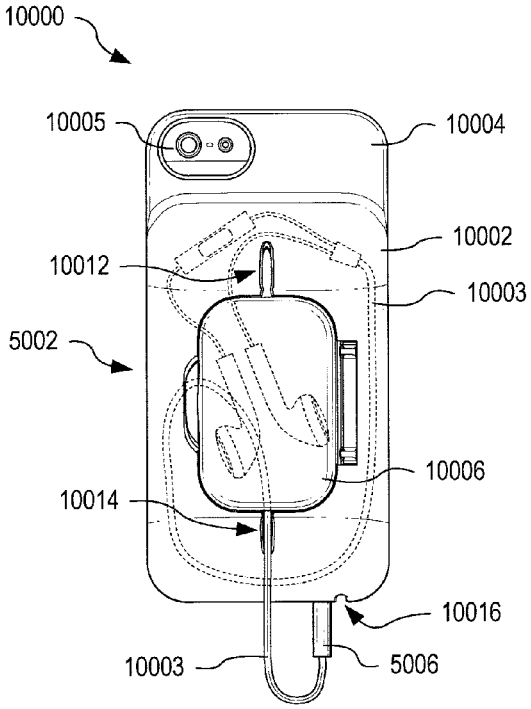
Figure 105:
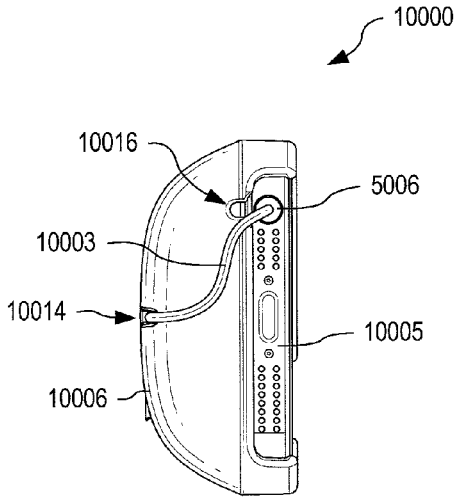
Figure 106:
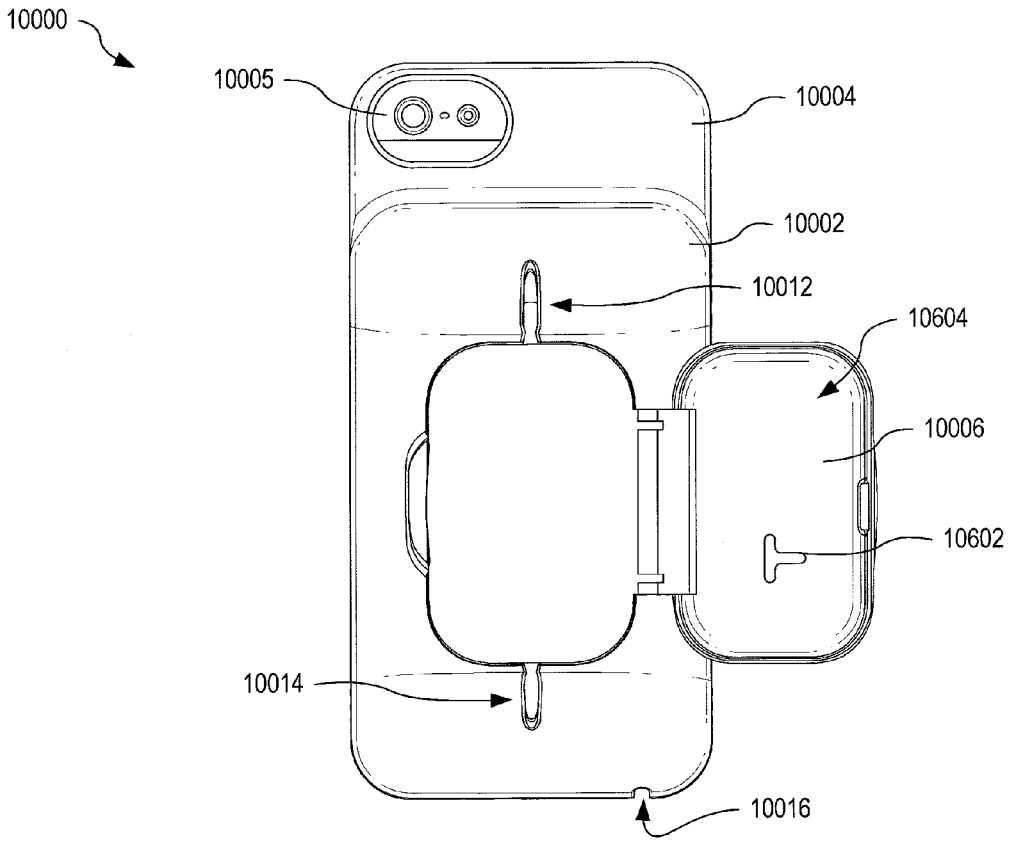
FIGS. 106-109 show one exemplary hook formed on an internal surface of lid of the slotted exoskeleton case of FIGS. 100-105 for capturing cables of an earphone set, in an embodiment.
Figure 107:
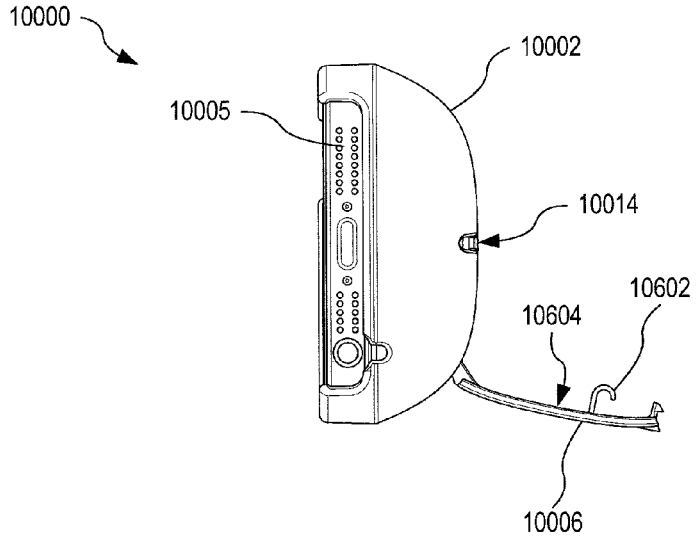
Figure 108:
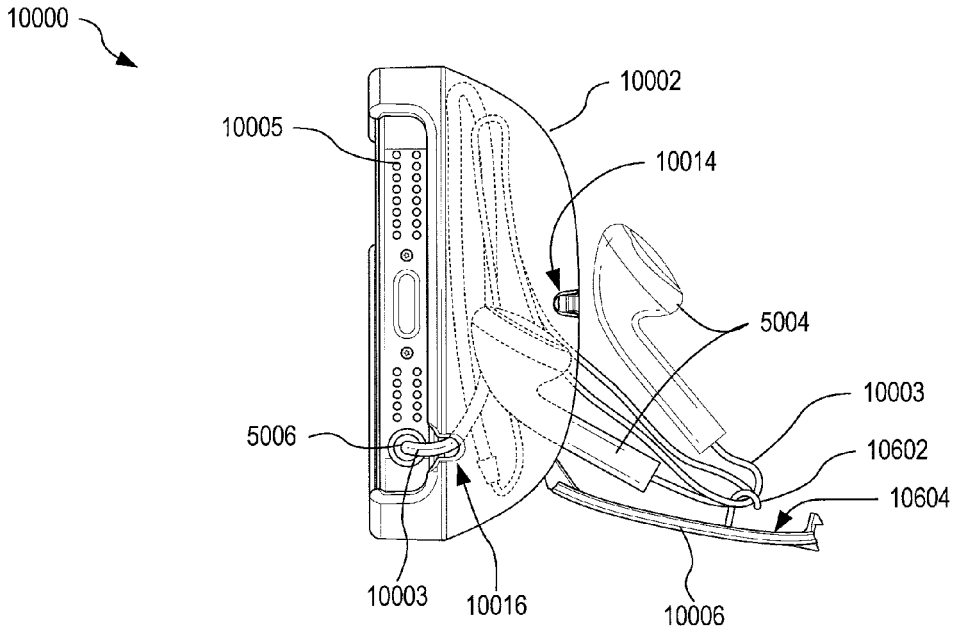
Figure 109:
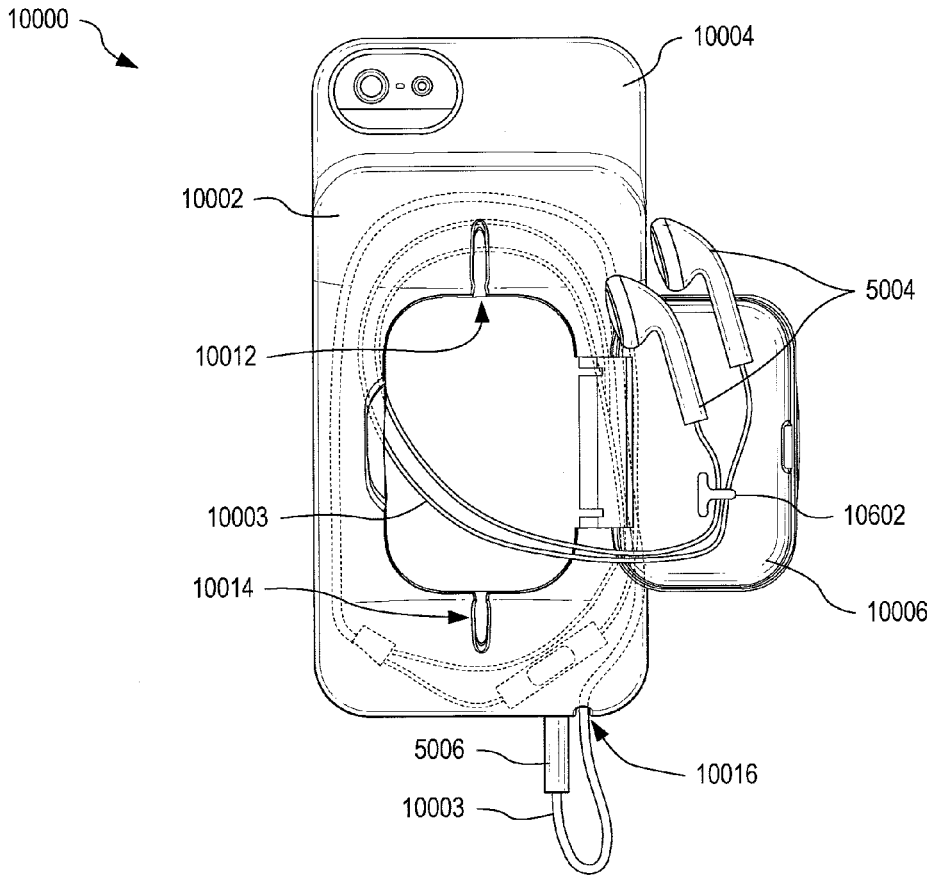

FIG. 103-105 show another exemplary use of slotted exoskeleton case 10000 to store excess cable of earphone set 5002 during use, wherein jack 5006 is plugged into DMD 10005 and cable 10003 passes through slot 10014 into case 10000. Cable 10003 then passes out of slot 10012 allowing use of earphone set 5002 while excess cable is stored within case 10000.

As shown in FIG. 104, earphone set 5002 may be stored within case 10000 while jack 5006 remains connected to DMD 10005. In this configuration, case 10000 need not be removed from DMD 10005 to separate earphone set 5002 from DMD 10005 and case 10000 since earphone set 5002 is not captured between case 10000 and DMD 10005.

FIGS. 106-109 show one exemplary hook 10602 formed on an internal surface 10604 of lid 10006 of slotted exoskeleton case 10000 for capturing cables 10003 of earphone set 5002. Hook 10602 may be used to capture cable 10003 proximate earpieces 5004 of earphone set 5002 to facilitate retrieval and use of earphone set 5002 from within case 10000.

Figure 110:
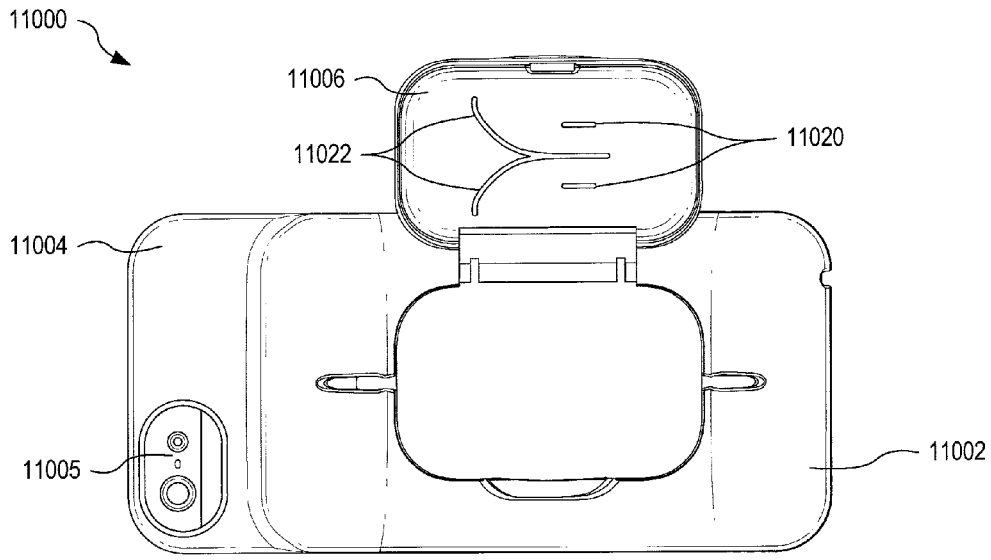
FIGS. 110-112 show one exemplary slotted exoskeleton case that is similar to the exoskeleton case of FIGS. 100-109 and is formed with a domed earphone storage portion and a base portion that couples with and protects a DMD, in an embodiment.
Figure 111:
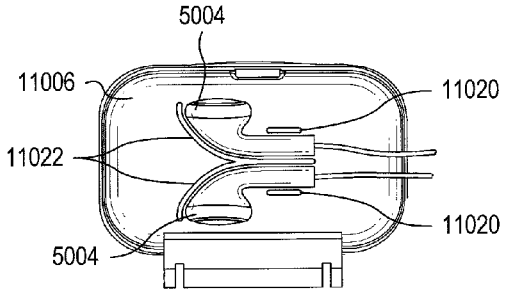
Figure 112:
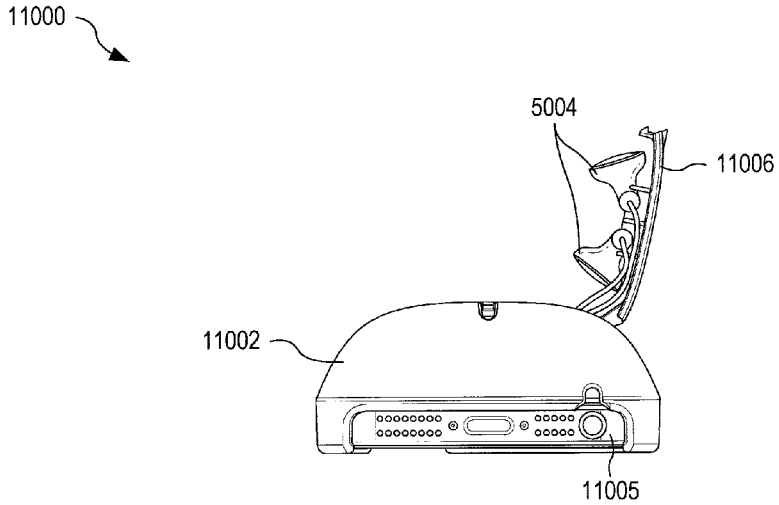

FIGS. 110-112 show one exemplary slotted exoskeleton case 11000 that is similar to the exoskeleton case 10000 of FIGS. 100-109 and is formed with a domed earphone storage portion 11002 and a base portion 11004 that couples with and protects a DMD 11005. Domed earphone storage portion 11002 has a lid 11006 for inserting or removing earphone set 5002, for example. Lid 11006 is configured with clasps 11020 and ridges 11022 that cooperate to captures earpieces 5004 of earphone set 5002 for storage within case 11000.

Figure 113:
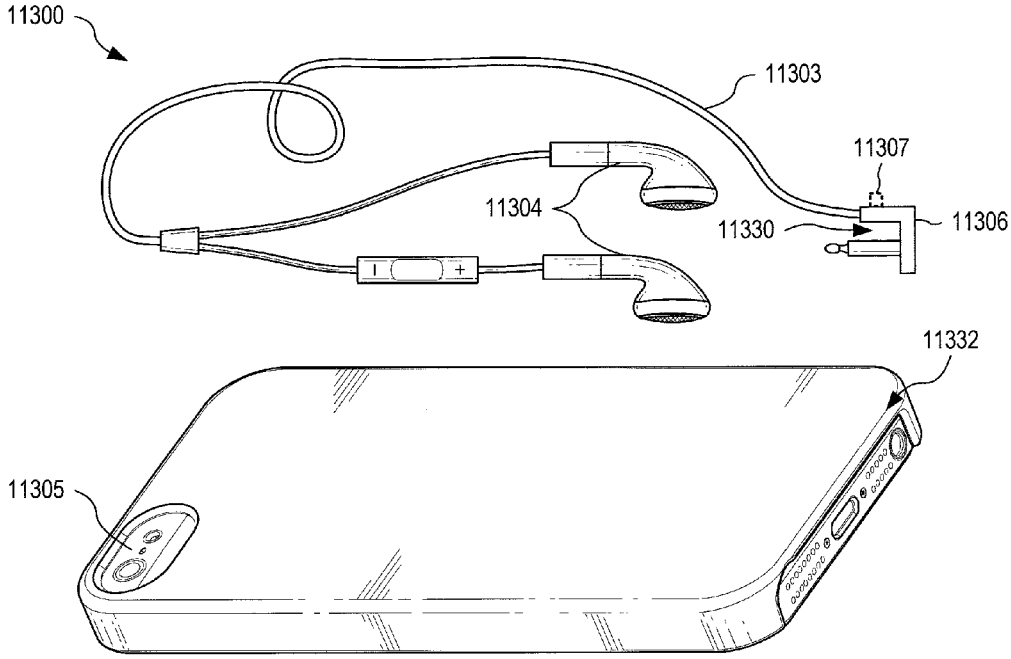
FIG. 113 shows one exemplary earphone set with earpieces and a jack that is configured in a fixed "U" shape such that an interior surface of the jack matches the shape and size of an exterior surface of a DMD, in an embodiment.

FIG. 113 shows one exemplary earphone set 11300 with earpieces 11304 and a jack 11306 that is configured in a fixed "U" shape such that an interior surface 11330 of jack 11306 matches the shape and size of an exterior surface 11332 of a DMD 11305. Specifically, interior surface 11330 forms a close fit with exterior surface 11332 when jack plug 11306 is coupled with DMD 11305. In the example of FIG. 113, exterior surface 11332 of DMD 11305 is angular.

Optionally, jack 11306 includes a switch 11307 that disables earphone set 11300 while still plugged into DMD 11305 to allow DMD 11305 to be used without earphone set 11300 without the need to unplug jack 11306.

Figure 114:
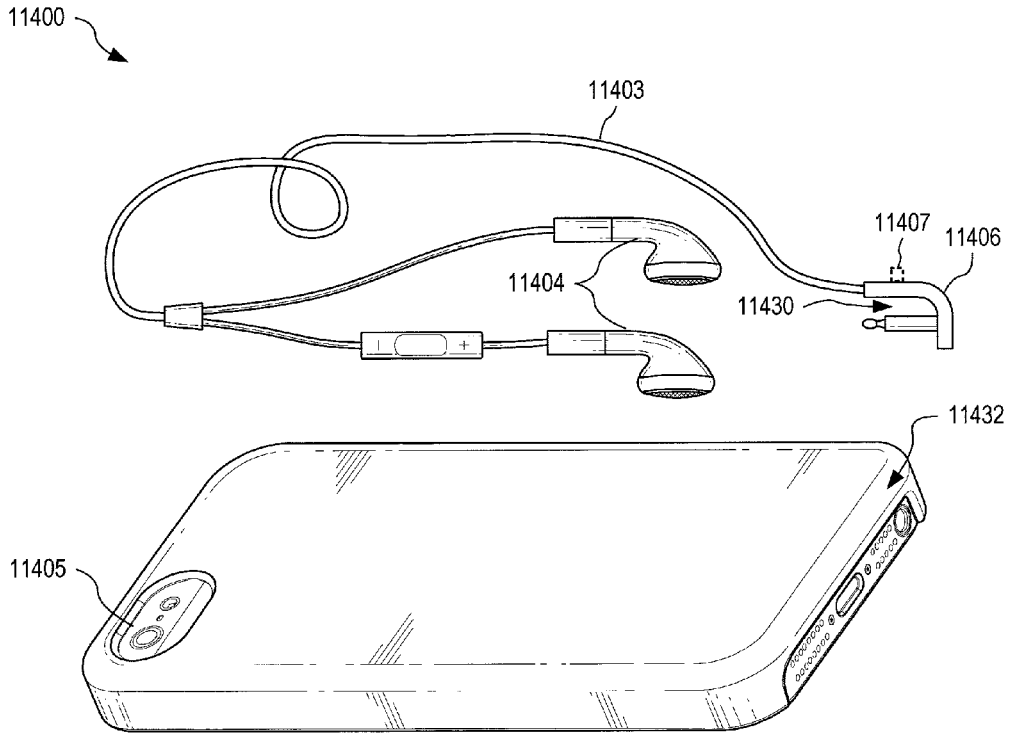
FIG. 114 shows one exemplary earphone set with earpieces and a jack that is configured in a fixed "U" shape such that an interior surface of the jack matches the shape and size of a more rounded exterior surface of a DMD, in an embodiment.

FIG. 114 shows one exemplary earphone set 11400 with earpieces 11404 and a jack 11406 that is configured in a fixed "U" shape such that an interior surface 11430 of jack 11406 matches the shape and size of an exterior surface 11432 of a DMD 11405. Specifically, interior surface 11430 forms a close fit with exterior surface 11432 when jack 11406 is coupled with DMD 11405. In the example of FIG. 114, exterior surface 11432 of DMD 11405 is rounded.

Optionally, jack 11406 includes a switch 11407 that disables earphone set 11400 while still plugged into DMD 11405 to allow DMD 11405 to be used without earphone set 11400 and without the need to unplug jack 11406 from DMD 11405.

Figure 115:
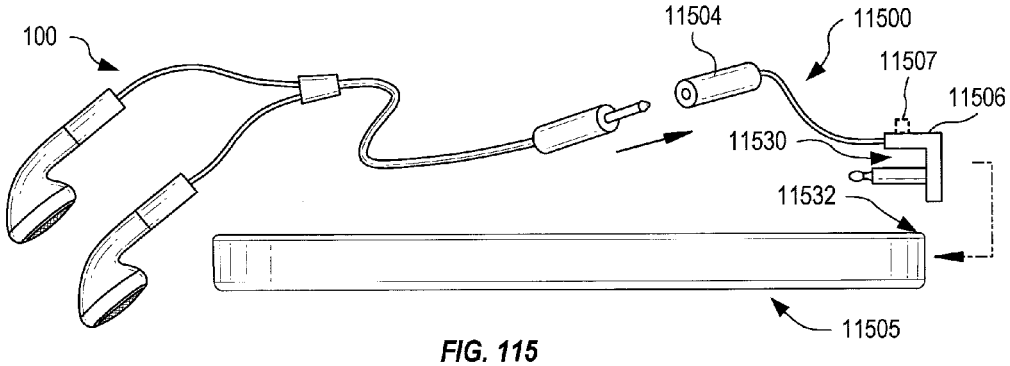
FIGS. 115-118 show one exemplary earphone extension cord that has a jack socket and a shaped jack plug that couples with a DMD, in an embodiment.
Figure 116:
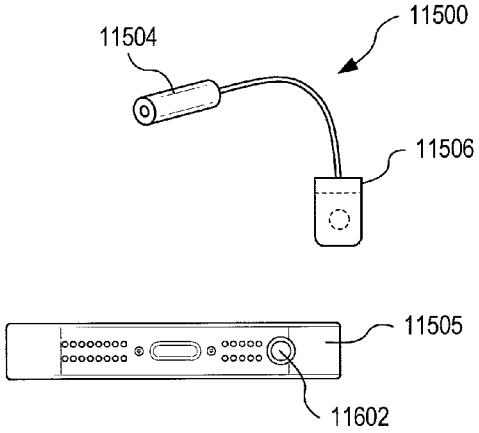
Figure 118:
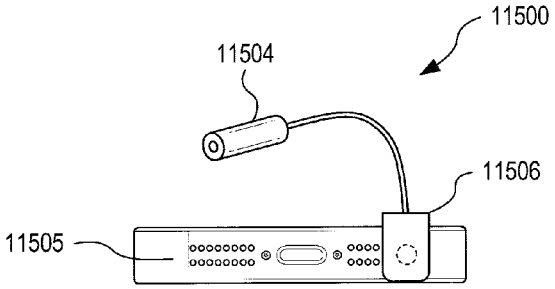
Figure 117:
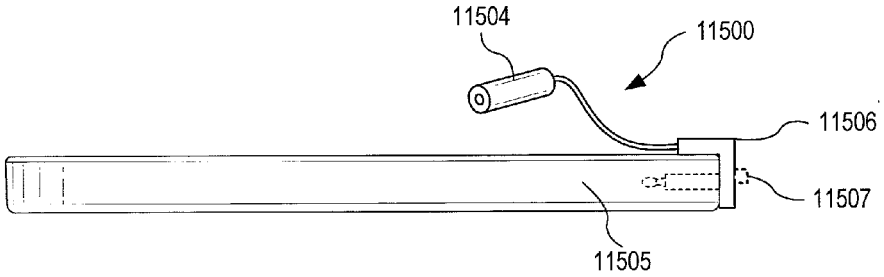

FIGS. 115-118 show one exemplary earphone extension cord 11500 that has a jack socket 11504 and a shaped jack plug 11506 that couples with a DMD 11505. Jack socket 11504 couples with jack plug 102 of earphone set 100 of FIG. 1 thereby configuring earphone set 5002 with a shaped jack plug 11506 for coupling with DMD 11505. Thus, by adding earphone extension cord 11500 to a prior art earphone set (e.g., earphone set 100), that earphone set may benefit from a less obtrusive coupling with DMD 11505. FIG. 115 is an end view of DMD 11505 prior to coupling with extension cord 11500 illustrating exemplary position of jack socket 11602 on DMD 11505. FIGS. 117 and 118 show a side view and an end view, respectively, of coupling between jack 11506 and socket 11606 of DMD 11505.

Optionally, jack 11506 includes a switch 11507 that disables earphone extension cord 11500 while still plugged into DMD 11505 to allow DMD 11505 to be used without earphone set 100 without the need to unplug jack 11506. Switch 11507 may be positioned elsewhere on jack 11506 without departing from the scope hereof.

Figure 119:
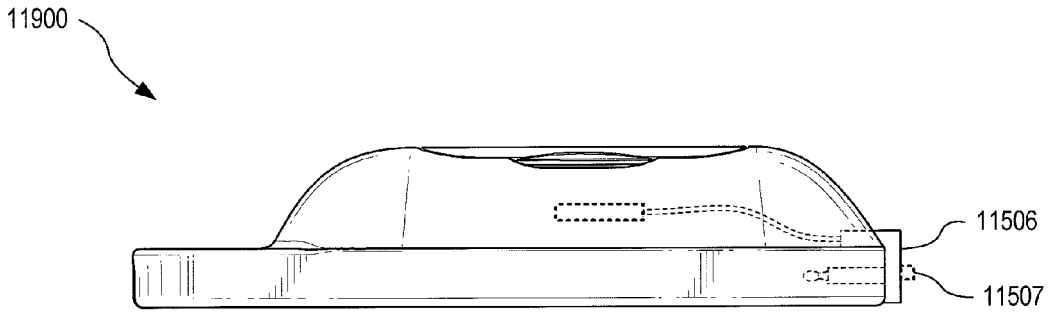
FIGS. 119 and 120 shows one exemplary DMD combo case coupled with the DMD of FIGS. 115-118 and configured to accommodate the extension cord coupled with the DMD.
Figure 120:
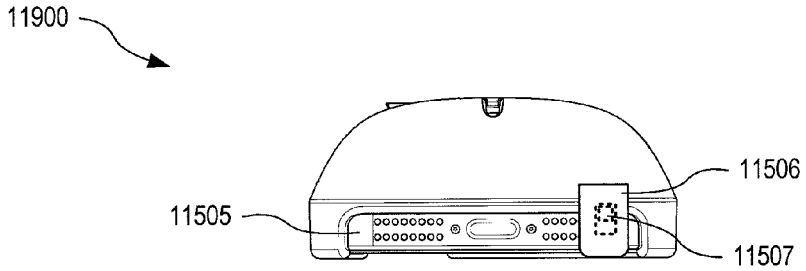

FIGS. 119 and 120 shows one exemplary DMD combo case 11900 coupled with DMD 11505 and configured to accommodate extension cord 11500 coupled with DMD 11505. Case 11900 may represent cases 700, 2000, 2900, 3000, 5300, 7200, and 7600 of FIGS. 7, 20, 29, 30, 53, 72, and 76, respectively. Extension cord 11500 provides a more compact and less damage prone connection between an earphone set (e.g., earphone set 100) and DMD 11505 when used together since jack 11506 is less likely to catch on other items during use of DMD 11505.

Figure 121:
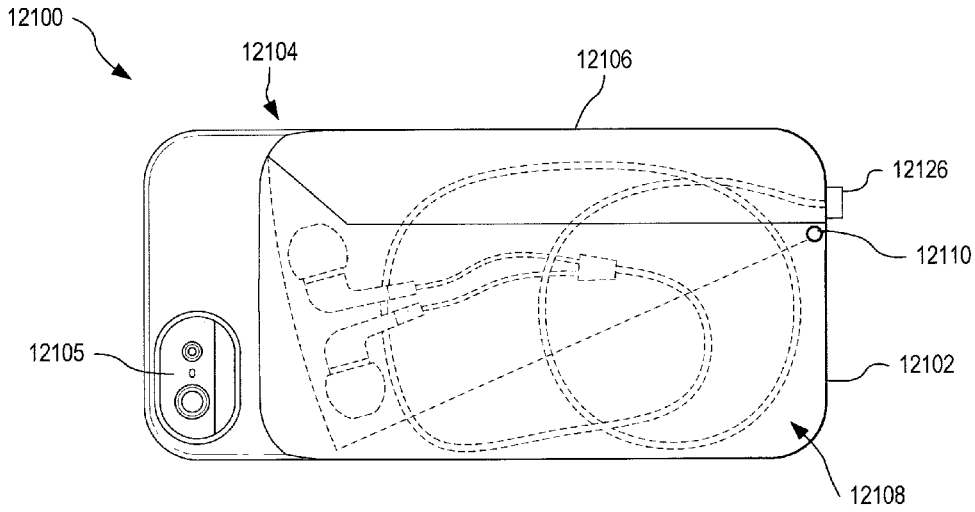
FIGS. 121 and 122 shows one exemplary exoskeleton combo case that is similar to the case of FIG. 53 except that the opening and the lid of case are omitted and dome is configured with a side opening and a hinged tray that allows access to a storage area of the case, in an embodiment.
Figure 122:
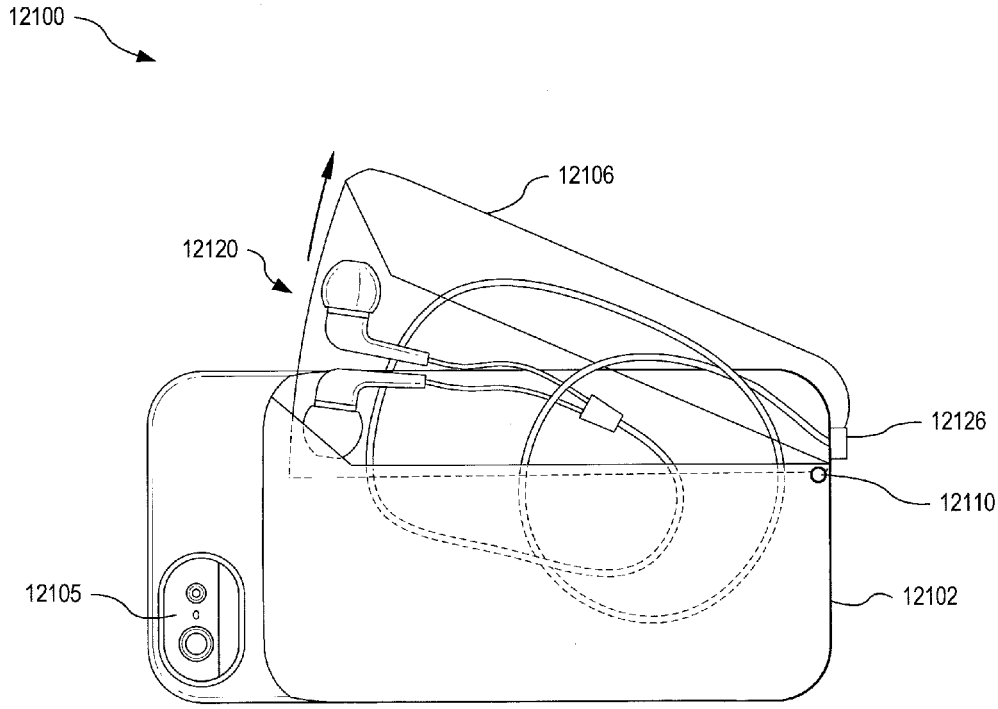

FIGS. 121 and 122 shows one exemplary exoskeleton combo case 12100 that is similar to case 5300 of FIG. 53 except that opening 5309 and lid 5306 of case 5300 are omitted and dome 12102, which is a similar shape and size to dome 5302, is configured with a side opening 12104 and a hinged tray 12106 that allows access to storage area 12108 of case 12100. A hinge 12110 allows tray 12106 to pivot out, as shown in FIG. 122, such that an earphone set 12120 (e.g., one of earphone sets 100, 200, 5002, 11300, and 11400 of FIGS. 1, 2, 50, 113, and 114, respectively) may be easily inserted and removed from storage area 12108. As shown in FIGS. 121, 122, a jack 12126 of earphone set 12120 is coupled with DMD 12105 such that the cable passing into storage area 12108.

Figure 123:
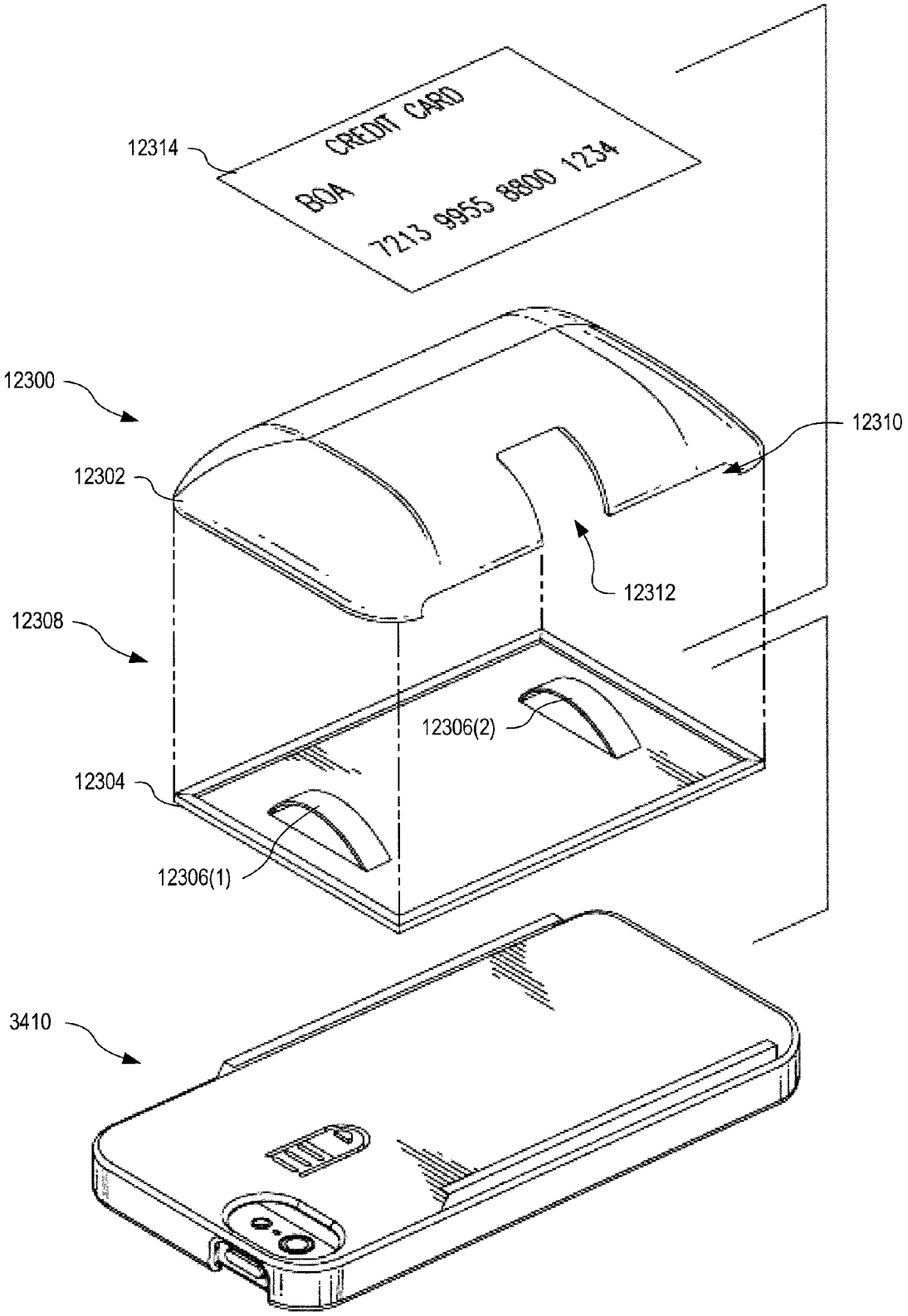
FIG. 123 is an exploded view showing one exemplary credit card case that couples with the DMD case of FIG. 34, in an embodiment.
Figure 124:
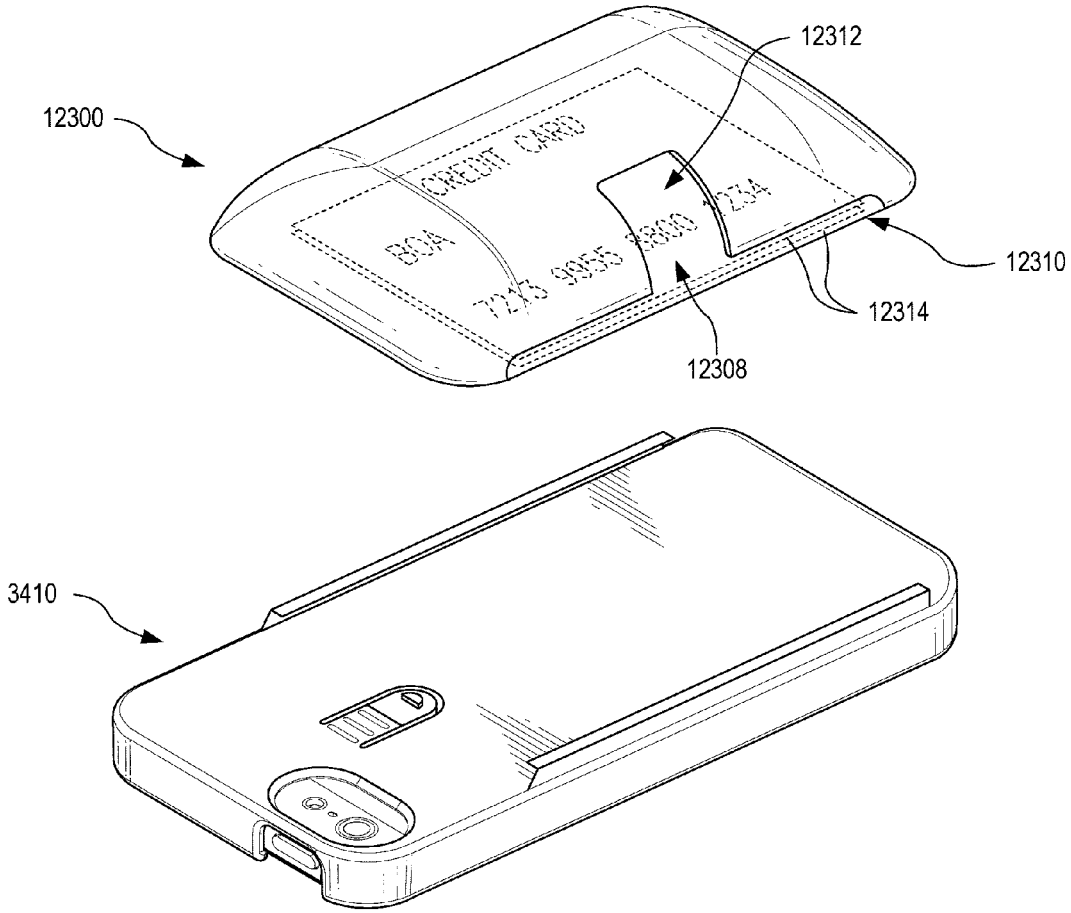
FIG. 124 shows the case of FIG. 123 storing two credit cards and detached from the DMD case of FIG. 34.

FIG. 123 is an exploded view showing one exemplary credit card case 12300 that couples with DMD case 3410 of FIG. 34. FIG. 124 shows case 12300 of FIG. 123 storing two credit cards and detached from DMD case 3410 of FIG. 34. FIGS. 123 and 124 are best viewed together with the following description.

Credit card case 12300 stores one or more credit cards 12314 (and other similarly shaped objects) and may function independently of DMD case 3410 and when combined therewith. Case 12300 may also couple with cases 3702, 3902, 4202, 7210, and 7610 of FIGS. 37, 39, 42, 72, and 76 with inappropriate configuration of the required coupling mechanism 3600, 3800, 4110, 7222, and 7618, respectfully. That is, case 12300 may be configured with attachment mechanisms other than for coupling with slotted rails 3408 of case 3410 as shown without departing from the scope hereof.

Case 12300 is formed with a domed lid 12302 and a base 12304 that fixedly couple together to form a storage area

12308. When coupled with base 12304, domed lid 12302 is shaped to form a slot 12310 that facilitates insertion of credit card 12314 and an access notch 12312 that allows a user to insert a finger or thumb to remove credit card 12314 from storage area 12308 through slot 12310. Base 12304 has two spring clips 12306(1) and (2) that retain credit card 12314 within storage area 12308, but that are compressible to allow the user to remove the credit card. Spring clips 12306 are for example molded as part of base 12304.

Figure 125:
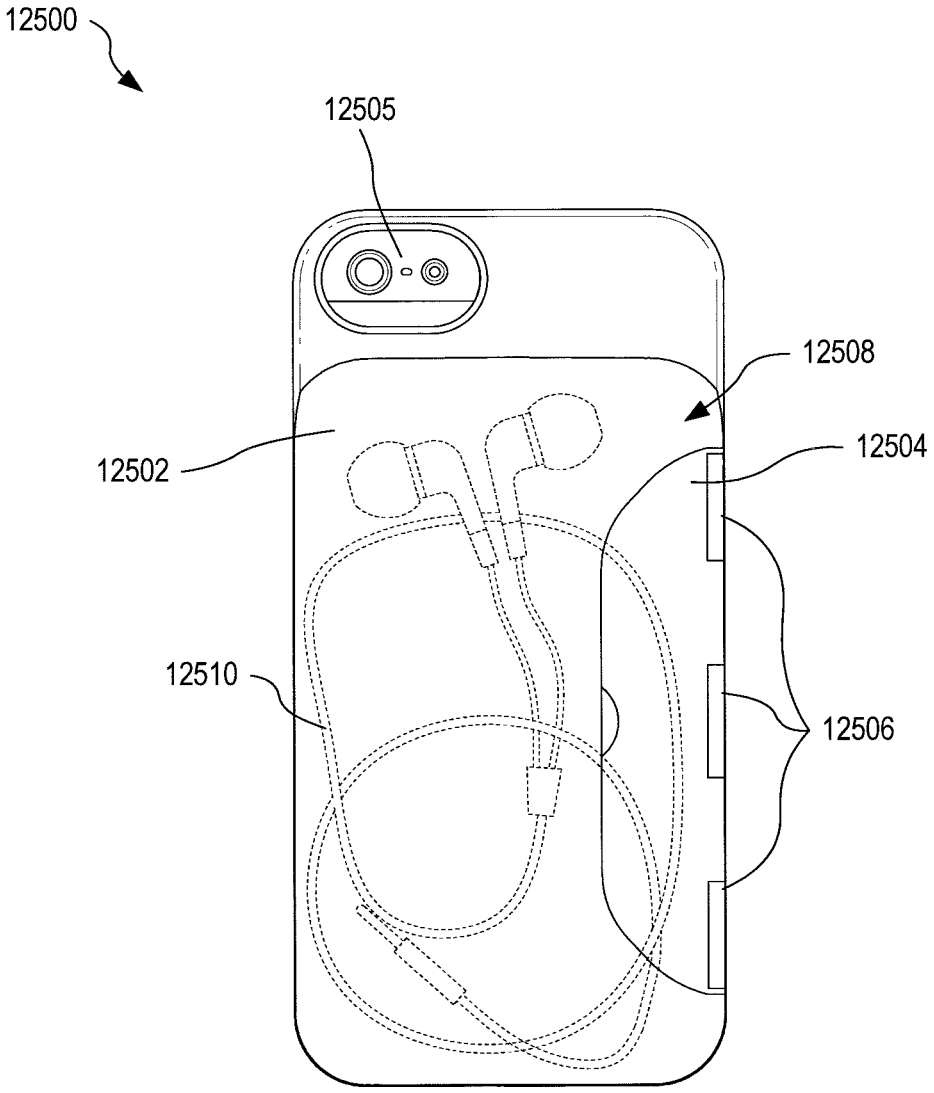
FIGS. 125 and 126 show one exemplary combined DMD protection and earphone storage case that has an access door positioned to one side of a domed portion that forms a storage area, in an embodiment.
Figure 126:
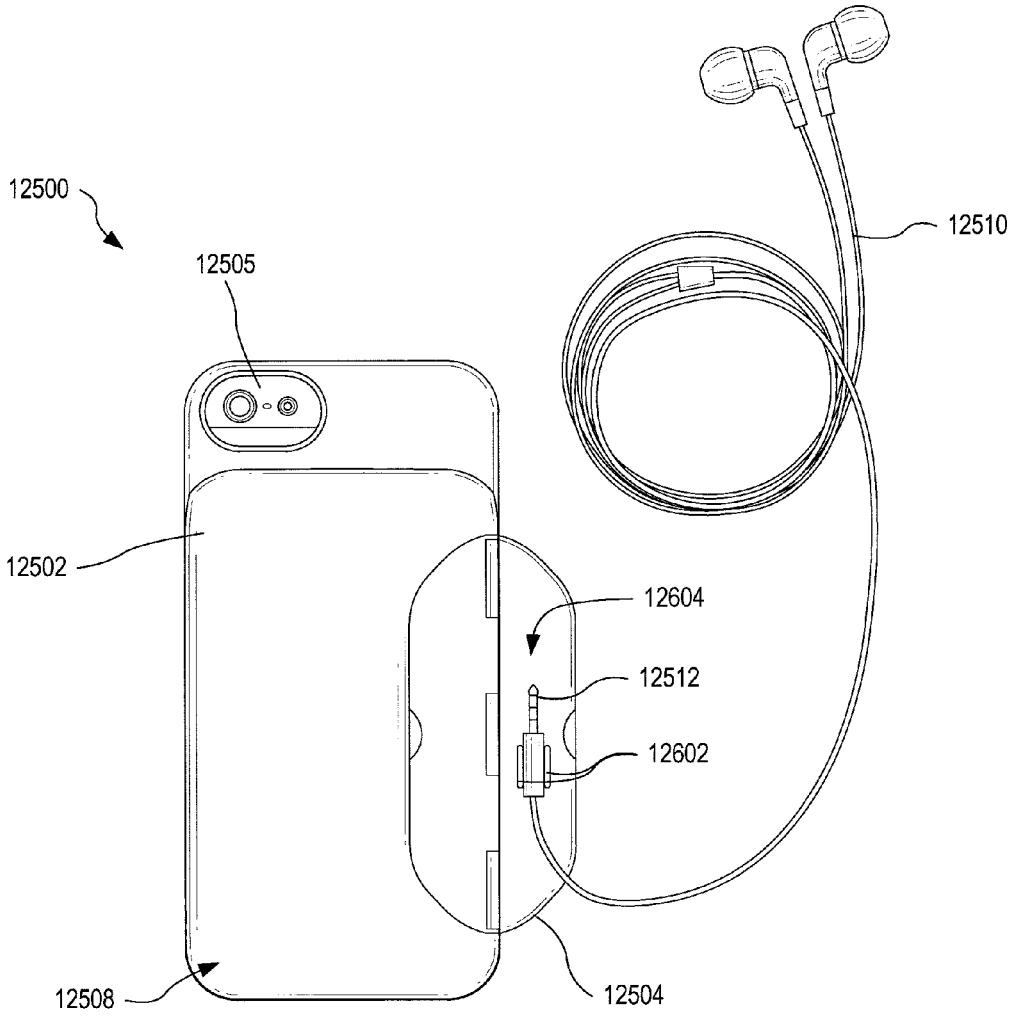

FIGS. 125 and 126 shows one exemplary combined DMD protection and earphone storage case 12500 that has an access door 12504 positioned to one side of a domed portion 12502 that forms a storage area 12508. FIGS. 125 and 126 are best viewed together with the following description. Case 12500 is shown coupled to a DMD 12505 and is similar in shape and size to case 700 of FIG. 7.

Access door 12504 is attached by hinges 12506 that allow access door 12504 to open to provide access to storage area 12508 and to retain objects (e.g., an earphone set 12510) within storage area 12508 when closed. Case 12500 is shown storing earphone set 12510, but may be used to store other similarly sized items without departing from the scope hereof.

As shown in FIG. 126, an inside surface 12604 of access door 12504 is optionally configured with retaining clips 12602 that may be used to capture a jack 12512 of earphone set 12510, thereby facilitating easy retrieval of earphone set 12510 from storage area 12508 and preventing tangling of earphone set 12510 within storage area 12508. Retaining clips may take other form, as shown in FIGS. 60-67, to provide a keyed coupling to certain earphone sets. Retaining clips 12602 may be sized and shaped to retain other parts (e.g., cable and/or earpieces) of the earphone set without departing from the scope hereof.

Figure 127:
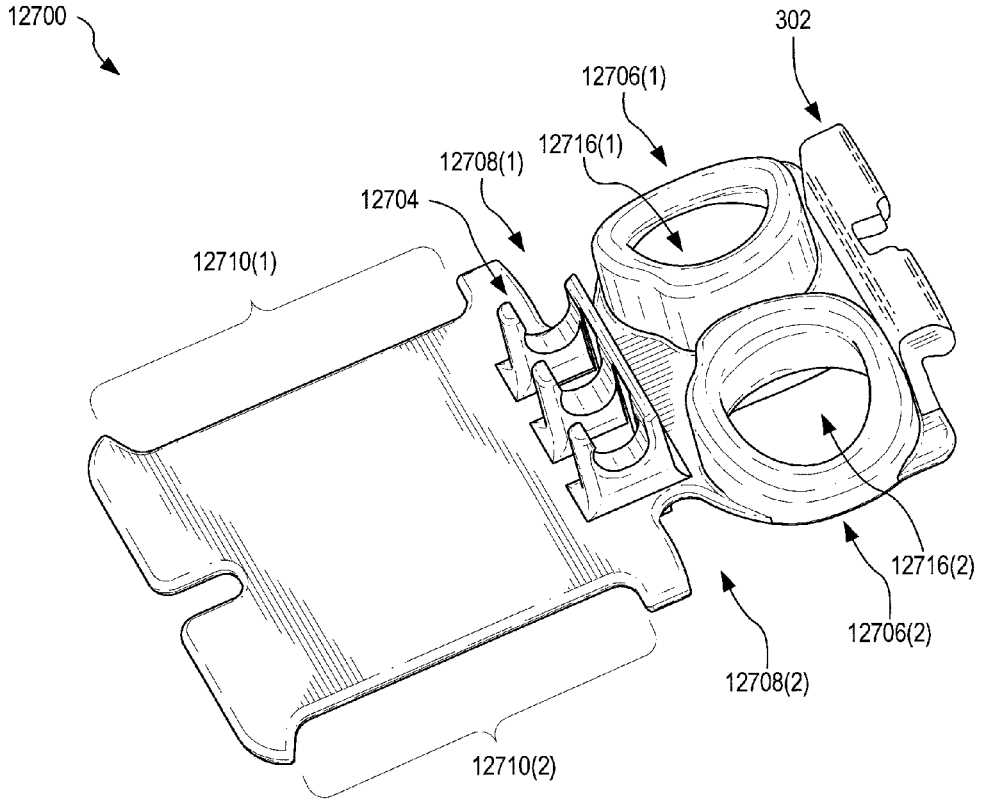
FIG. 127 is a perspective view of one exemplary keyed caddy for storing an earphone set proximate a DMD, in an embodiment.
Figure 128:
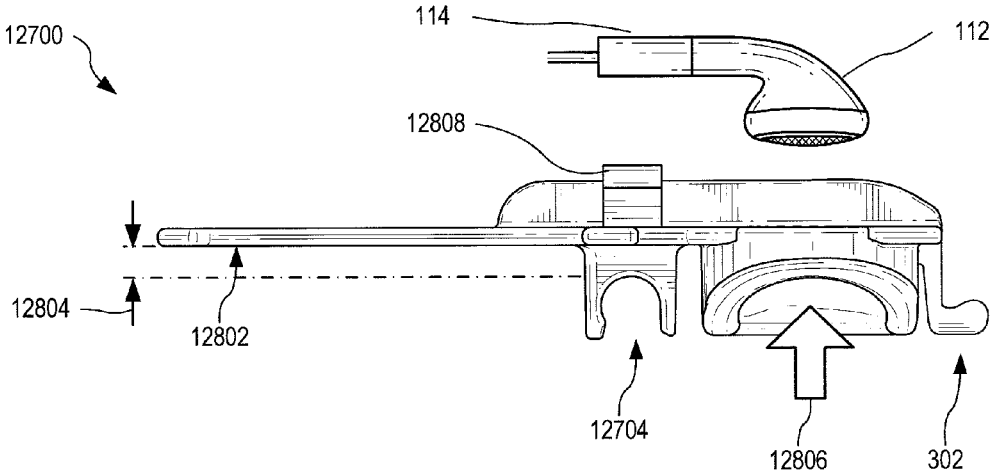
FIG. 128 is a side view of the keyed caddy of FIG. 127 illustrating ejection of an earpiece.

FIG. 127 is a perspective view of one exemplary keyed caddy 12700 for storing an earphone set (e.g. earphone set 100 of FIG. 1) proximate a DMD. FIG. 128 is a side view of keyed caddy 12700 of FIG. 127 illustrating ejection of earpiece 112 of earphone set 100 of FIG. 1. FIGS. 127 and 128 are best viewed together with the following description.

Keyed caddy 12700 is similar to keyed caddy 300 of FIG. 3, and includes three additional features that improve operation of keyed caddy 12700, as compared to operation of keyed caddy 300. Keyed caddy 12700 is a contoured plate with contoured portions 12706(1)-(2) for receiving earpieces 112 and with winding notches 12710(1)-(2) around which cable 104 and wires 106 of the earphone set are wrapped. The contoured plate of caddy 300 also includes stem retaining clips 12808 into which stems 114 of earpieces 112 snap, and a jack retaining clip 12704 into which jack plug 102 snaps, such that earphone set 100 is held by keyed caddy 12700.

Caddy 12700 is also configured with first keyed coupling 302 that is mateable with second keyed coupling 710 within storage case 700, such that when mated, first keyed coupling 302 and second keyed coupling 710 removably secure caddy 12700 within storage area 708 of keyed storage case 700.

Caddy 12700 is also configured with additional deep notches 12708(1) and (2) proximate the jack retaining clip 12704 that form a narrow portion of the contoured plate to allow a user to adjust the winding length of cable 104 and wires 106 such that jack plug 102 may be snapped into jack retaining clip 12704 to compactly hold earphone set 100 on caddy 12700. Further, jack retaining clip 12704 is configured to capture and position jack plug 102 a distance 12804 above a surface 12802 of the contoured plate to facilitate removal of jack plug 102 from jack plug retaining clip 12704. That is, when snapped into jack plug retaining clip 12704, a user's finger may get between surface 12802 and jack plug 102 such that jack plug 102 is easily extricated from jack plug retaining clip 12704.

Removal of earpieces 112 from contoured portions 12706 (1)-(2) is facilitated by enlarged (as compared to caddy 300) openings 12716(1) and (2), respectively, that allow the user to push from the reverse side of the contoured plate (e.g., using a finger in the direction indicated by arrow 12806), earpieces 112 out of contoured portions 12706 such that the stems of the earpieces are released from stem retaining clips 12808.

Figure 129:
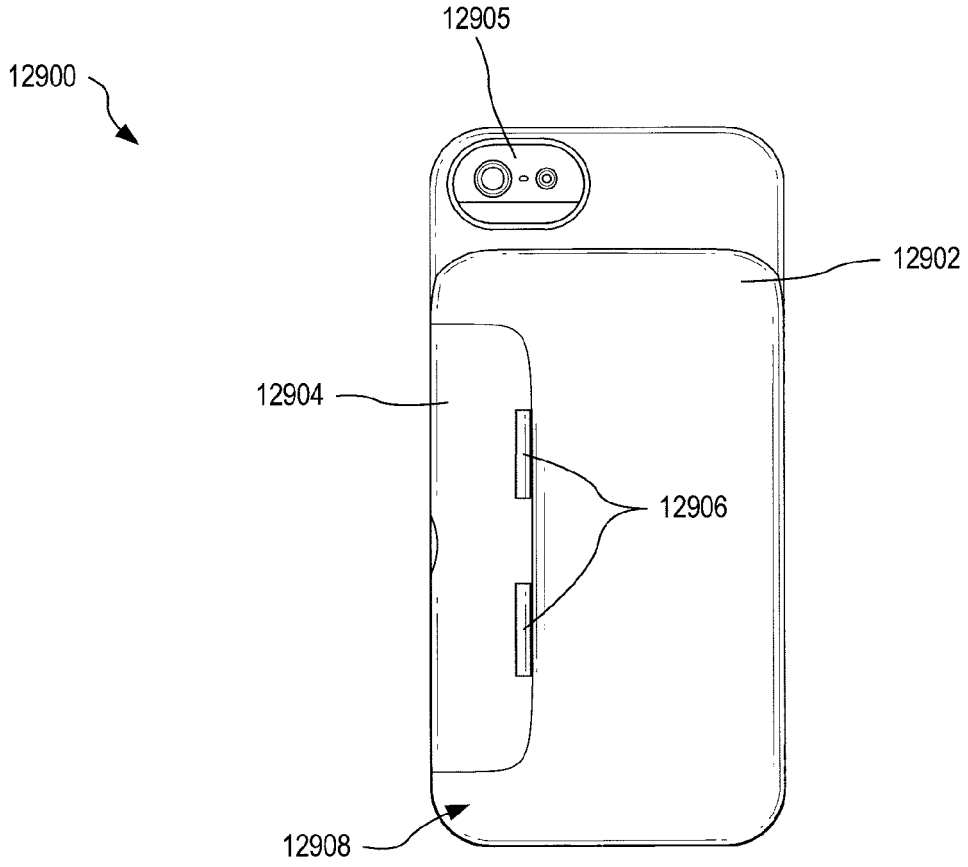
FIGS. 129 and 130 show one exemplary combined DMD protection and earphone storage case that has an access door (a) positioned to one side of a domed portion that forms a storage area, and (b) operable as a stand for the DMD, in an embodiment.
Figure 130:
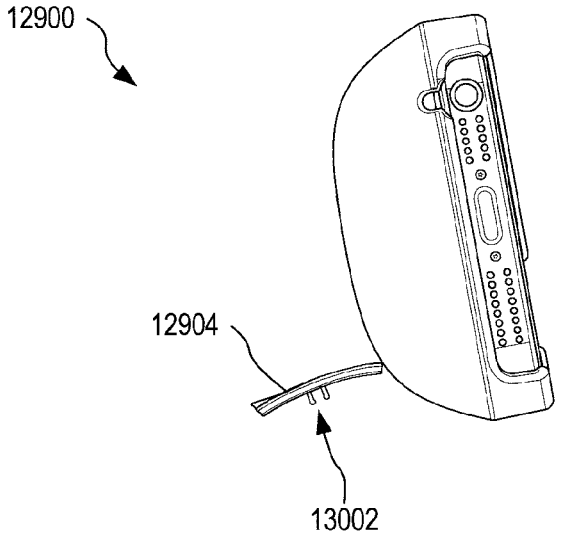

FIGS. 129 and 130 show one exemplary combined DMD protection and earphone storage case 12900 that has an access door (a) positioned to one side of a domed portion that forms a storage area, and (b) operable as a stand for the DMD 12905, in an embodiment. Case 12900 is similar to case 12500 of FIGS. 125 and 126, and is formed with a door 12904 that is on the opposite side of the storage areas 12908 (as compared to case 12500) and door 12904 is hinged, by hinges 12906, on a side nearer the center of storage area 12908 as shown, as compared to hinges 12506 that are proximate a side of case 12500. As shown in FIG. 130, door 12904 also operates as a stand for DMD 12905.

Benefits to the Consumer

There are several advantages for consumers to use a keyed caddy (e.g., keyed caddies 300, 500) that is specifically configured for capturing and holding a particular earphone set, where the keyed caddy couples with a case that is specifically configured for a particular DMD. The use of the keyed caddy storage system provides a simple, elegant, and ergonomic solution to a number of problems, including managing an earphone set that is a separate piece of equipment that is difficult to store safely when not in use. For example, consider the following points:

a) Earphone sets are an optional piece of separate equipment for some DMDs and are often used intermittently, making it a difficult for users to know when to go through the trouble of locating and organizing them, and deciding when to bring them along. Earphones are often forgotten when they are stored separately from the DMD. The keyed caddy storage system makes it easy for the user to store the earphone sets with the DMD and thereby remember to bring the earphone set along. The conveniently concealed and ergonomically designed earphone set storage compartment is integral with the protective case for the DMD.

b) Earphone sets were difficult to store and are easily damaged, for example when placed loosely in a pocket or wrapped around the DMD, since they are exposed to hazards and additional wear and tear. The keyed caddy storage system organizes the earphone set, eliminates tangles, and protects fragile components against damage.

c) The keyed caddy of the keyed caddy storage system allows the consumer to easily store the earphone set in the most compact and secure form such that the consumer has the convenience of having earphone set storage and DMD protection in single compact case, providing convenience of locating and using the earphone set at any time.

Benefits to DMD Manufacturers

The keyed caddy storage system provides several benefits for DMD manufacturers (e.g., Apple™) that manufacture and sell DMDs and earphone sets, even where the earphone set is optionally bundled with the DMD. Consider the following points:

a) The DMD manufacturer may create a line of protective cases (e.g., case 700) and keyed caddy (e.g., caddies 300, 500 of FIGS. 3 and 5, respectively) that exclusively pair their DMD and their earphone set. This exclusive pairing of the keyed caddy storage system provides the manufacturer with a competitive advantage over companies that manufacture and sell earphone sets, by offering the advantage of compact earphone set storage with the DMD. Specifically, the keyed caddy storage system steers the consumer to purchase the paired earphone set for the DMD.

b) The keyed caddy storage system directs consumers away from single purpose protective cases made by third party case makers, by offering a paired storage solution. The keyed caddy storage system offers functional advantages over conventional DMD protective cases.

c) The keyed caddy storage system allows only certain earphone sets to be captured by the keyed caddy and stored within the paired case. That is, the keyed caddy is configured for a particular earphone set and keyed to the protective case for the DMD. The keyed caddy storage system provides additional revenue possibilities for the mobile device maker through cross marketing.

d) The keyed caddy storage system may compel many consumers to continue using the Original Equipment Manufacturer (OEM) earphone sets originally supplied with the DMD, rather than purchase earphone sets from other manufacturers that cannot be captured by the keyed caddy. That is, consumers will question the value of switching to other earphone sets that cannot be captured by the keyed caddy for storage within the case. Consumers are more likely to purchase a new OEM earphone set to replace the originals as they wear out.

e) A DMD manufacturer using the keyed caddy storage system benefits by including a keyed caddy with each DMD and/or earphone set package. For example, where the manufacturer supplies the keyed caddy with each DMD and/or earphone set, consumers are steered to purchase and use the paired earphone set with the DMD.

f) Only earphone sets that have a keyed caddy, (i.e., where the keyed caddy is specifically configured for capturing that particular earphone set) may be stored in the paired case. Products of other earphone set manufacturers (e.g., Skull Candy™, Klipsh™, BOSE™) are therefore not compatible with the keyed caddy.

Benefits to Earphone Set Manufacturers

The keyed caddy storage system provides several benefits for earphone set manufacturers. Consider the following points:

a) An earphone set manufacturer might utilize the keyed caddy storage system to create a product line of protective cases designed to be "in theme" with their own line of earphone set products. Optionally, the keyed caddy storage system case could be configured to protect a DMD from another manufacturer. The earphone set manufacturer would thereby gain a competitive advantage over other manufacturers of earphone sets that do not offer a line of designer earphone sets that are exclusively themed with cases that protect a DMD and store the paired earphone set in the same single case.

b) The keyed caddy storage system provides an incentive for an earphone set manufacturer to expand into making protective cases. The keyed caddy storage system physically pairs an earphone set with a protective case and may increase revenues for the manufacturer, because production of the protective case becomes linked to the earphone set market.

c) The use of the keyed caddy storage system by manufacturers of earphone sets will make the protective cases and earphone sets offered by other earphone sets companies less desirable to own, since they are not as compact or convenient.

Benefits to Case Manufactures

The keyed caddy storage system provides several benefits for DMD case manufacturers. Consider the following points:

a) A case manufacturer would have the only case that can efficiently manage both a pair of earphone sets and a DMD. No other case can be designed to be as compact.

b) The manufacturer has the ability to produce cases for earphone set manufacturers thus providing earphone set manufacturers with an advantage over their competition.

c) The manufacturer has the ability to produce cases for DMD manufacturers thus providing the DMD manufacturer with an advantage over their competition.

d) The keyed caddy storage system may compel the case manufacturer to develop their own line of earphone sets to sell to the public.

Disadvantages of Non-Exclusive Dual Purposes Protective Cases

Manufacturers of DMDs, earphone sets, and protective cases, may manufacture a universal storage case that accommodates a wide variety of earphone sets. However, the universal storage case (with or without a caddy) requires that the case be larger to accommodate all possible earphone set styles and forms, resulting in a bulky design that has wasted space as compared to the compact design made possible by the keyed caddy storage system. The bulky design makes the DMD, when protected by the case, more difficult use, and less convenient to slip into a pocket or purse. Universal cases are not keyed and therefore do not provide the manufacturer with a competitive advantage of linking their products together in paired relationships.

Advantages of the Combo (Two-in-One) Case to Manufacturers of DMD's

Most all manufacturers of DMD's include in the retail packaging for use by the consumer a set of companion earphone set along with the DMD. By organizing the retail packaging of the DMD without a DMD protective cover, and while packaging the companion earphones inside a keyed storage compartment, the DMD/earphone manufacturer creates an opportunity to sell additional products in the form of a line of separately sold DMD protective cases which may be offered in different colors, styles levels of protection, and price points. All of which can mate with the earphone case contained within the retail packaging.

The purchaser of the DMD may determine that having the two devices contained in a two-in-one case arrangement is an important lifestyle of business choice and so may choose instead to purchase a matable case sold by the DMD/Earphone manufacturer rather than a single purpose case sold by third party case manufactures.

Advantages of the Two-in-One Case to Manufacturers of Earphones.

Manufacturers of earphones may benefit by including a keyed earphones storage compartment in their retail packaging.

More expensive higher end earphones often come packaged with a protective case. Customers making a significant investment in high-end audio earphones expect manufacturers of earphones to provide some type of protective case inside the retail packaging. These protective earphone cases are often discarded because they are difficult to use, difficult to keep track of and thus frequently lost or misplaced or forgotten. Even when they are regularly used for the storage and protection of the earphones, it still requires the DMD user to keep track of two separate pieces of equipment. Greater customer satisfaction is achieved and their earphones are better protected.

When packaging a earphone set with companion storage case, one that is keyed and mateable to a separately sold line of DMD protective cases, the earphone manufacturer creates an opportunity to sell additional products. These separately sold DMD protective cases can be offered in different colors, styles, levels of protection and price points, all of which are mateable and keyed to a specific style of earphone and companion earphone case as determined by the manufacturer.

The purchaser of the earphone may determine that having the two devices contained in a two-in-one ergonomic dual-purpose case arrangement is an important lifestyle of business choice and so may choose instead to purchase a mateable case sold by the earphone manufacturer rather than a single purpose case sold by third party case manufactures.

Advantages of the Combo Case to Manufacturers of DMD Protective Cases

Protective case manufacturers are focused primarily on selling protective cases for DMDs and have done little to help the consumer efficiently manage, control or store earphone sets for transport together with the DMD.

Manufacturers of DMD protective cases can benefit by manufacturing dual-purpose two-in-one combo DMD/earphone protective cases. They would be able to form relationships with manufacturers of DMD's and manufacturers of earphones to create unique cross marketing opportunities. By strategically partnering with a DMD and a earphone manufacture, a case maker would be able to offer OEM cases to both companies to serve the needs of targeted marketing campaigns. A DMD manufacturer and a earphone manufacturer may benefit by contracting with a famous personality to create a limited addition matching DMD/Earphone/two-in-one.

By manufacturing dual-purpose two-in-one combo DMD/earphone protective cases, case manufacturers have reason expand their business platform and offer their own propriety line of earphones keyed to match their own cases. By controlling the ability to create and sell dual-purpose keyed cases, barriers to entry by a case manufacturer are lowered.

A case manufacturer, manufacturing a line of dual-purpose two-in-one combo DMD/earphone protective cases, would possess a significant competitive advantage over other case makers manufacturing single purpose DMD protective cases.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween. In particular, the following embodiments are specifically contemplated, as well as any combinations of such embodiments that are compatible with one another:

A. A keyed caddy storage system for storing an earphone set proximate a digital media device (DMD), comprising: a first caddy configured for holding the earphone set and having a first keyed coupling; and a case configured for attachment to the DMD and forming a storage area for storing the earphone set held by the first caddy, the case having a second keyed coupling mateable with first keyed coupling to removably secure the first caddy within the storage area.

B. The keyed caddy storage system of embodiment A, the first and second keyed couplings comprising irregularly shaped features that interleave with one another when mated.

C. The keyed caddy storage system of embodiment B, wherein the irregularly shaped features prevent each of the first and second keyed couplings from coupling with a non-mateable keyed coupling.

D. The keyed caddy storage system of embodiments A through C, wherein the second keyed coupling is positioned within the storage area.

E. The keyed caddy storage system of embodiments A through D, the case comprising a lid to provide external access to the storage area and wherein the second keyed coupling is positioned within the lid.

F. The keyed caddy storage system of embodiments A through E, wherein the first and second keyed coupling form a matched pair that is one of a plurality of matched pairs.

G. The keyed caddy storage system of embodiments A through F, further comprising a second caddy configured for holding a second earphone set and having the first keyed coupling such that the second caddy may be removably secured within the storage area.

H. The keyed caddy storage system of embodiments A through G, further comprising a second case configured to attach with a different DMD and having a second storage area for storing the first caddy with the earphone set mounted thereon, wherein the second case is configured with the second keyed coupling to removably secure the first caddy within the second storage area.

I. A keyed caddy for storing and protecting an earphone set proximate a digital media device (DMD), including: a contoured plate configured to hold the earphone set such that cables of the earphone set are wrappable about the contoured plate, the contoured plate having a first keyed coupling that mates with a second keyed coupling formed with a case that (a) forms a storage area for the contoured plate holding the earphone set and (b) attaches with the DMD.

J. The keyed caddy of embodiment I, wherein the first keyed coupling removably couples with the second keyed coupling to secure the caddy within the storage area.

K. The keyed caddy of embodiments I or J, wherein the first keyed coupling and second keyed coupling pair the keyed caddy to the case.

L. The keyed caddy of embodiments I through K, wherein earpieces of the earphone set are snappable to the contoured plate.

M. A case for storing an earphone set proximate a digital media device (DMD), including: a base component that attaches to the DMD; a lid component that couples with the base component to form a storage area; and a first keyed coupling for removably mating with a second keyed coupling of a keyed caddy configured to hold the earphone set;

wherein the first keyed coupling and the second keyed coupling form a matched pair and are non-mateable with a keyed coupling of a different matched pair.

N. The case of embodiment M, the first keyed coupling being formed with the base component and located within the storage area.

O. The case of embodiment M, the first keyed coupling being formed with the lid component and located within the storage area.

P. A method for storing an earphone set proximate a digital media device (DMD), including the steps of: forming a case that attaches to the DMD and has a second keyed coupling and a storage area; and forming a keyed caddy with a first keyed coupling matched with the second keyed coupling, such that the first and second keyed couplings are removably mated to position the earphone set held by the keyed caddy within the storage area.

Q. The method of embodiment P, wherein the steps of forming comprise forming irregularities in the keyed couplings that interleave with one another when mated.

R. The method of embodiment Q, the irregularities inhibiting mating of the first and second keyed couplings with non-matched keyed couplings.

S. A method for uniquely coupling an earphone storage case to a digital media device (DMD) case, including the steps of: configuring the earphone storage case with a first keyed coupling; and configuring the DMD case with a second keyed coupling that matches the first keyed coupling; wherein the first and second keyed couplings removably mate to secure the earphone storage case to the DMD case.

T. The method of embodiment S, wherein the first and second keyed couplings comprise irregularities that interleave when coupled together.

U. The method of embodiment T, wherein the irregularities inhibit coupling of non-matched keyed couplings.

V. The method of embodiment S through U, further including the steps of: configuring the earphone storage case with a third keyed coupling; and configuring a keyed caddy with a fourth keyed coupling;

wherein the third and fourth keyed couplings are matched to uniquely mate, such that the third and fourth keyed couplings removably mate to position an earphone set held by the keyed caddy within a storage area of the earphone storage case.

W. Product packaging for a digital media device (DMD) and accompanying earphone set to promote sale of a DMD case, including: keyed caddy having a first keyed coupling and configured to hold the earphone set; and container for containing the DMD and the earphone set held by the keyed caddy;

wherein the first keyed coupling matches a second keyed coupling of the DMD case.

X. The product packaging of embodiment W, wherein each of the first and second keyed couplings comprise irregularities that interleave when mated to couple the keyed caddy and the DMD case together.

Y. The product packaging of embodiment X, wherein the irregularities inhibit coupling of each of the first and second keyed couplings to non-matched keyed couplings.

Z. The product packaging of embodiments W through Y, further comprising a second keyed caddy having the first keyed coupling for holding a second earphone set.

AA. A method of designing an earphone caddy to store an earphone set within an earphone set storage case, including the steps of: forming a caddy to hold the earphone set; and configuring the caddy with a first keyed coupling that uniquely couples with a second keyed coupling of the earphone storage case;

wherein each of the first and second keyed couplings comprise irregularities that interleave when the caddy and the earphone set storage case are mated.

BB. The method of embodiment AA, wherein the irregularities inhibit mating of each of the first and second keyed coupling to non-matched keyed couplings.

CC. A case for storing an earphone set proximate a digital media device (DMD), including: a base component that attaches with the DMD and forms a storage area that is accessible via an aperture in the base component; and a lid component that couples with the base component to close the aperture, an inner surface of the lid having a first keyed coupling that holds a component of the earphone set.

DD. The case of embodiment CC, wherein the first keyed coupling is mateable with a second keyed coupling formed on a jack plug of the earphone set.

EE. The case of embodiment DD, wherein the first and second keyed couplings form a matched pair and are non-mateable with a keyed coupling of a different matched pair.

FF. The case of embodiments CC through EE, wherein lid is positioned to one side of the base component and functions, when opened, as a stand for the DMD.

GG. A keyed caddy for storing and protecting an earphone set proximate a digital media device (DMD), including: a contoured plate configured to hold the earphone set such that cables of the earphone set are wrappable about, earpieces and a jack plug of the earphone set are snappable to, the contoured plate;

wherein the contoured plate has a first keyed coupling that mates with a second keyed coupling formed with a case that (a) forms a storage area for the contoured plate holding the earphone set and (b) attaches with the DMD.

HH. The keyed caddy of embodiment GG, the contoured plate having (c) stem retaining clips into which stems of the earpieces snap, and (d) a jack retaining clip into which the jack plug snaps.

II. The keyed caddy of embodiment HH, the jack retaining clip configured to hold the jack plug a predefined distance above the surface of the contoured plate to facilitate removal of the jack plug from the jack retaining clip.

JJ. The keyed caddy of embodiments GG through II, the contoured plate having, for each of the earpieces, a contoured area shaped to receive one of the earpieces, wherein the contoured area has an aperture for ejecting the earpiece from the contoured plate.

KK. The keyed caddy of embodiments GG through JJ, the contoured plate having, proximate the jack retaining clip, a narrowed portion that facilitates snapping the jack plug into the jack retaining clip.

LL. A combination case for protecting a digital media device (DMD) and for storing an earphone set having two wireless earpieces proximate the DMD, comprising:

a base component that attaches with, and protects, the DMD;

a raised portion, positioned on the rear external face of the base component, shaped to receive each earpiece of the wireless earphone set; and two connectors that each mechanically couple with one of the wireless earpieces to removably retain each wireless earpiece.

MM. The combination case of embodiment LL, wherein the wireless earpieces and the raised portion are matched such that non-matches earpieces cannot be stored within the raised portion.

NN. The combination case of embodiments LL and MM, further comprising electrical contacts positioned on an internal surface of the base component to electrically couple with a DMD such that the DMD charges rechargeable batteries within the earpieces stored within the raised portion.

OO. The combination case of embodiment LL, further comprising a rechargeable battery positioned within the raised portion and electrically coupled with both the two connectors to provide power to recharge the earpieces when stored within the raised portion.

PP. The combination case of embodiments LL and OO, further comprising electrical contacts positioned on an internal surface of the base component to electrically couple with a DMD such that the DMD, when electrically coupled with a power source, charges the rechargeable battery.

QQ. The combination case of embodiments LL, OO and PP, further comprising an electrical connector positioned on an external surface of the raised portion for receiving electrical power to charge the rechargeable battery.

What is claimed is:

1. A keyed caddy storage system for storing an earphone set proximate a digital media device (DMD), comprising:

a first caddy configured for holding the earphone set and having a first keyed coupling;

a case configured for attachment to the DMD and forming a storage area for storing the earphone set held by the first caddy, the case having a second keyed coupling mateable with first keyed coupling to removably secure the first caddy within the storage area.

2. The keyed caddy storage system of claim 1, the first and second keyed couplings comprising irregularly shaped features that interleave with one another when mated.

3. The keyed caddy storage system of claim 2, wherein the irregularly shaped features prevent each of the first and second keyed couplings from coupling with a non-mateable keyed coupling.

4. The keyed caddy storage system of claim 1, wherein the second keyed coupling is positioned within the storage area.

5. The keyed caddy storage system of claim 1, the case comprising a lid to provide external access to the storage area and wherein the second keyed coupling is positioned within the lid.

6. The keyed caddy storage system of claim 1, wherein the first and second keyed coupling form a matched pair that is one of a plurality of matched pairs.

7. The keyed caddy storage system of claim 1, further comprising a second caddy configured for holding a second earphone set and having the first keyed coupling such that the second caddy may be removably secured within the storage area.

8. The keyed caddy storage system of claim 1, further comprising a second case configured to attach with a different DMD and having a second storage area for storing the first caddy with the earphone set mounted thereon, wherein the second case is configured with the second keyed coupling to removably secure the first caddy within the second storage area.

* * * * *